US007516536B2

(12) United States Patent
Suzuki

(10) Patent No.: US 7,516,536 B2
(45) Date of Patent: Apr. 14, 2009

(54) METHOD OF PRODUCING POLISHING PAD

(75) Inventor: Tatsutoshi Suzuki, Yokkaichi (JP)

(73) Assignee: Toho Engineering Kabushiki Kaisha (JP)

( * ) Notice: Subject to any disclaimer, the term of this patent is extended or adjusted under 35 U.S.C. 154(b) by 662 days.

(21) Appl. No.: 11/301,361

(22) Filed: Dec. 12, 2005

(65) Prior Publication Data

US 2006/0154577 A1 Jul. 13, 2006

Related U.S. Application Data

(60) Continuation-in-part of application No. 10/830,567, filed on Apr. 23, 2004, now Pat. No. 7,104,868, which is a division of application No. 10/026,504, filed on Dec. 19, 2001, now Pat. No. 6,869,343.

(51) Int. Cl.
*B23P 15/00* (2006.01)

(52) U.S. Cl. ..... 29/558; 409/293; 409/304; 409/345; 82/1.11

(58) Field of Classification Search ..... 29/557–558, 29/27 C, 27 R; 409/293, 304, 305, 345, 308, 409/288; 82/1.11
See application file for complete search history.

(56) References Cited

U.S. PATENT DOCUMENTS

| | | | |
|---|---|---|---|
| 798,856 | A | 9/1905 | Wetter |
| 1,410,451 | A | 3/1922 | Bullard et al. |
| 1,416,843 | A | 5/1922 | Labonte |
| 2,701,192 | A | 2/1955 | Maass |
| RE25,955 | E | 2/1966 | Emmons |
| 3,466,721 | A | 9/1969 | Binns |
| 4,063,841 | A | 12/1977 | Niman, Jr. |
| 4,474,721 | A | 10/1984 | Carpenter |
| 5,031,491 | A | 7/1991 | Hofmann |

(Continued)

FOREIGN PATENT DOCUMENTS

| | | |
|---|---|---|
| JP | 47-16044 | 6/1972 |

(Continued)

OTHER PUBLICATIONS

The Science of CMP; Aug. 20, 1997; pp. 113-119; Chapter 4, Part III "Structure and Feature of the polishing pad". (Partial Translation).

*Primary Examiner*—Erica E Cadugan
(74) *Attorney, Agent, or Firm*—Rossi, Kimms & McDowell LLP

(57) ABSTRACT

A method of manufacturing a grooved polishing pad wherein a large number of grooves, extending parallel to each other, are fabricated at specific intervals on at least one of a front surface and a back surface of a polishing pad substrate through a groove cutting process on the polishing pad substrate which is made from a synthetic resin material, the method comprising the steps of: cutting, by using a multi-edged tool having a plurality of pad groove machining cutting parts, arrayed at equal spacing p with the spacing p being an integer multiple no less than 2 of a desired spacing d of the grooves, a plurality of the grooves; and repeating the cutting of the plurality of grooves through shifting the multi-edged tool in a direction in which the pad groove machining cutting parts are arrayed, in order to fabricate the large number of grooves, extending parallel to each other, with the desired spacing d.

16 Claims, 60 Drawing Sheets

U.S. PATENT DOCUMENTS 5,067,377 A 11/1991 Dona et al.
5,081,051 A * 1/1992 Mattingly et al. ..... 451/56
5,205,678 A 4/1993 Britsch et al.
5,329,735 A 7/1994 Charlton et al.
5,370,023 A 12/1994 Morgan et al.
5,398,458 A 3/1995 Henriksen et al.
5,578,362 A 11/1996 Reinhardt et al.
5,921,855 A 7/1999 Osterheld et al.
5,984,769 A 11/1999 Bennett et al.
6,206,759 B1 3/2001 Agarwal et al.
6,227,771 B1 5/2001 Lagerberg et al.
6,238,271 B1 5/2001 Cesna
6,241,585 B1 6/2001 White
6,340,325 B1 1/2002 Chen et al.
6,406,363 B1 6/2002 Xu et al.
6,439,989 B1 8/2002 Reinhardt et al.
6,464,563 B1 10/2002 Lensing
6,488,575 B2 12/2002 Agarwal et al.
6,520,847 B2 2/2003 Osterheld et al.
6,544,104 B1 4/2003 Koike et al.
6,561,891 B2 5/2003 Eppert, Jr. et al.
6,572,445 B2 6/2003 Laursen
6,602,436 B2 8/2003 Mandigo et al.
6,632,129 B2 10/2003 Goetz
6,641,471 B1 11/2003 Pinheiro et al.
6,656,019 B1 12/2003 Chen et al.
6,656,030 B2 12/2003 Xu et al.
6,685,548 B2 2/2004 Chen et al.
6,688,957 B2 2/2004 Tolles
6,736,714 B2 5/2004 Dudovicz
6,749,485 B1 6/2004 James et al.
6,749,714 B1 6/2004 Ishikawa et al.
6,758,735 B2 7/2004 Blalock
6,783,436 B1 8/2004 Muldowney
6,852,020 B2 2/2005 Petroski et al.
6,869,343 B2 3/2005 Suzuki
6,893,325 B2 5/2005 Robinson
7,017,246 B2 3/2006 Suzuki
7,044,697 B2 * 5/2006 Kodaka et al. ..... 409/304
7,104,868 B2 * 9/2006 Suzuki ..... 451/28
7,140,088 B2 * 11/2006 Suzuki ..... 29/557
7,234,224 B1 * 6/2007 Naugler et al. ..... 29/557
2003/0003857 A1 1/2003 Shimagaki et al.
2004/0014413 A1 1/2004 Kawahashi et al.
2004/0045419 A1 * 3/2004 Bryan et al. ..... 83/13
2007/0034614 A1 * 2/2007 McClain et al. ..... 219/121.69
2007/0082587 A1 * 4/2007 Hosaka et al. ..... 451/56
2008/0153398 A1 * 6/2008 Sung ..... 451/56

FOREIGN PATENT DOCUMENTS

JP 63-22002 6/1988
JP 11-70463 3/1999
JP 2000-94303 4/2000
JP 2001-018164 A 1/2001
JP 2002-011630 A 1/2002
JP 2002-184730 A * 6/2002

* cited by examiner

FIG. 5A
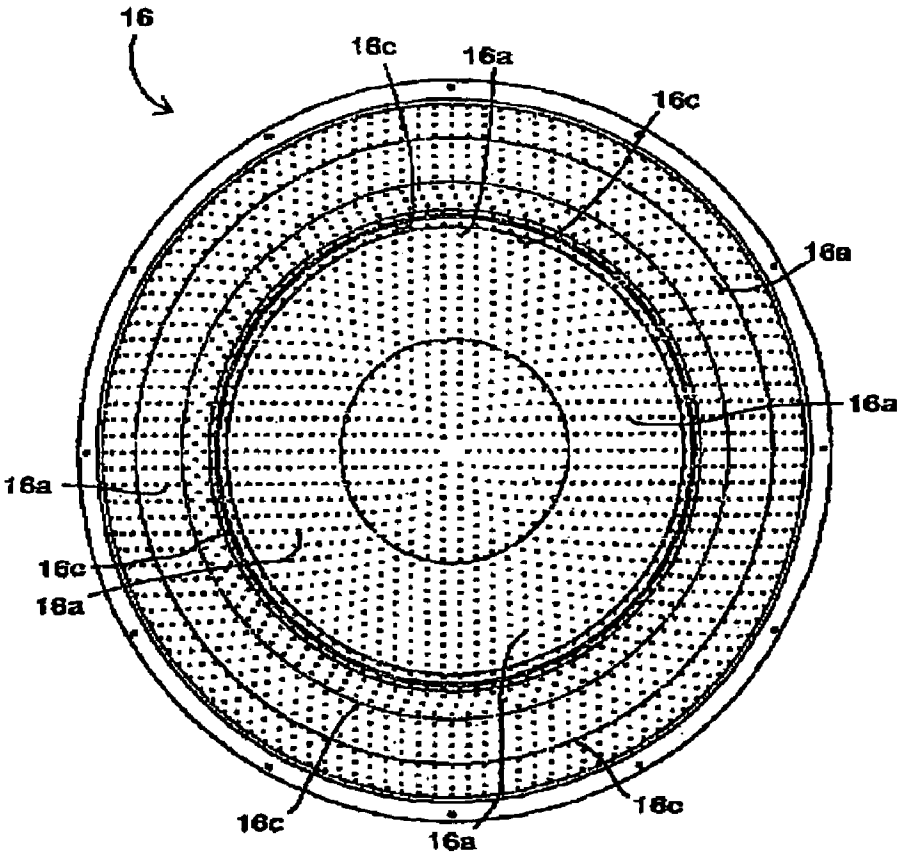
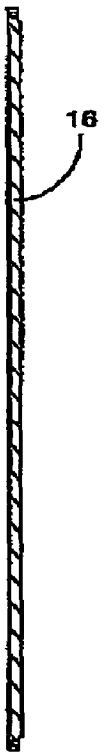
FIG. 5B
FIG. 5C
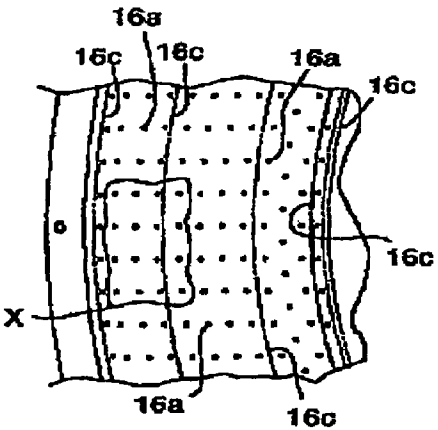

30 / 1

100 / 1

METHOD OF PRODUCING POLISHING PAD

CROSS-REFERENCE TO RELATED APPLICATION

This is a Continuation-in-Part of application Ser. No. 10/830,567 filed Apr. 23, 2004, now U.S. Pat. No. 7,104,868, incorporated herein by reference and which is a Divisional of application Ser. No. 10/026,504 filed Dec. 19, 2001, now U.S. Pat. No. 6,869,343.

INCORPORATED BY REFERENCE

The disclosure of Japanese Patent Application No. 2004-359025 filed on Dec. 10, 2004 including the specification, drawings and abstract is incorporated herein by reference in its entirety.

BACKGROUND OF THE INVENTION

1. Field of the Invention

The present invention relates to technologies relating to polishing pads used in, for example, the CMP method (chemical-mechanical polishing method), and, in particular, relates to a method for manufacturing grooved polishing pads wherein a multiple grooves are formed on the front surface and/or back surface thereof in order to increase the polishing precision.

2. Description of the Related Art

Conventionally, technologies have been known for polishing processes for high precision polishing of objects using polishing pads in the form of thin disks of synthetic resin materials. For example, in recent years there has been a great deal of interest in providing technologies for performing CMP of semiconductor wafers and devices with multilayer structures such as conductive layers on the surface of semiconductor layers. In particular, given increases in the density of the electronic components to be polished, there is the need for greater precision and greater efficiency polishing processes, and in CMP in particular. There have been reports of not only improvement in polishing devices, slurries, polishing pad materials, and so forth, to this end, but also reports of the effectiveness of forming grooves of the appropriate shapes on the front and or back surfaces of the polishing pads.

These types of polishing pads used in CMP are conventionally made from synthetic resin materials, and, typically, the grooves of appropriate shapes are molded at the same time as the fabrication of the polishing pads. However, given the increasingly rigorous requirements for polishing precision, the present inventors, aware of the limitations in the fabrication of grooves using molding, have been the first to propose the fabrication of grooves using a cutting (machining) process. Moreover, in this type of cutting of grooves, typically a large number of grooves adjacent one another in parallel are cut simultaneously through a multi-edged tool that is equipped with a plurality of blade edge parts arranged in parallel to one another in order to raise the efficiency of the machining cycle.

However, in order to achieve high precision polishing, as well as in order to achieve effective cutting with respect to a soft polishing pad, it is desirable to form a large number of grooves with a small pitch and a small width onto a surface of the polishing pad, as pointed out in the previous application by the present inventors. In particular, the groove widths and groove pitches have been miniaturized to their limits in order to respond to recent requirements for high levels of high precision polishing performance.

At this point, in machining of polishing pads using conventional multi-edged tools, the gaps between the individual blade edge parts provided in the multi-edged tools have become narrow due to the narrowing of the desired groove pitch. Because of this, the frictional heating that occurs repetitively in the blade edge parts due to the friction with the polishing pads is concentrated on the narrow parts positioned between the blade edge parts in the polishing pads, with the risk of causing problems such as thermal deformation of the polishing pads, which are made from synthetic resin.

Further, the narrower gaps between the individual blade edge parts will cause low air flows flowing through the gaps. This may cause deterioration in cooling performance by means of the air flows flowing through the gaps, thereby enhancing the risk of the heating problems. In order to address the heating problems, the cutting speed must be decreased, thereby lowering the machining rate.

Moreover, where the individual blade edge parts make small in the width length and the gap distance, manufacturing of the blade edge parts becomes difficult, and defects or dimensional errors of the blade edge parts may occur readily.

In addition, the narrower gaps between the individual blade edge parts may readily cause the sticking of the cutting parts against the gaps. This may further deteriorate air flows through the gaps between the individual blades, so that the resultant insufficient cooling may cause additional problems. The cutting parts stuck to gaps between adjacent blade edge parts may be welded due to the heat of the blade edge parts, thereby ragging the cutting surfaces of the grooves, leading readily to deterioration in cutting accuracy of the grooves.

SUMMARY OF THE INVENTION

It is therefore one object of this invention to provide a new method of manufacturing a grooved polishing pad, capable of fabricating a large number of grooves with a narrow groove gap and capable of producing a polishing pad that provides high-precision polishing.

The above and/or optional objects of this invention may be attained according to at least one of the following modes of the invention. The following modes and/or elements employed in each mode of the invention may be adopted at any possible optional combinations.

The present invention relates to a method of manufacturing a grooved polishing pad. A first mode of the invention provides a method of manufacturing a grooved polishing pad wherein a large number of grooves, extending parallel to each other, are fabricated at specific intervals on at least one of a front surface and a back surface of a polishing pad substrate through a groove cutting process on the polishing pad substrate which is made from a synthetic resin material, the method comprising the steps of: cutting, by using a multi-edged tool having a plurality of pad groove machining cutting parts, arrayed at equal spacing p with the spacing p being an integer multiple no less than 2 of a desired spacing d of the grooves, a plurality of the grooves; and repeating the cutting of the plurality of grooves through shifting the multi-edged tool in a direction in which the pad groove machining cutting parts are arrayed, in order to fabricate the large number of grooves, extending parallel to each other, with the desired spacing d.

Given this type of method of manufacturing a grooved polishing pad according to the present form of embodiment, a multi-edged tool that has a relatively large blade edge spacing can be used even when fabricating grooves with a small groove spacing. Consequently, it is possible to avoid the concentration at a narrower area on the polishing pad substrate of the heat due to the friction between the pad groove cutting parts and the polishing pad substrate. That is, because the blade edge spacing in the multi-edged tool is large, the heat due to friction between the cutting parts and the polishing pad substrate can be dispersed into the relatively large area of the polishing pad substrate, making it possible to avoid machining defects due to the deformation and melting of the pad, and possible to improve the machining efficiency.

Moreover, because a multi-edged tool with a large cutting edge spacing can be used, the air flow in the cutting edge spacing can be utilized to increase the cooling rate, not only making it possible to more effectively avoid machining defects due to heating of the cutting edges, but also making it possible to reduce the wear of the blade edge parts of the multi-edged tools due to heating, thereby making it possible to beneficially extend the useful life of the tool.

Furthermore, even if the groove spacing are to be made smaller, because the blade edge spacing in the multi-edged tool is an integer multiple (two times or more) of the groove spacing, the blade edge spacing can still be comparatively large. Because of this, even in those multi-edged tools that are used when fabricating grooves with narrow groove spacing, the machining can be done with relative ease when compared to the cutting edge parts for which the machining tends to be difficult, making it possible to achieve effectively the manufacturing of a multi-edged tool that is able to produce effectively the desired grooves with lower labor and high manufacturing precision.

A second mode of the invention provides a method of manufacturing a grooved polishing pad according to the aforementioned first mode, wherein the cutting of the plurality of grooves is performed by using the multi-edged tool wherein the spacing p of the plurality of cutting parts for fabricating the grooves, which are arrayed in the multi-edged tool, is twice the spacing d of the aforementioned grooves to be cut into the aforementioned polishing pad substrate.

The method for manufacturing a grooved polishing pad according to the present mode enables the fabrication of grooves in a polishing pad substrate at half the spacing of the pad groove machining cutting part, enabling the grooves that are fabricated with the desired groove spacing d to be achieved with superior machining efficiency with a relatively small number of machining steps as well as a reduced number of dislocation of the multi-edged tool in the widthwise direction.

A third mode of the invention provides a method of manufacturing a grooved polishing pad according to the aforementioned first or second mode, wherein the the plurality of grooves formed on the polishing pad substrate are circumferential grooves extending in a direction of a circumference of the polishing pad substrate.

Given the method for manufacturing grooved polishing pads according to the present mode, having the grooves that are formed in the polishing pad substrates be circumferential grooves that extend in the circumferential direction enables the specific grooves to be achieved easily through a turning process. Note that the "circumferential grooves that extend in the circumferential direction of the polishing pad substrate" in the present mode are, for example, grooves that extend in concentric circles, grooves that extend in a spiral shape, grooves that extend windingly in the circumferential direction in a petal shape, a star shape and a polygon shape, and so forth.

A fourth mode of the invention provides a method of manufacturing a grooved polishing pad according to any one of the first through third modes, wherein the cutting of the plurality of grooves is performed by using the multi-edged tool wherein the spacing p for the plurality of pad groove machining cutting parts, which are arrayed in the multi-edged tool, are such that $0.5\ \text{mm} \leqq p \leqq 30\ \text{mm}$.

Given the method for manufacturing a grooved polishing pad according to the present embodiment, not only can the setting of the groove spacing in the range as described above enable the effective use of the air flow that flows between the pad groove machining cutting parts to have a cooling effect on the blade edge parts, but also enables the achievement of superior manufacturability through preventing any remarkable increase in the amount of machining work in the machining of the grooves in the polishing pad substrate. If the spacing p of the pad groove machining cutting parts were too small, then the amount of air flow that flows between the pad groove machining cutting parts during the cutting process would be small, making it difficult to achieve adequate cooling of the pad groove machining cutting parts. On the other hand, if the spacing p between the pad groove machining cutting parts is too large, then in order to fabricate the grooves with the desired spacing d it would require a large number of repeated machining processes comprising cutting grooves using the multi-edged tool and then moving the multi-edged tool, which could reduce the productivity. Preferably, the spacing p for the plurality of pad groove machining cutting parts, which are arrayed in the multi-edged tool, are such that $0.5\ \text{mm} \leqq p \leqq 30\ \text{mm}$, preferably, $1\ \text{mm} \leqq p \leqq 20\ \text{mm}$, more preferably, $2\ \text{mm} \leqq p \leqq 10\ \text{mm}$.

A fifth mode of the invention provides a method of manufacturing a grooved polishing pad according to any one of the first through fourth modes, wherein the plurality of grooves are formed on the polishing pad substrate while blowing a cooling fluid onto the pad groove machining cutting parts.

Given the method for manufacturing a grooved polishing pad according to the present form of embodiment, the act of blowing of a cooling fluid onto the pad groove machining cutting parts can effectively suppress the heating of the pad groove machining cutting parts by friction. In this method in particular, the spacing p between adjacent pad groove machining cutting parts is made large relatively, whereby a sufficient amount of cooling fluid can be blown through the spacing between the adjacent cutting parts, resulting in an enhanced effect of the cooling fluid. Accordingly, it is possible to fully increase the cutting speed, enabling an increase in machining efficiency.

A sixth mode of the invention provides a method of manufacturing a grooved polishing pad according to any one of the first through fifth modes, wherein the cooling fluid comprises an ionic air.

Given the method for manufacturing a grooved polishing pad according to the present mode, the blowing of the ionic air onto the pad groove machining cutting part can produce the same cooling effect as in the aforementioned fifth form of embodiment, and can improve the machining efficiency. Furthermore, the use, as the cooling fluid, of ionic air can blow ions onto the cutting positions, which can effectively suppress the static electricity that is caused by the friction between the pad groove machining cutting part and the polishing pad substrate. This provides an static electricity suppressing effect, thereby effectively preventing the electrostatic adhesion of shavings onto the polishing pad substrate, which enables the specific groove machining to be achieved with high precision.

The employed ionic air may have an opposite charge in order to suppress electric charge. Generally, since the resin pad substrate will be charged negatively, a positive ionic air can be blown effectively, and since the multi-edged tool of metal will be positively charged, a negative ionic air can be blown effectively. In the case where the pad substrate and the multi-edged tool both suffer from the problem of the electric charge, the ionic air positively charged and ionic air negatively charged can be adequately applied.

Note that while the ionic air may be blown in any direction relative to the blade edge positions, preferably the airflow should be blown towards the front from the rear in the direction of travel of the blade edge. When machining grooves in a polishing pad substrate made from a synthetic resin material, the shavings are produced in the forward direction of travel of the blade edges, and when these shavings get into the gaps between the blade edges of the pad groove machining cutting parts, these shavings may be melted by the heat of friction and adhere to the pad groove machining cutting parts, which can produce problems in that it becomes impossible to achieve an adequate cooling effect by the airflow between the blade edges of the pad groove machining cutting parts. Given this, blowing the ions towards the blade edges from behind the pad groove machining cutting parts, in the direction of travel, can effectively prevent the occurrence of the problems described above due to obstructions in the airflow due to shavings getting between the blade edges.

More preferably, the opening of a vacuum suction of a vacuum tube is positioned in front of the multi-edged tool, in the direction of travel, along with blowing off the cutting position (the pad groove machining cutting parts) from behind, in the direction of travel of the cutting parts, with the ion blow, as described above. That is, along with the ion blow preventing the shavings from getting between the blade edges, the shavings should be removed through suction, to remove the shavings as quickly as possible from the operating environment, using a negative pressure suction opening.

A seventh mode of the invention provides a method of manufacturing a grooved polishing pad according to any one of the first through sixth modes, wherein the cutting of the plurality of grooves is performed by using the multi-edged tool wherein each of the pad groove machining cutting parts includes a curve at a position between 0.05 mm and 1.0 mm high from a blade edge on a front clearance face thereof, and has a wedge angle $\theta 1$, on a blade edge side of the curve, in the range of $25° \leqq \theta 1 \leqq 87°$, while has a wedge angle $\theta 2$, on a base part side of the curve, being such that $\theta 2 < \theta 1$.

In experiments and research by the present inventors, it was discovered that in pad groove machining cutting parts according to conventional structures there were the dangers of the following problems occurring depending on the pad substrate materials and depending on the machining parameters, etc:

(1) There is a tendency to produce defects due to chips in the blade edge. In particular, there is a tendency to have this problem in cutting parts made from an ultrahard alloy, more than from high-speed steel.

(2) The useful life of the tooling is short.

(3) It has been difficult to improve the roughness of the bottom surfaces of the grooves produced.

At this point, when pad groove machining cutting parts structured as described in the present mode are used in a method for manufacturing grooved polishing pads, curves are provided on the front clearance faces of the pad groove machining cutting parts and the front clearance angles are given 2-stage structures so that the small wedge angle $\theta 2$ on the base part side will cause the front clearance faces of the cutting parts to essentially stand greatly upright, making it possible to avoid tool interferences with the groove side surfaces when machining grooves with small radii of curvature, while having the wedge angles of the blade edge parts, which have the blade edges, be large, thereby insuring strength, etc., not only (1) preventing chips in the blades, but also (2) enabling increases in the useful life of the tool.

The use of this 2-stage blade structure, which has two stages of angles on the front clearance face, as the distinctive characteristic of the structure in this way makes it possible to suppress increases in the dimensions in the direction of thickness of the blade, and thereby suppress interferences with the inner surfaces of the grooves at both of the edges of the cutting parts in the transverse direction when performing the machining of grooves with large curvatures. Namely, the wedge angle is set to be essentially small at the base part side (the side that is opposite from the blade edge) in the cutting part, and as a result, it is possible to maintain excellent machining surface precision on the inner surfaces on both sides of the grooves. Additionally, because the wedge angles are set to be essentially large angles at the cutting tool blade parts, it becomes possible to insure beneficially the strength and durability of the blade edges, and thereby possible to obtain excellent precision and surface roughness of the bottom parts of the grooves that are formed thereby.

Moreover, in the present mode in particular, the provision of the curve on the front clearance face of the cutting part, rather than a cutting face on the cutting part, makes it possible to insure a specific cutting angle. As a result, it is possible to obtain even greater effectiveness in the effect of improving the aforementioned strength and durability while insuring excellent cutting performance on polishing pads made from synthetic resin materials in particular.

Furthermore, in the present mode, the size of the wedge angle $\theta 1$ of the blade edge side is set in a specific range, making it possible to effectively demonstrate the effects described above. In other words, having the wedge angle $\theta 1$ too small makes it difficult to insure the strength of the blade edge part, while, on the other hand, having the wedge angle $\theta 1$ too large increases the amount of contact between the front clearance face and the bottom surface of the groove, along with making it impossible to avoid effectively tooling interferences when performing the cutting process, with the risk of problems such as generating frictional heating and static electricity. Preferably, the wedge angle $\theta 1$ is held in a range of $30° \leqq \theta 1 \leqq 70°$.

Furthermore, in the present mode, the formation of a large wedge angle $\theta 1$ on the blade edge side makes the manufacturing of the cutting part easier by reducing the occurrence of chipped blades when manufacturing the blade edge parts of the pad groove machining cutting parts. Note that were the positioning of the curve less than 0.05 mm high, it would be difficult to fully realize the effect of improving the durability and strength of the cutting part, and, conversely, were the position more than 1.0 mm high, there would be the danger of the occurrence of problems with interferences between the side wall surfaces of the grooves and the blades when cutting grooves with tight radii of curvature.

Note that in the present mode, the distance of the position of the curve from the blade edge is set so as to be less than the depth dimension desired for the groove to be fabricated, thereby enabling the cutting part to demonstrate the effects of suppressing interferences with the inside surfaces of the grooves on both edges of the cutting part in the transverse direction. Here the "position of 0.05 mm to 1.0 mm from the blade edge, where the curve is formed" in the present mode indicates the height position in the direction of depth of the pad groove. Consequently, the position of the curve on the face of the front clearance face is determined by the magnitude of the front clearance angle. In other words, if the front clearance angles relative to the piece being cut are different, then the height positions of the curves will also be different, even if the cutting parts have the same wedge angles.

An eighth mode of the invention provides a method of manufacturing a grooved polishing pad according to the seventh mode, wherein the cutting of the plurality of grooves is performed by using the multi-edged tool wherein a surface roughness of a region on the blade edge side of the curve on the front clearance face has an Ry value of no more than 3 μm.

In the method for manufacturing a grooved polishing pad according to the present mode, an even greater level of machining precision can be obtained on the bottom surface of the groove for the method for manufacturing a grooved polishing pad according to the aforementioned seventh form of embodiment.

In other words, in the cutting tool as shown in the seventh mode of embodiment, which has a 2-stage structure for the front clearance angle, there is the danger of the following new problems (4) through (7) occurring, where these problems can conceivably occur due to the wedge angle of the blade edge part being increased under specific conditions, such as the characteristics of the pad substrate materials:

(4) Depending on the pad substrate materials, the amount of contact between the front clearance face and the bottom surface of the grooves may increase during the cutting processes, due to elastic deformation, etc., of the pad substrate materials, which tends to cause the adherence of cutting chips or shavings (resin dust) to the machined surfaces, which is thought to be caused by static electricity that is generated by the contact. The adherence of these shavings can cause the shavings to cut into the machined surfaces during repetitive machining, which may cause the cut surfaces to be rough. (5) The amount of heat produced by the blade edge part, which is assumed to be due to frictional heating, when the cutting process is performed may prevent the cutting speed from being as fast as possible, which may reduce machining efficiency, depending on, for example, the pad substrate material. (6) There is the danger of an impact on the inside surfaces of the gaps in the pad due to heating of the blade edge parts, depending on the pad substrate materials, etc., when the cutting speed in increased. (7) There is the danger of a negative impact on the useful life of the tooling due to the production of heat in the blade edge parts when the speed of processing is increased.

Note that the present form of embodiment can solve not only the aforementioned (1) through (3), but can also solve these new problems (4) through (7) as well. More specifically, in the method for manufacturing a grooved polishing pad according to the present form of embodiment, increasing the wedge angle of the blade edge side of the curve to insure an appropriate thickness dimension for the blade edge part can insure the strength of the blade edge part, while, at the same time, reducing the wedge angle of the base part side of the curve to cause the front clearance face to greatly stand upward can reduce tooling interferences with the side wall surfaces of the grooves, as described above, in the same way as for the seventh form of embodiment. While this can avoid tooling interferences with the side surfaces of the grooves when cutting grooves with small radii of curvature, this can also not only (1) prevent chips in the blades, but also (2) increase the useful life of the tools, while, by reducing the surface roughness of the blade edge side of the curve on the front clearance face, (3) the roughness of the bottom surface of the groove can be reduced.

Furthermore, in the present form of embodiment, making the surface of the blade edge side of the curve smooth can (4) increase the machining precision of the cut surface by suppressing the adhesion of shavings through reducing the occurrence of static electricity due to the increases in the amount of contact between the blade edge part and the surface of the bottom of the grooves, even when using those polishing pads that are made from materials for which static electricity has been a problem, such as synthetic resin materials. In addition, reducing the heat that is produced at the blade edge part when performing the machining can (5) increase the cutting speed and increase the cutting efficiency, and can not only (6) reduce the negative impact on the inside surfaces of the pad grooves, but can also (7) achieve an improvement in the useful life of the tooling, and thus even through this particular structure, that is, a structure having a 2-stage structure in the front clearance angle, is used, it is possible to avoid effectively the new problems, described above, resulting therefrom.

Note that a variety of machining processes for improving the surface roughness may be used as the surface processing on the region on the blade edge side on the front clearance face, where, along with lapping, polishing, buff finishing, ultrasonic treatments, plating, and the like, may be used. In the present mode, more preferably $Ry \leqq 1.0$ μm, and even more preferably $Ry \leqq 0.5$ μm, and even more preferably $Ry \leqq 0.25$ μm. Note that the Ry value is the highest specified in JIS B0601-1994.

A ninth mode of the invention provides a method of manufacturing a grooved polishing pad according to the seventh or eighth mode, wherein the cutting of the plurality of grooves is performed by using the multi-edged tool wherein a surface processing is performed on a blade edge side region of the curve on the front clearance face so that the surface roughness of the blade edge side region will be less than that of a base part side region, on an other side of the curve.

The method for manufacturing a grooved polishing pad according to the present form of embodiment is able to avoid effectively new problems with the dangers that arise due to the use of the specific structure in the 2-stage structure in the front clearance angle, in the same manner as in the aforementioned eighth form of embodiment, and can form grooves with small radii of curvature, with excellent machining precision through suppressing the tool interferences that occur during the cutting process, the same as in the aforementioned seventh and eighth forms of embodiment. Note that in the present mode, the surface treatment may be performed both on the region on the blade edge side of the curve, and also on the region on the base part side of the curve.

A tenth mode of the invention provides a method of manufacturing a grooved polishing pad according to any one of the seventh through ninth modes, wherein the cutting of the plurality of grooves is performed by using the multi-edged tool wherein a front clearance angle $\alpha$ of the blade edge side of the curve in the pad groove machining cutting part is in a range of $3° \leqq \alpha \leqq 60°$.

In the method for manufacturing a grooved polishing pad according to the present form of embodiment, having the front clearance angle $\alpha$ of the blade edge side of the curve be in the specific range makes it possible to avoid tooling interferences when performing the machining, and to reduce more effectively the adherence of shavings and the production of heat in the blade edge part. That is, when the front clearance angle $\alpha$ is too large, the blade edge part that contacts the pad will stand up, which is essentially the same as using a cutting tool with a small wedge angle, which can cause chipping of the blade edge part, and insufficient durability. On the other hand, if the front clearance angle $\alpha$ is too small, then the amount of contact between the blade edge part and the pad substrate will be large, which may prevent the desired effect of reducing the heating or charging of the blade edge part.

Note that the front clearance angle α of the blade edge side of the curve in the present form of embodiment is in the range described above, and is determined by a combination of the cutting face of the pad groove machining cutting part and the cutting angle, which is 0° or more, that is formed by the surface that is perpendicular relative to the polishing pad substrate. Note that, preferably, the front clearance angle α is such that $10° \leqq \alpha \leqq 60°$, more preferably $20° \leqq \alpha \leqq 50°$.

An eleventh mode of the invention provides a method of manufacturing a grooved polishing pad according to any one of the seventh through tenth modes, wherein the cutting of the plurality of grooves is performed by using the multi-edged tool wherein the performance of a surface treatment by lapping, using diamond particles of 10 μm or less, on the blade edge side region of the curve on the front clearance face.

In the method for manufacturing a grooved polishing pad according to the present mode, the surface roughness of the region on the blade edge side of the curve can be reduced effectively. Doing so can reduce effectively the wear of the surface in the region on the blade edge side of the curve. This can also delay the start and advancement of the initial wear, enabling the effective maintenance of the machining precision over an extended period. Note that, more preferably, a surface treatment using lapping with diamond particles of less than 5 μm is more preferable, where a well-known lapping process may be performed in a form that uses a slurry with an appropriate solvent, or the like.

A twelfth mode of the invention provides a method of manufacturing a grooved polishing pad according to any one of the seventh through eleventh modes, wherein the cutting of the plurality of grooves is performed by using the multi-edged tool wherein a position where a height is 2.0 mm, in a direction of a depth of each groove, from a blade edge on the front clearance face is at a distance of separation of no more than 2.5 mm from the blade edge in a direction of cutting.

In this type of method for manufacturing a grooved polishing pad according to the present mode, the width dimension in the front-back direction, in the direction of cutting by the pad groove machining cutting part enables the roughness of the machined surface to be effectively eliminated or decreased through decreasing the interferences between the side surfaces of the blades and the side surfaces of the tools even when cutting grooves with small radii of curvature. More preferably, the design should be such that the position that is 2.0 mm high, in the direction of depth of the groove, from the blade edge has a distance of separation of no more than 2.0 mm from the blade edge in the direction of cutting.

A thirteenth mode of the invention provides a method of manufacturing a grooved polishing pad according to any one of the seventh through eleventh modes, wherein the cutting of the plurality of grooves is performed by using the multi-edged tool wherein a nose radius R of the blade edge in each of the pad groove machining cutting parts is such that $R \leqq 0.05$ mm.

Typically, nearly all polishing pad substrates are formed out of a synthetic resin material, and when performing machining on this type of synthetic polymer material, it is desirable for the blade edge of the pad groove machining cutting part to have a sharp shape. However, conventionally the blade edge has been formed into a rounded surface, not withstanding the reduction in machining precision, due to the need to insure the strength of the blade edge, in response to this problem, the pad groove machining cutting part used in the method for manufacturing a grooved polishing pad according to the present form of embodiment, the strength of the blade edge part can be increased through the use of a blade edge part having a specific structure, enabling the nose radius R of the blade edge part to be made smaller. Reducing the nose radius R of the blade edge part enables the cutting of the polishing head substrate, which is typically made of a synthetic resin material, to be performed with greater machining precision. Note that, as is obvious from the above, it is desirable for the nose radius R of the blade edge to be as small as possible, and, in practice, the blade edge part can also be made sharp, with a nose radius R of 0.

A fourteenth mode of the invention provides a method of manufacturing a grooved polishing pad according to any one of the seventh through thirteenth modes, wherein the cutting of the plurality of grooves is performed by using the multi-edged tool wherein side clearance angles being provided on both end faces, in a width direction of the cutting part, in the pad groove machining cutting parts.

In this type of method for manufacturing, a grooved polishing pad manufactured according to the present mode, interferences with the side surfaces of the grooves by the width-direction edge faces of the blades of the pad groove machining cutting parts can be avoided effectively. In the case where the polishing pad substrate is formed of a synthetic resin material having an elasticity, or upon machining grooves having a relatively large radius of curvature, the present arrangement is effective to avoid undesirable interferences with the side surfaces of the grooves by the width-direction edge faces of the blades of the pad groove machining cutting parts during machining or moving upward the cutting parts, thereby enabling the orthogonality of the groove edges to be maintained. In consideration of the strength and durability of the cutting tools, ease of machining, and so forth, the side clearance angles (εs) are preferably set to no more than 5°, and more preferably set in a range of $0° \leqq \epsilon s \leqq 3°$, and even more preferably set in the range of $0.1° \leqq \epsilon s \leqq 10$.

A fifteenth thirteenth mode of the invention provides a method of manufacturing a grooved polishing pad according to any one of the seventh through fourteenth modes, wherein the cutting of the plurality of grooves is performed by using the multi-edged tool wherein the pad groove machining cutting parts are fabricated from an ultrahard alloy or a high-speed steel.

In this type of method for manufacturing a grooved polishing pad according to the present form of embodiment, the use of an ultrahard alloy with superior hardness, wear-resistance, and toughness makes it possible to provide a pad groove machining cutting part that has superior machining precision. Moreover, because fabricating the blade edge part so as to have a large wedge angle enables increased strength in the blade edge part, the present form of embodiment makes it possible to avoid or reduce the occurrence of small chips, etc., in the blade, even in pad groove machining cutting parts made from sintered materials such as ultrahard alloys. In view of wear-resistant of the multi-edged tool, preferably employed is a multi-edged tool having a plurality of cutting parts made of an ultrahard alloy. In view of a finish of the grooves, preferably employed is a multi-edged tool with the cutting parts made of a high-speed steel.

As is clear from the description above, in the method for manufacturing a grooved polishing pad according to the present invention, the use of a multi-edged tool wherein the blade edge spacing is an integer multiple (2 or more) of the desired groove spacing enables a large number of grooves to be fabricated with high precision with the desired groove spacing being narrow. Furthermore, in machining of grooves, the present invention can prevent effectively the concentrated occurrence of heating and static electricity between the large number of grooves produced, thereby enabling an improvement in machining precision.

BRIEF DESCRIPTION OF THE DRAWINGS

The foregoing and/or other objects features and advantages of the invention will become more apparent from the following description of preferred embodiments with reference to the accompanying drawings, in which like numerals are used to represent like elements and wherein:

FIG. 1B is an plane view of the grooving machine of FIG. 1A, while

FIG. 5A is a plane view of a suction plate of the grooving machine of FIG. 1, FIG. 5B is an axial cross sectional view of the suction plate, FIG. 5C is a fragmentally enlarged view of the suction plate.

FIGS. 27A and 27B show one example of a polishing pad of foamed urethane having a plurality of generally concentric grooves formed by cutting process executed by the grooving machine of FIG. 1, wherein FIG. 27A is a fragmentally enlarged plane view of the polishing pad, and FIG. 27B is a fragmentally enlarged view in cross section of the polishing pad;

FIGS. 28A and 28B show another example of polishing pad of foamed urethane having a plurality of grooves arranged at grid pattern formed by milling process executed by the grooving machine of FIG. 1, wherein FIG. 28A is a fragmentally enlarged plane view of the polishing pad, and FIG. 28B is a fragmentally enlarged view in cross section of the polishing pad;

FIG. 55A shows specific set values in the cutting tool and FIG. 55B shows the amount of interference with the side wall faces of the groove with the cutting tool when forming a groove with a radius dimension r.

DETAILED DESCRIPTION OF PREFERRED EMBODIMENTS

Figure 1A:
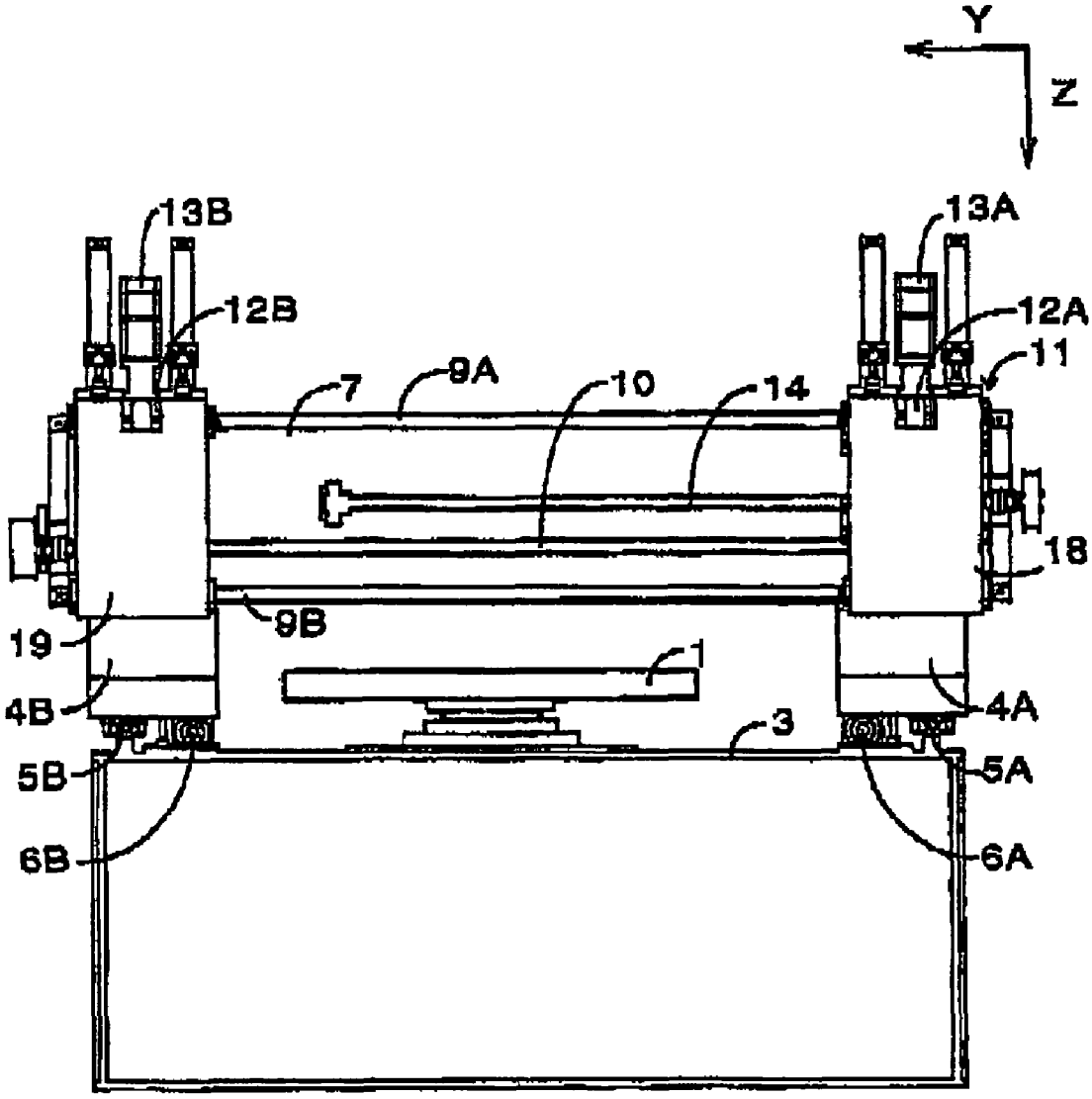
FIG. 1A is an front elevational view of a grooving machine constructed according to one preferred embodiment of the present invention.
Figure 1B:
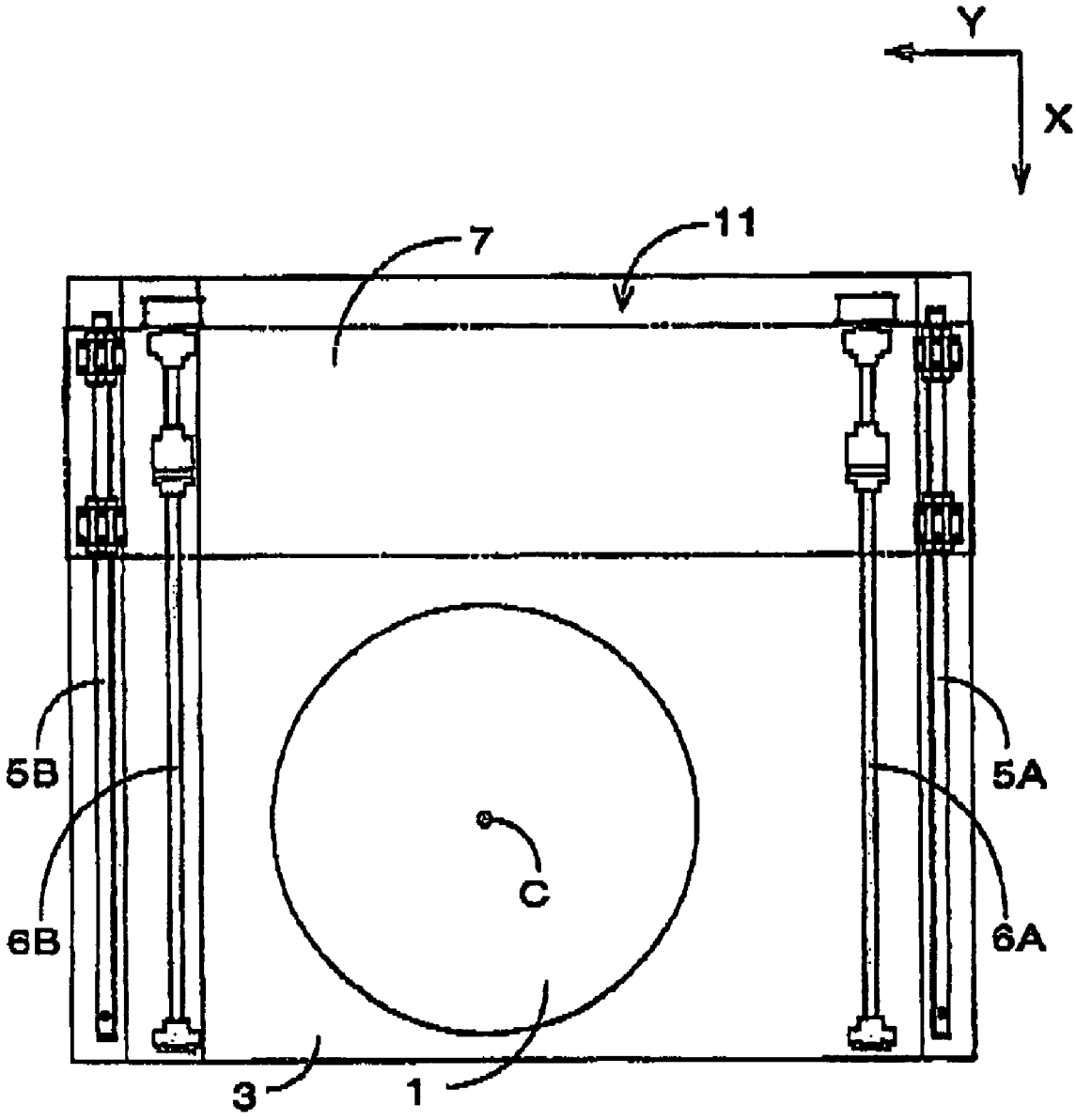
Figure 1C:
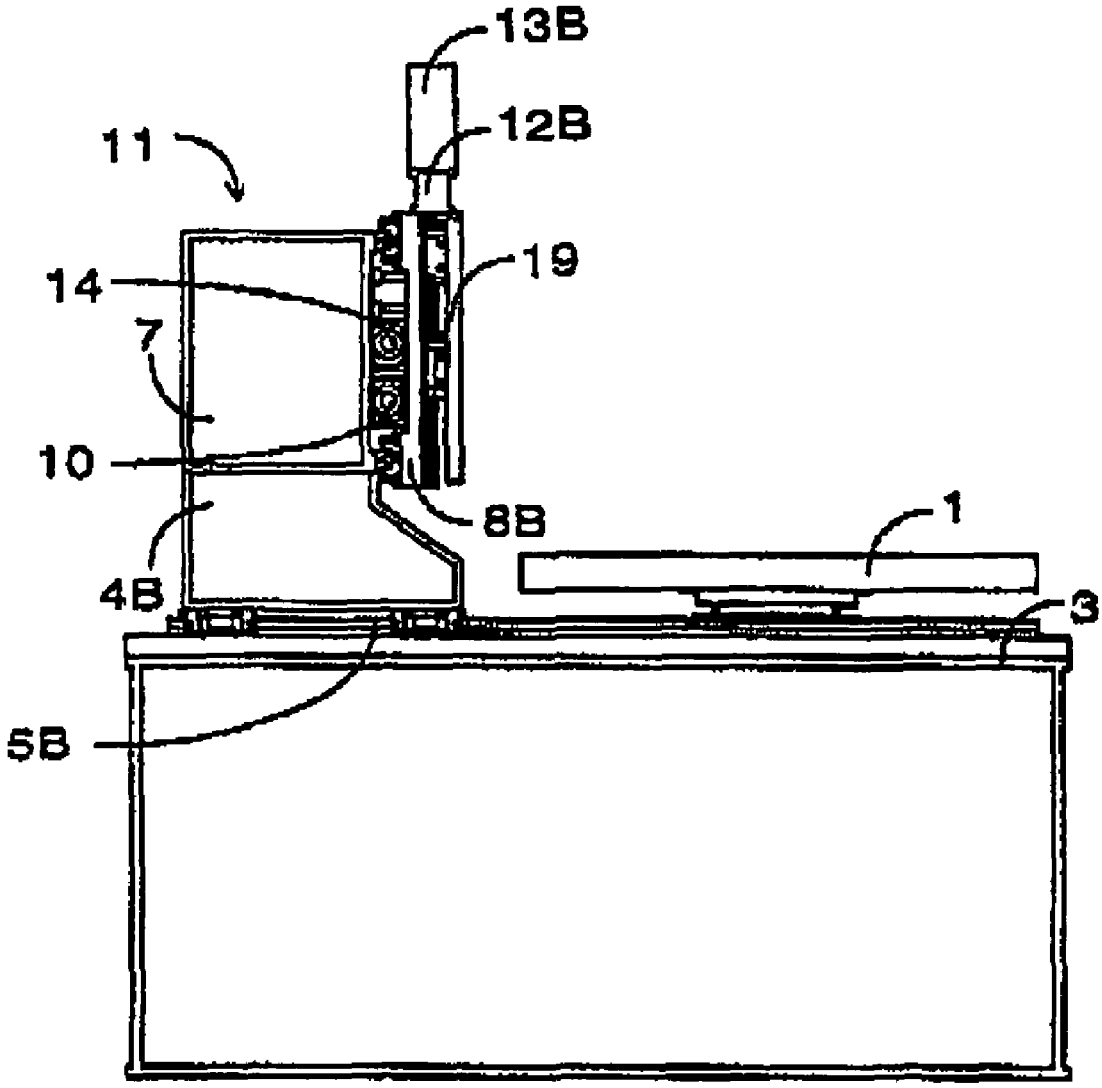
FIG. 1C is a side elevational view of the grooving machine of FIG. 1A.

Referring first to FIGS. 1A-1C, there is shown a schematic construction of a grooving machine according to one preferred embodiment of the present invention. The grooving machine is equipped with a turning tool for cutting grooves, which is constructed according to one preferred embodiment of the invention. The grooving machine is used for producing a polishing pad according to one preferred embodiment of the invention in accordance with a method according to one preferred embodiment of the invention.

The grooving machine constructed according to the present embodiment is operable to produce by cutting circumferential grooves, e.g., a multiplicity of generally concentric annular grooves in the present embodiment, on a surface of a base for the polishing pad made of a resin material, e.g., a foamed urethane pad 15. The grooving machine comprises the following components:

(a) a circular platen 1 rotatable under control about C-axis extending in a vertical direction as seen in FIG. 1A;
(b) a gate-shaped column 11 reciprocatory movable under control in a direction of X-axis;
(c) two saddles 8A, 8B mounted on a cross rail 7 and reciprocatory movable along a screw-thread 10 (Y1-axis) and a screw-thread 14 (Y2-axis);
(d) two tool holders 18, 19 mounted on the two saddles 8A, 8B; respectively, and reciprocatory movable along a screw-thread 12A (Z1-axis) and a screw-thread 12B (Z2-axis);
(e) a numerical control device 102 (see FIGS. 13, 14) adapted to control operation of motor and a control axis;
(f) an ion blower 114 as an ion blowing device (see FIG. 15) for neutralizing charged components;
(g) a fixed tool 69 as a turning tool in the form of a single cutting Edge tool 58 and a multiple cutting edges tool 74 (see FIG. 12) for cutting grooves;
(h) a cutting device (see FIG. 24); and
(i) a rotative tool 57 in the form of a milling tool 59 and a drill unit 65 (see FIGS. 10, 11).

There will be described in detail a general construction of the grooving machine and specific construction of the respective components listed above, with reference to the accompanying drawings, sequentially.

FIGS. 1A-1C shows an entire construction of the grooving machine according to the present embodiment. The circular platen 1 is fixedly mounted on a bed 3 so as to extend parallel to an upper surface of the bed 3. The circular platen 1 is rotatable about the C-axis extending perpendicular to the upper surface of the bed 3, i.e., extending in the vertical direction as seen in FIG. 1A. The bed 3 further supports a pair of first guide rails 5A, 5B horizontally mounted on opposite sides of its upper surface. The first guide rails 5A, 5B extend parallel to each other in a longitudinal direction of the bed 3 while being spaced apart from each other with the circular platen 1 interposed therebetween. The gate-shaped column 11 is mounted on the first guide rails 5A, 5B so that the gate-shaped column 11 is movable along the first guide rails 5A, 5B in the horizontal direction. The gate-shaped column 11 includes a pair of legs in the form of column portions 4A, 4B mounted on the first guide rails 5A, 5B, respectively, and a cross rail 7 extending between the column portions 4A, 4B so as to connect the column portions 4A, 4B to each other. The thus formed gate-shaped column 11 is driven by a pair of screw shaft 6A (first X axis) and 6B (second X axis) disposed on the bed 3 so as to extend along the guide rails 5A, 5B, respectively, in a direction of an X-axis as indicated by an arrow in FIG. 1B. The pair of screw shafts 6A, 6B are synchronously rotated by a drive motor 40 which will be described later with reference to FIG. 7B. The drive of the gate-shaped column 11 is controlled by a suitable control device that will be described later. A pair of second guide rails 9A, 9B are disposed on one of opposite side faces of the cross rail 7 so as to extend in a direction of a Y-axis as indicated by an arrow in FIGS. 1A and 1B, which is perpendicular to the X-axis. On the second guide rails 9A, 9B, the two saddles 8A, 8B are mounted so as to be movable along the guide rails 9A, 9B, i.e., in the direction of the Y-axis. The two saddles 8A, 8B are driven by respective screw shafts 10, 14 disposed on the side face of the cross rail 7 so as to extend along the guide rails 9A, 9B. The screw shafts 10, 14 are rotated by suitably electric drive motors (not shown) under control of the suitable control device. The two saddles 8A, 8B support tool rests 18, 19 mounted thereon, respectively, such that the tool rests 18, 19 are movable in a direction of a Z-axis extending in the vertical direction as seen in FIG. 1A (as indicated by an arrow). The tool rests 18, 19 are driven by respective ball-screws 12A, 12B disposed on the saddles 8A, 8B so as to extend along the Z-axis. The screw shafts 12A, 12B are rotated by respective electric motors 13A, 13B so that the tool rests 18, 19 are moved in the direction of the Z-axis independently of each other. The gate shaped column 11, the saddles 8A, 8B, and the tool rests 18, 19 may be formed by desired metallic materials, preferably rigid light metallic materials such as a hard aluminum alloy or the like.

(a) Circular Platen (C-Axis)

Figure 2:
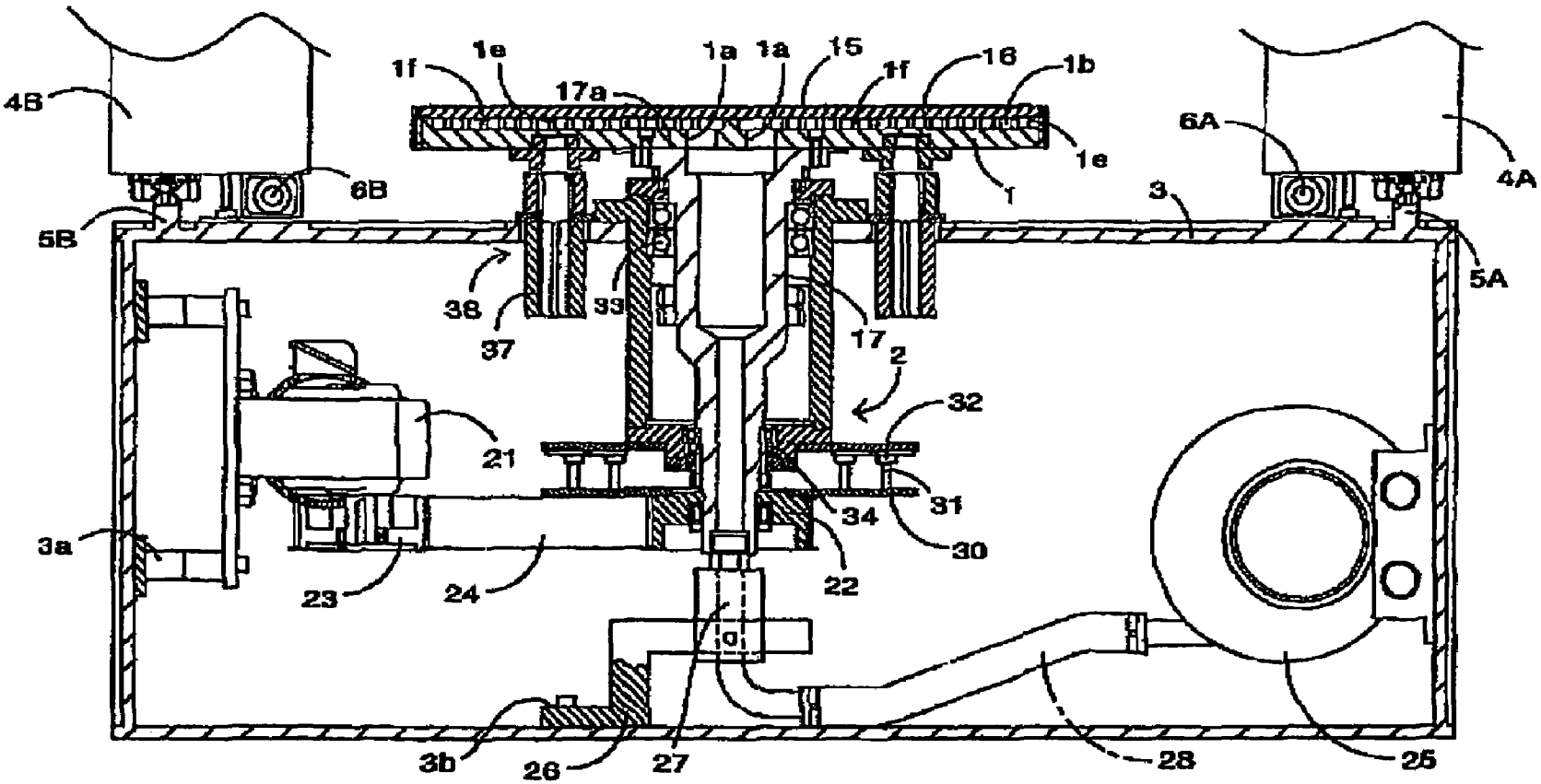
FIG. 2 is an elevational view in a vertical or a longitudinal cross section of the grooving machine of FIG. 1A.
Figure 3:
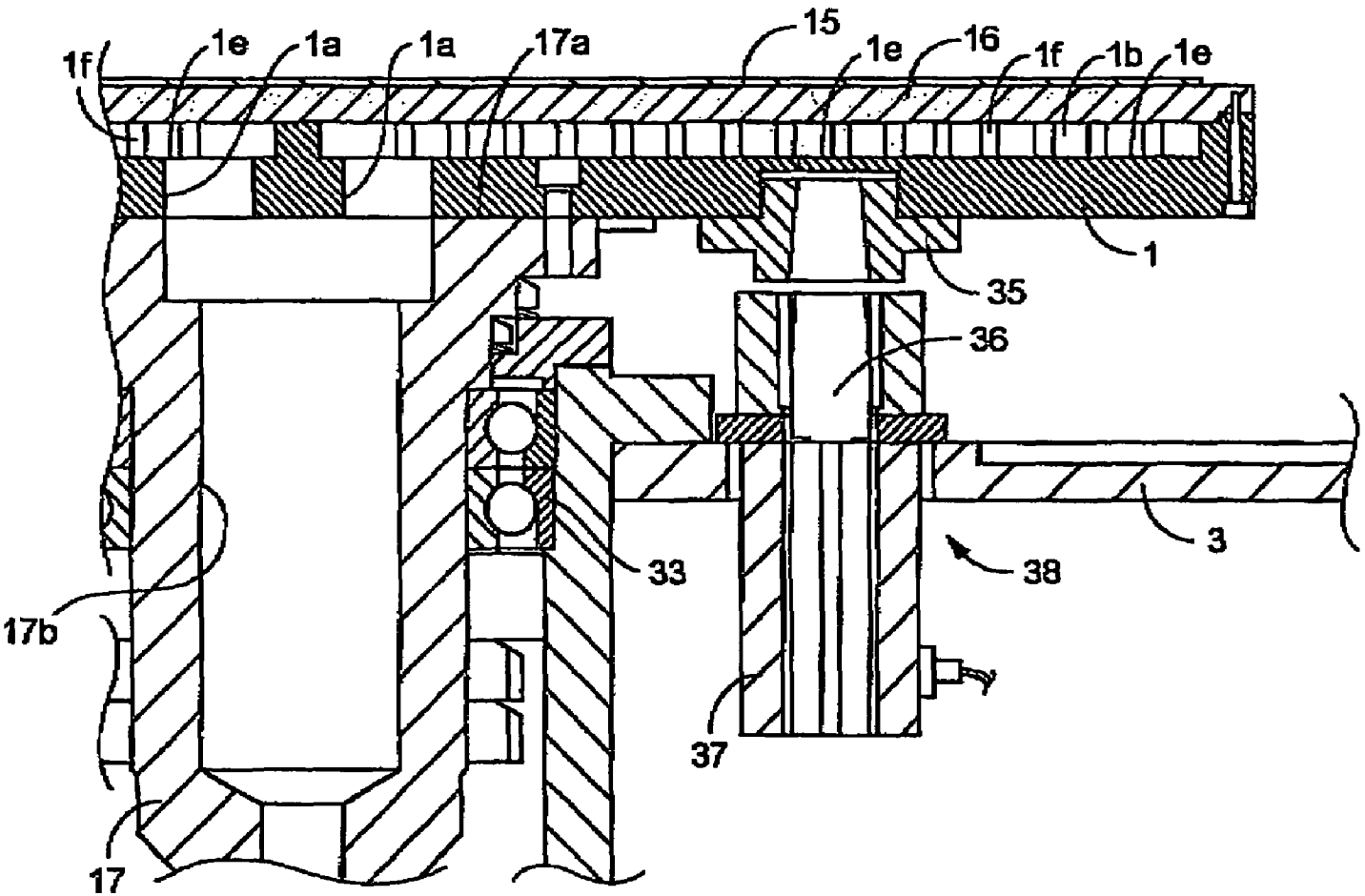
FIG. 3 is an fragmentally enlarged view of the grooving machine of FIG. 1A.

Referring next to FIG. 2, the circular platen 1 and a housing member of the circular platen 1 are both shown in their axial cross sections. FIG. 2 also shows a driving mechanism for rotating the circular platen 1 and an air suction device in the form of a suction blower 25 installed within the bed 3 so as to apply a vacuum to an upper surface of the circular platen 1 to thereby attract the base for a desired polishing pad for the CMP, in the form of the foamed urethane pad 15, on the upper surface of the circular platen 1. FIG. 3 shows an enlarged view in axial cross section of a position holding member 38 adapted to place the circular platen at its suitable angular position about the C-axis, which is determined based on the angular position of the circular platen 1 detected by controlling the rotation of the circular platen 1 about the C-axis. FIG. 4 shows a plane view and an axial cross sectional view of the circular platen 1 in which a plurality of air flow passages are evenly formed therethrough so that the vacuum delivered from the suction blower 25 is evenly applied to a rear surface of the foamed urethane pad 15. FIG. 5 shows a suction plate 16 assembled in the surface of the circular platen 1. The suction plate 16 has a plurality of tiny air holes 16*a* formed therethrough and tiny grooves 16*b*, 16*c* connecting the air holes 16*a* so that the vacuum is evenly applied to the rear surface of the foamed urethane pad 15, thus preventing deformation of the surface of the urethane pad due to stress concentrated at a local portion of the foamed urethane pad upon cutting grooves on the urethane pad.

As is understood from FIGS. 2 and 3, the circular platen 1 is supported by a hollow shaft member in the form of a hollow center shaft 17 that is disposed in and supported by the bed 3 via the housing 2, such that the hollow center shaft 17 is rotatable about a center axis thereof. Described in detail, the center shaft 17 has an outward flange portions 17*a* integrally formed at an axially upper end portion thereof. The circular platen 1 is placed on and fixed to an annular upper surface of the outward flange portion 17*a* so as to extend in a radial direction perpendicular to the center axis of the center shaft 17. The center shaft 17 is fixed at its axially upper and lower end portions to the housing 2 via upper and lower bearings 33, 34, respectively. The type, size and level of dimensional accuracy of the upper and lower bearings 33, 34 are suitably determined so that an amount of deflection occurred at an outer peripheral portion and the upper surface of the circular platen 1 is significantly reduced. The housing 2 is fixed to the bed, whereby the center shaft 17 is rotatably supported by the bed 3.

The axially lower end portion of the center shaft 17 protrudes axially downwardly from the housing 2. To the protruded end portion of the center shaft 17, an optional power transmittal member, e.g., a pulley 22 is fixed. On the other hand, a drive motor 21 operable for controlling the rotation of the circular platen 1 about the C-axis is fixed to a sheet portion 3*a* of the bed 3. The output power of the drive motor 21 is transmitted via pulleys 22, 23 and a belt 24 rounded about the pulleys 22, 23, thus generating a rotation of the center shaft 17 and the circular platen 1 fixed to the center shaft 17 about the C-axis. In this respect, power transmitting mechanism for transmitting the output power of the drive motor 21 to the center shaft 17 may otherwise be constituted by utilizing a combination of gears, or any other possible power transmittal members.

The hollow center shaft 17 has a bore 17*b* serving as an air passage. The bore 17*b* is held in fluid-tight communication at its upper end with a plurality of communication holes 1*a* formed through the central portion of the circular platen 1, and at its lower end with an air hose 28 of the suction blower 25 via a coupling 27 supported by a support 26 fixed to a seat portion 3*b* of the bed 3. In this condition, the vacuum generated in the suction blower 25 is applicable to the rear surface of the foamed urethane pad placed on the upper surface of the circular platen 1 through the bore 17*b* of the center shaft 17 and the communication holes 1*a* of the circular platen 1. Therefore, the vacuum application needed for holding the foamed urethane pad on the surface of the circular plate 1 can be executed during the rotation of the center shaft 17. In this respect, the upper open end of the communication holes 1*a* are closed by a suction plate 16 which is placed on the upper surface of the circular platen 1. As shown in FIG. 5, the suction plate 16 is formed with a plurality of suction holes in the form of air holes 16*a* and grooves 16*b*, so that the vacuum is evenly applied in the upper surface of the suction plate 16 through the communication holes 1*a* and the air holes 16*a* and the grooves 16*b*, thus assuring firmly holding of the foamed urethane pad 15 on the surface of the suction plate 16. As is understood from the aforementioned description, the position holding member 38, the drive motor 21 and the suitable power transmittal members cooperates to form a drive mechanism adapted to rotate the circular platen 1 and place the circular platen 1 at a suitable angular position, in the present embodiment.

Referring back to FIGS. 2 and 3, a disk plate 30 having a plurality of projections 31 is fixed to the protruding end portion of the center shaft 17, while plurality of sensors 32 are fixed to the lower end face of the housing 2 so as to be located above the projections 31 with a slight spacing therebetween in the vertical direction as seen in FIG. 2. The sensors 32 detect the projections 31 to thereby detect the angular position of the circular platen 1. This mechanism is used for detecting the angular position of the circular platen 1 rotating about the C-axis under control, and positioning the circular platen 1 at its desired angular position. When the grooving machine is operated to form a multiplicity of small-width straight grooves arranged in a grid pattern on the surface of the foamed urethane pad 15, by using the milling cutter, the positions of the sensors 32 and the projections 31 are changed so that the sensors 32 can detect angular positions of the circular platen 1 each time the circular platen 1 is rotated by 45 degree about the C-axis. In the grooving process, the circular platen 1 is fixed each time the circular platen is rotated by 90 degree about the C-axis, to thereby cutting the straight grooves on the surface of the urethane pad in the grid pattern. In the present embodiment, the position holding member 38 is constituted by a positioning bush 35 having a tapered hole, which is fixed to a predetermined angular position of the lower surface of the circular platen 1, and a piston member 37 having a shaft 36 whose upper end portion is tapered, which is disposed on a corresponding angular position of the bed 3. The piston member 37 may be of pneumatic type, hydraulic type or alternatively electromagnetic type. It should be appreciated that the structure of the position holding member 38 is not particular limited to the illustrated one. For instance, a Curvic coupling device (curvic: trademark) may be employed instead of the tapered shaft 36, for thereby permitting the detection of the angular position of the circular platen 1 at angular intervals of not larger than 45 degree.

Figure 4B:
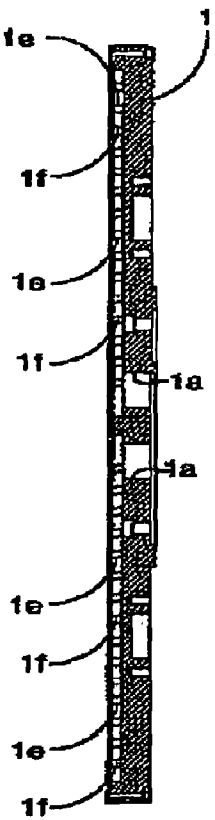
FIG. 4B is a cross sectional view of the platen of FIG. 4A taken along line B-B of FIG. 4A.
Figure 4A:
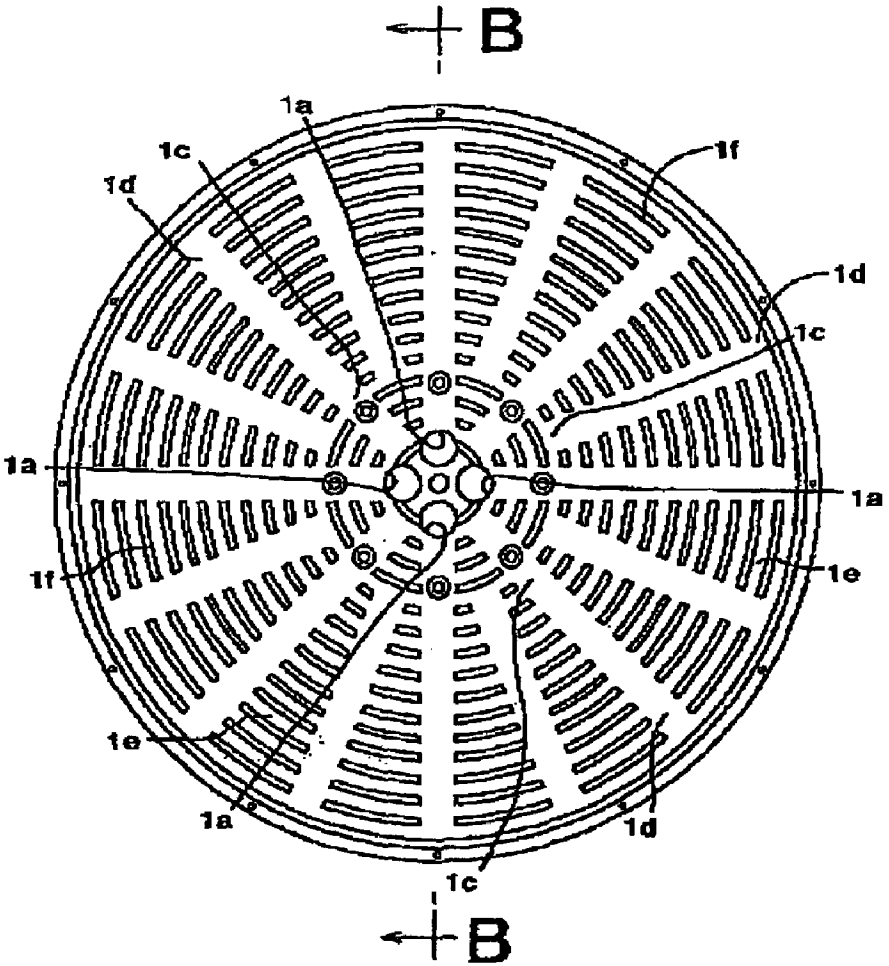
FIG. 4A is a plane view of a platen of the grooving machine of FIG. 1.

FIG. 4A shows a plane view of the circular platen 1, while the FIG. 4B shows a cross sectional view of the circular platen 1 taken along line B-B of FIG. 4A. A material for producing the circular platen 1 may be preferably selected from light metals including aluminum alloy, titanium and the like, thereby lowing a moment of inertia of the circular platen 1, thus permitting a prompt startup or stop of the rotation of the circular platen. In particular, the material of the circular platen 1 is desired to be less likely to cause the secular change of the circular platen 1, like strain, to exhibit a heat resistance, and to have sufficient stiffness and strength. While the communication holes 1*a* is formed through the central portion of the circular platen 1 for introducing the suction force applied from the suction blower 25 into the upper surface of the circular platen 1 through, the circular platen 1 is also formed with a plurality of leading grooves 1*c*, 1*d* for leading the suction force into the outer circumferential portion of the circular platen 1. The circular platen 1 is further provided with a plurality of generally concentric grooves 1*e*, through which the plurality of leading grooves 1*c*, 1*d* extending in the radial directions are held in communication with each other. A plurality of circumferential walls If defined between adjacent ones of the annular grooves 1*e* serve as supports on which the suction plate 16 is placed.

Figure 5D:
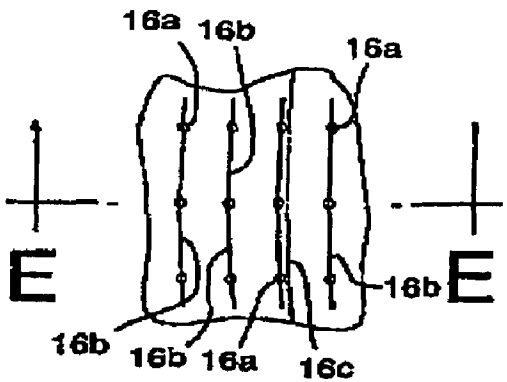
FIG. 5D is an enlarged view of a X portion of FIG. 5C.
Figure 5E:
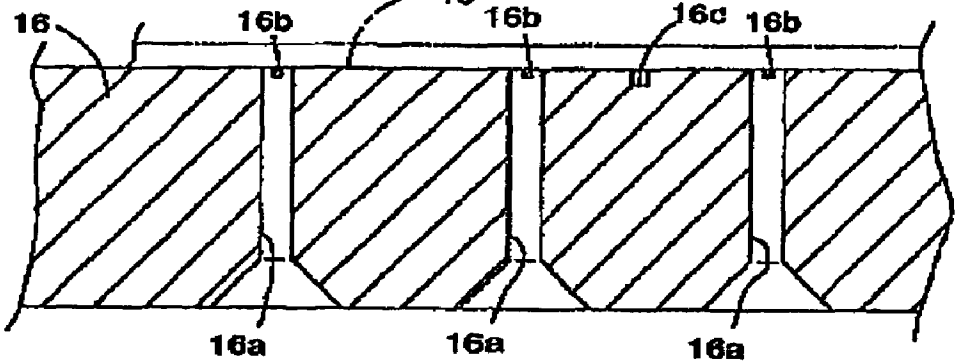
FIG. 5E is an enlarged cross sectional view taken along line E-E of FIG. 5D.

Referring next to FIGS. 5A, 5B, 5C, there are shown a plane view, an axial cross sectional view, and a fragmentally enlarged view of the suction plate 16. In addition, FIG. 5D shows an enlarged view of an X part of FIG. 5C, and FIG. 5E shows a cross sectional view taken along line E-E of FIG. 5D. As shown in FIG. 5E, the suction plate 16 functions to support the foamed urethane pad 15 to be placed thereon. The suction plate 16 is provided with the multiplicity of tiny air holes 16*a* evenly dispersed over the entire surface of the suction plate 16, so that the foamed urethane pad 15 is fixed onto the surface of the suction plate 16 by the suction force evenly applied to the back surface thereof through the air holes 16*a*. Like the circular platen 1, the suction plate 16 is made of a material preferably selected from light metals including hard aluminum alloy, titanium, and the like, and ceramic materials.

In the light of flexibility of the foamed urethane pad 15, specific arrangement is needed for ensuring desired suction condition of the foamed urethane pad 15 on the suction plate 16. More specifically described, when the currently processed portion on the front surface of the foamed urethane pad is remote from suctioned portions on the rear surface of the foamed urethane pad 15 to which the suctioned force is applied, the processed foamed urethane pad 15 is prone to be deformed or displaced in the direction in which the cutting tool is forwarded, possibly causing deterioration of dimensional accuracy of the formed grooves. To cope with this problem, the suction plate 16 is required to be capable of evenly applying the suction force on the rear surface of the foamed urethane pad 16 placed thereon. Therefore, the air hole 16*a* are evenly dispersed over the entire area of the suction plate 16 with a substantially regular pitch. Each of the air holes 16*a* is dimensioned to have a suitable diameter, taken into account the thickness of the foamed urethane pad 16, so that the suction force applied through the air hole 16*a* to the corresponding portion of the rear surface of the urethane pad 16 does not cause deformation of the urethane pad 16. For instance, the air hole 16*a* is dimensioned to have a diameter of about 2 mm, when the foamed urethane pad 15 has a thickness of 1.4 mm. As shown in FIG. 5D, adjacent ones of the air holes 16*a* are held in communication with each other through communication grooves 16*b*, thus assuring further improved evenness of the suction force. The suction plate 16 is further provided with a plurality of annular generally concentric clearance grooves 16*c*, which are formed on predetermined radial portion of the front surface of the suction plate 16. In the case where the grooving machine is operated to perform a boring process with a boring unit in the form of a drill unit 65 (which will be described later with reference to FIGS. 11 and 16) attached thereto, the suction plate 16 is further provided with a clearance grooves (not shown) having a diameter slightly larger than the diameter of a drill of the drill unit 65 and formed through its predetermined portion.

(b) Gate-Shaped Column (X-Axis)

Figure 6A:
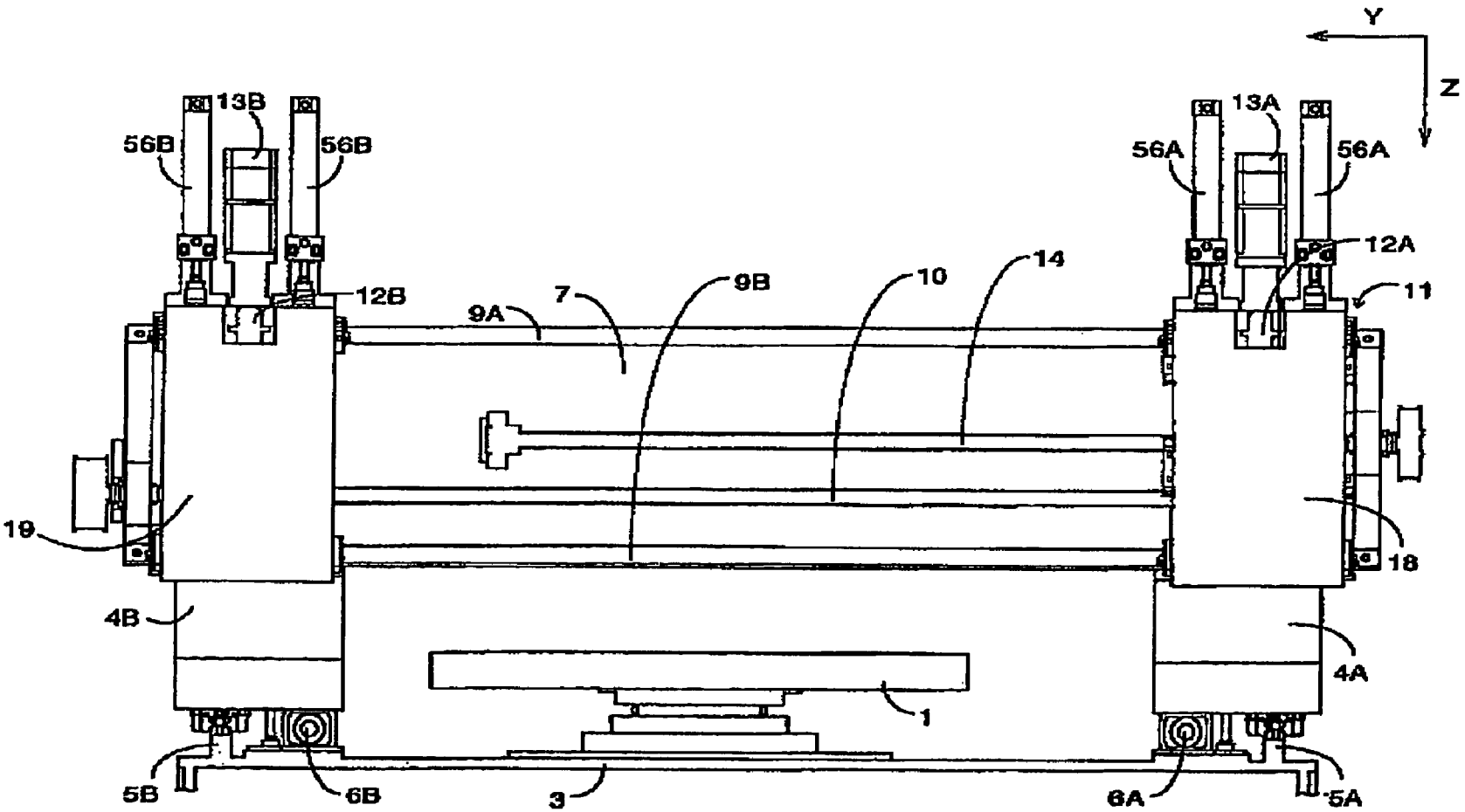
FIGS. 6A and 6B are a front and a side views of the grooving machine of FIG. 1A, which are depicted for explaining a primary part of the grooving machine of FIG. 1A.
Figure 6B:
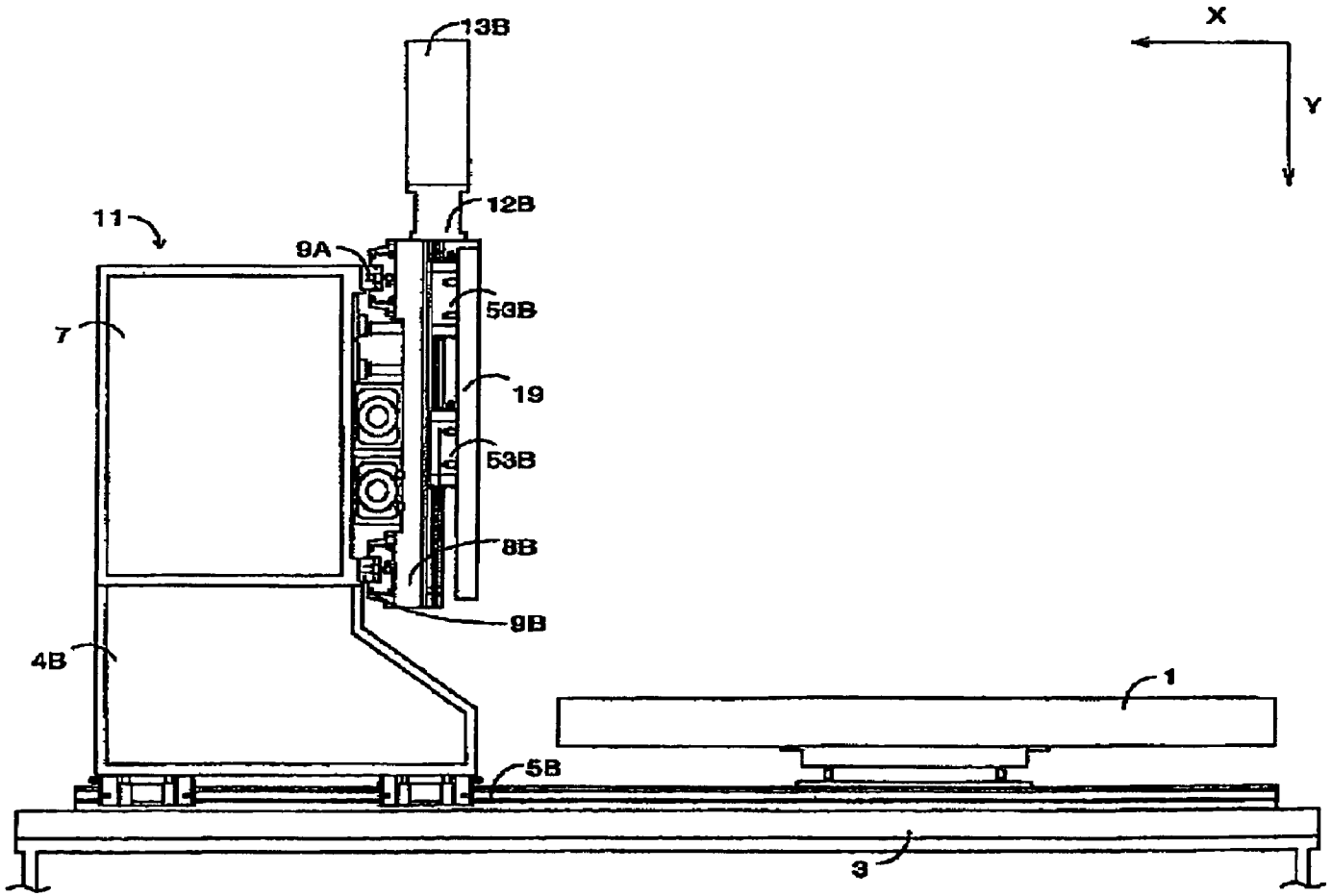
Figure 7A:
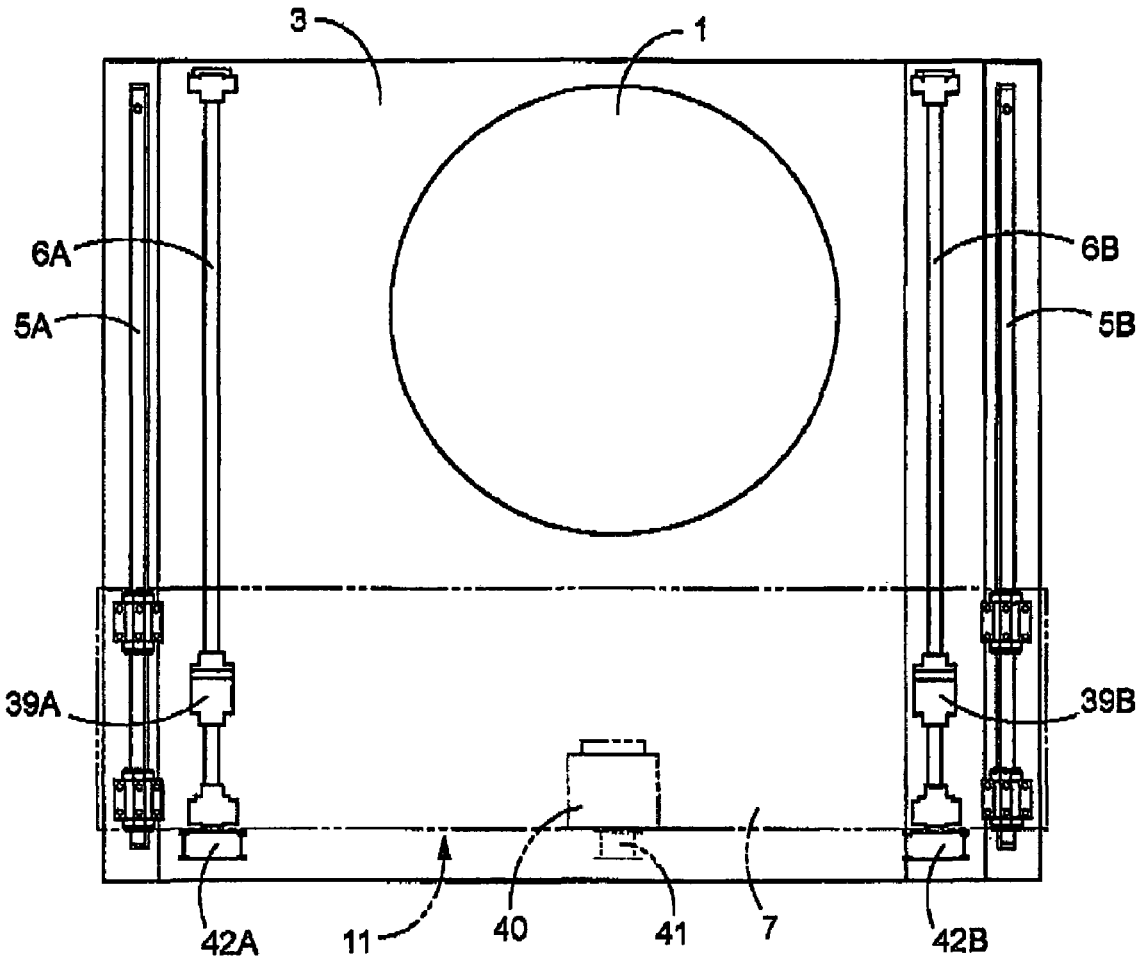
FIGS. 7A and 7B are a plane and a rear view of the grooving machine of FIG. 1A, which are depicted for explaining a primary part of the grooving machine of FIG. 1A.
Figure 7B:
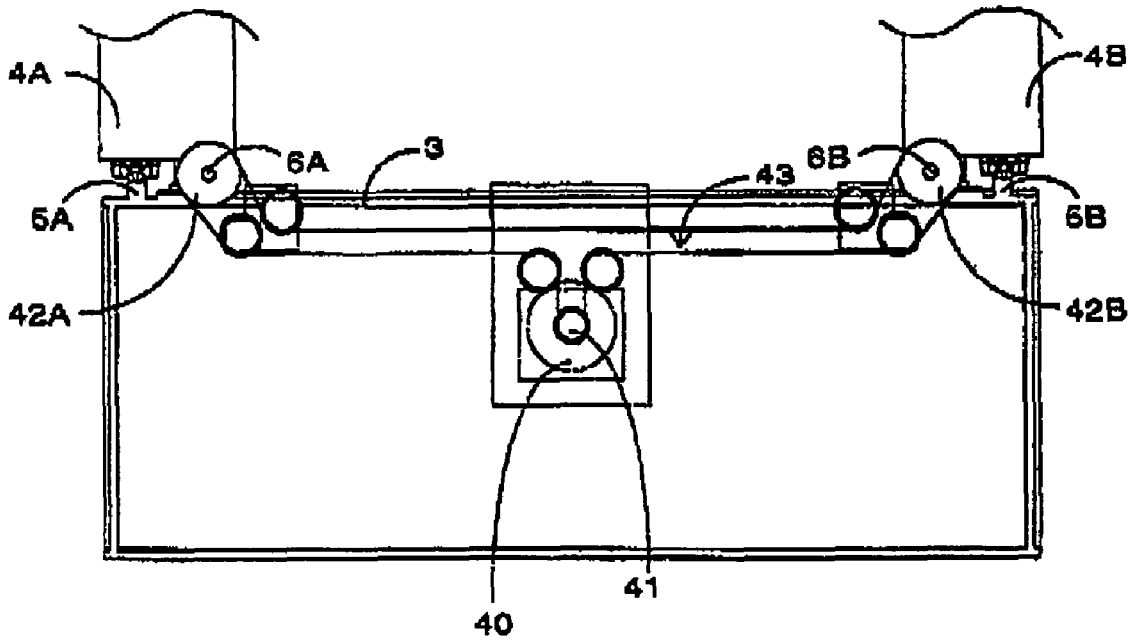

Referring next to FIGS. 6A and 6B, there are shown a plane view and a side view of the gate-shaped column 11 that is placed on the first guide rails 5A, 5B, which are disposed on the bed 3 with the circular platen 1 interposed therebetween. FIGS. 7A and 7B show drive mechanism for driving the gate-shaped column 11 in the direction of the X-axis as shown in FIG. 7A. Namely, FIG. 7A is a plane view of the bed 3 on which the pair of screw shafts 6A, 6B are disposed so as to extend along with the guide rails 5A, 5B, respectively. The motions of the screw shafts 6A, 6B in their axial direction i.e., in the direction of X-axis, are controllable. FIG. 7B shows a power transmitting system for controlling the rotation of the screw shaft 6A, 6B by using a single belt 43.

Described more specifically, the gate-shaped column 11 includes the pair of columns 4A, 4B and the cross rail 7 fixed at its both ends with the columns 4A, 4B, respectively, for thereby connecting the columns 4A, 4B. The pair of columns 4A, 4B are placed on the first guide rails 5A, 5B, respectively, so that the gate-shaped column 11 is movable in the direction of an X axis along the guide rails 5A, 5B, by the drive force generated by the screw shafts 6A, 6B. Alternatively, the gate-shaped column 11 may be formed as an integral form by welding or casting.

As shown in FIGS. 7A, 7B, the first pair of screw shaft 6A, 6B are disposed on the opposite side portions of the upper surface of the bed 3, so as to extend in the direction of the X-axis parallel to each other. A pair of ball nuts 39A, 39B are thread-engaged with the screw shafts 6A, 6B, respectively. To the ball nuts 39A, 39B, the columns 4A, 4B are fixed, respectively, whereby the gate-shaped column 11 is moved in the direction of the X-axis according to the axial motion of the ball nuts 39A, 39B along the screw shafts 6A, 6B. A drive motor 40 is disposed within the bed 3. The drive motor 40 has an output shaft equipped with a pulley 41. The rotation of the pulley 41 is transmitted to a pair of pulleys 42A, 42B, fixed to the respective screw shafts 6A, 6B, via a belt 43 wound around the pulleys 41, 42A, 42B, so that rotations of the pulleys 42A, 42B are synchronized with each other, thus moving the ball nut 39A, 39B simultaneously. The drive mechanism for driving the screw shafts 6A, 6B is not particularly limited to the illustrated one. For instance, the screw shafts 6A, 6B may be driven by respective drive motors directly connected thereto, which motors are controlled to provide synchronized operation with each other.

(c) Two Saddles 8A, 8B Mounted on a Cross Rail (Y1-Axis, Y2-Axis)

Figure 8A:
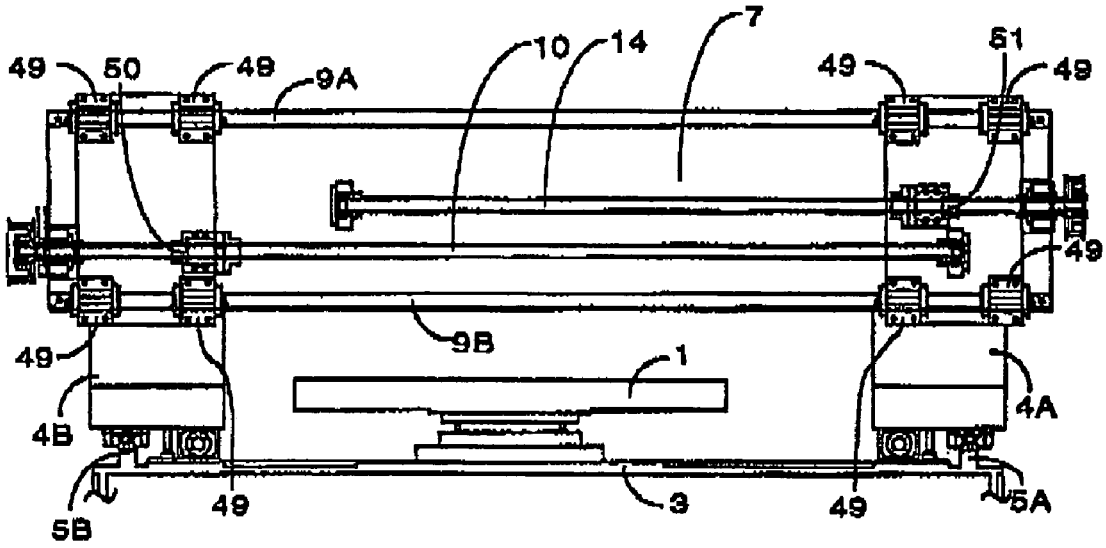
FIGS. 8A and 8B are a front and a cross sectional views of saddles of the grooving machine of FIG. 1, which are depicted for explaining a drive system of the saddles movable along a Y1 axis and a Y2 axis, respectively.
Figure 8B:
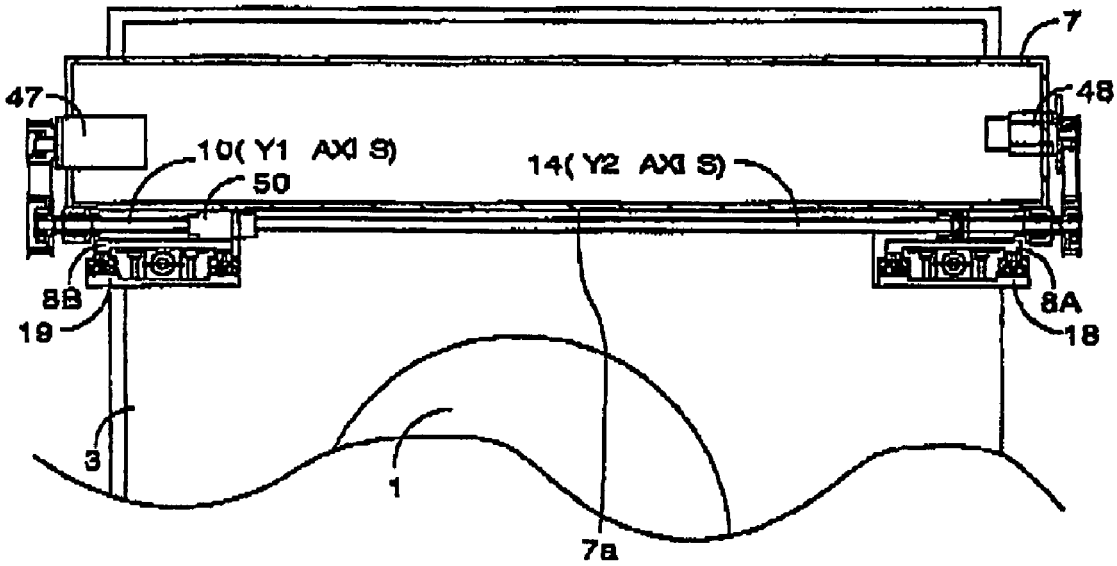

Referring back to FIG. 6A, there is shown a front view of two saddles 8A, 8B. Two saddles 8A, 8B are mounted on the second guide rails 9A, 9B disposed on the cross rail 7 so as to extend over the two symmetrical columns 4A, 4B in the direction of Y-axis perpendicular to the Z-axis and the X-axis, as shown by arrows in FIGS. 6A and 6B. Therefore, the two saddle systems 8A, 8B are movable in the direction of Y-axis along the second guide rails 9A, 9B. The two saddle systems 8A, 8B are driven by respective drive motors whose operation is controllable so as to place the saddles 8A, 8B at respective desired positions. FIG. 8A is a view corresponding to that of FIG. 6A, in which the two saddles 8A, 8B are removed from the second guide rails 9A, 9B. As is apparent from FIG. 8A, ball-screw shafts 10, 14 are disposed on the cross rail 7 so as to extend along with the second guide rails 9A, 9B, i.e., in the Y-axis direction. The screw shaft 10 is driven by an Y1-axis control motor 47, while the ball-screw shaft 14 is driven by an Y2-axis control motor 48. FIG. 8B shows power transmittal members constituting the motors 47, 48.

As is apparent from FIGS. 8A and 8B, the second guide rails 9A, 9B are disposed on the front side surface 7*a* of the cross rail 7 so as to extend parallel to each other. Each of the saddles 8A, 8B has four linear bearings 49 fixed on the rear surface thereof. The saddles 8A, 8B are mounted on the second guide rails 9A, 9B at their linear bearings, so that the saddles 8A, 8B are slidably movable along the second guide rails 9A, 9B in the Y-axis direction. Further, the ball-screw shafts 10, 14 are also disposed on the front side surface 7*a* of the cross rail 7 so as to extend parallel to the second guide rails 9A. 9B, which are driven by the motor 47 (Y1-axis) and the motor 48 (Y2-axis) to make a rotational motion. This rotational motion of the screw shafts 10, 14 are converted into longitudinal motions of nuts 50, 51 along the screw shafts 10, 14, respectively, which nuts 50, 51 are thread-engaged with the screw shafts 10, 14 and firmly fixed to the rear surfaces of the saddles 8A, 8B. Therefore, the saddles 8A, 8B are reciprocally moved in the Y-axis direction in accordance with the longitudinal motion of the nuts 50, 51 caused by the rotation of the screw shafts 10, 14. The motor 47 for rotating the screw shaft 10 is operable under control by a suitable control device so that the longitudinal motion of the nut 50, i.e., the displacement of the saddles 8A in the Y1-axis is suitably controlled. Likewise, the motor 48 for rotating the drive shaft 14 is operable under control by a suitable control device so that the longitudinal motion of the nut 51, i.e., the displacement of the saddles 8B in the Y2-axis is suitably controlled. In this respect, the saddles 8A, 8B share the same guide rails 9A, 9B, so that the motors 47, 48 are suitably controlled to prevent interference between the saddles 8A and 8B in the Y-axis direction.

The tool rests 18, 19 disposed on the saddles 8A, 8B may hold different kinds of cutting tools, for example. In this case, the saddles 8A, 8B are selectively driven. While the two saddles 8A, 8B are disposed on the same side, i.e., the front side of the cross rail 7 and utilize the same second rails 9A, 9B for their displacement in the Y-axis direction, the structure of the two saddles 8A, 8B are not partially limited, but may otherwise be modified or changed. For instance, the second guide rails 9A, 9B may be provided for each of the two saddles 8A, 8B. The saddles 8A, 8B may be disposed on the opposite sides, i.e., the front and rear sides of the cross rail 7, respectively, rather than the same side of the cross rail 7. In the case where the tool units attached to the tool rests 18, 19 may interfere with the other components or devices installed on the bed 3, it is effective to change arrangement of the saddles 8A, 8B on the gate-shaped column 11, thus avoiding or eliminating the undesirable interfere of the tool units and the other components.

(d) Tool Rests Disposed on the Two Saddles (Z1 Axis, Z2 Axis)

Figure 9A:
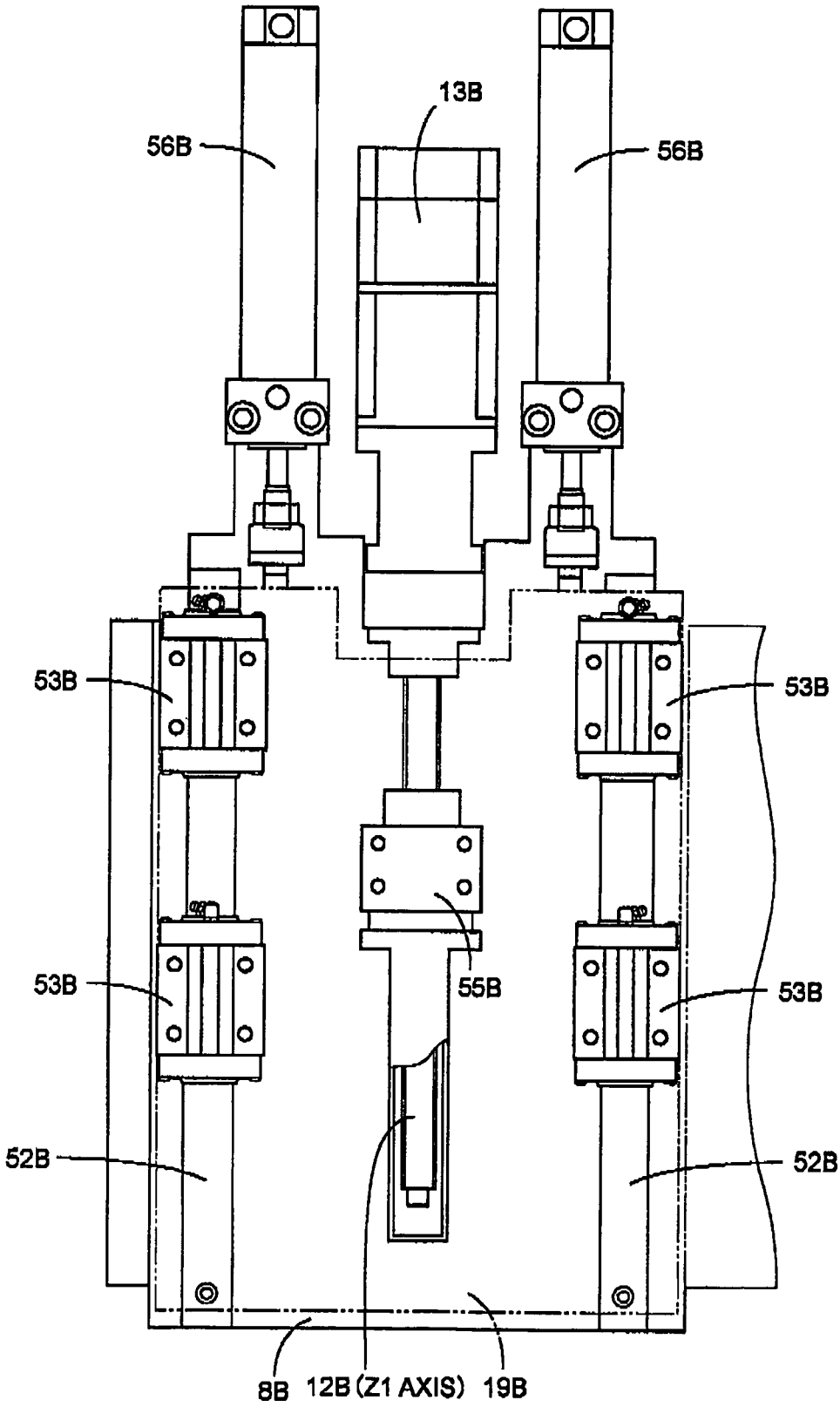
FIGS. 9A and 9B are a front and a side elevational view of an inside of the grooving machine of FIG. 1A, which are depicted for explaining a drive system of the tool holders movable along a Z1 axis and a Z2 axis, respectively.
Figure 9B:
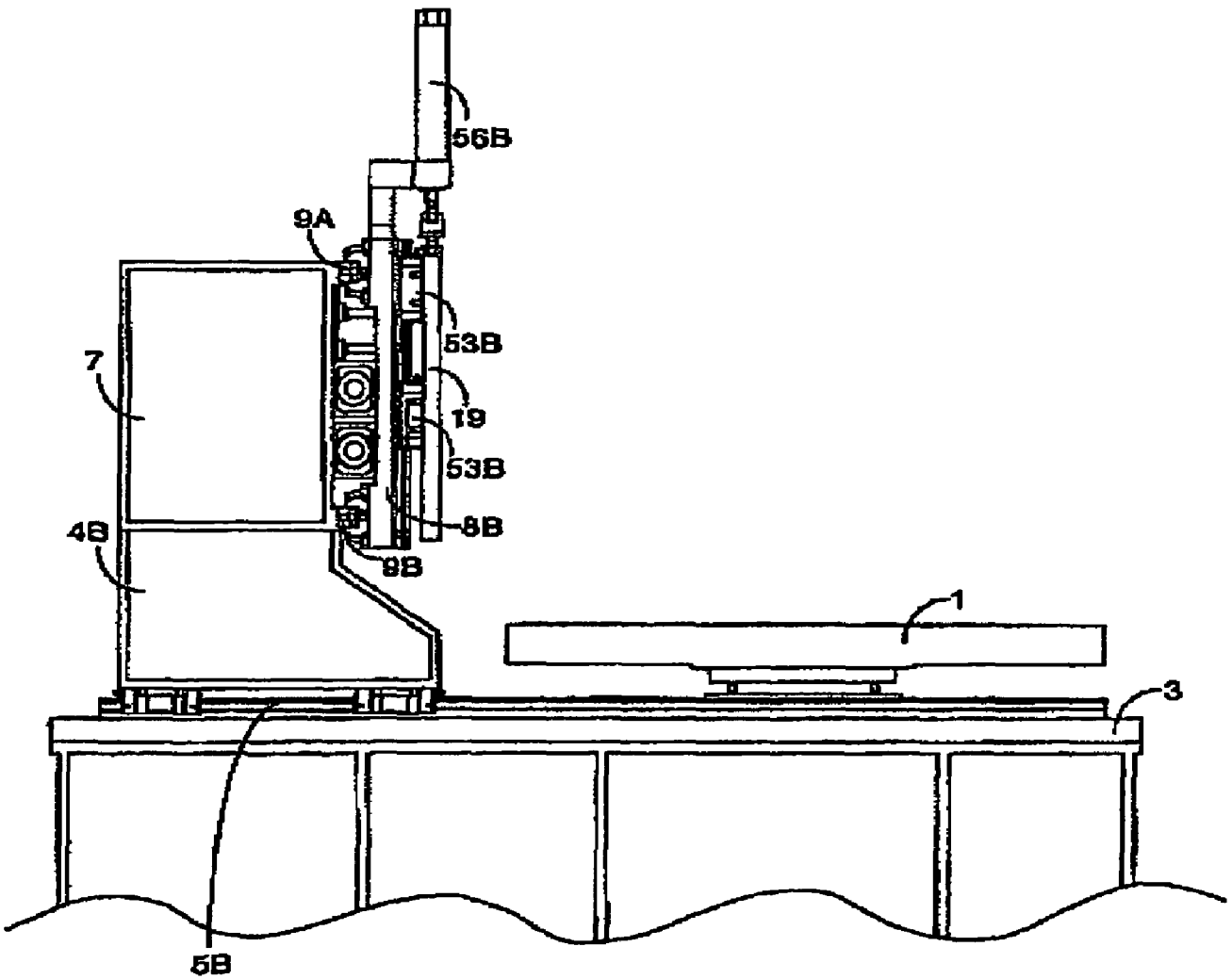
Figure 10:
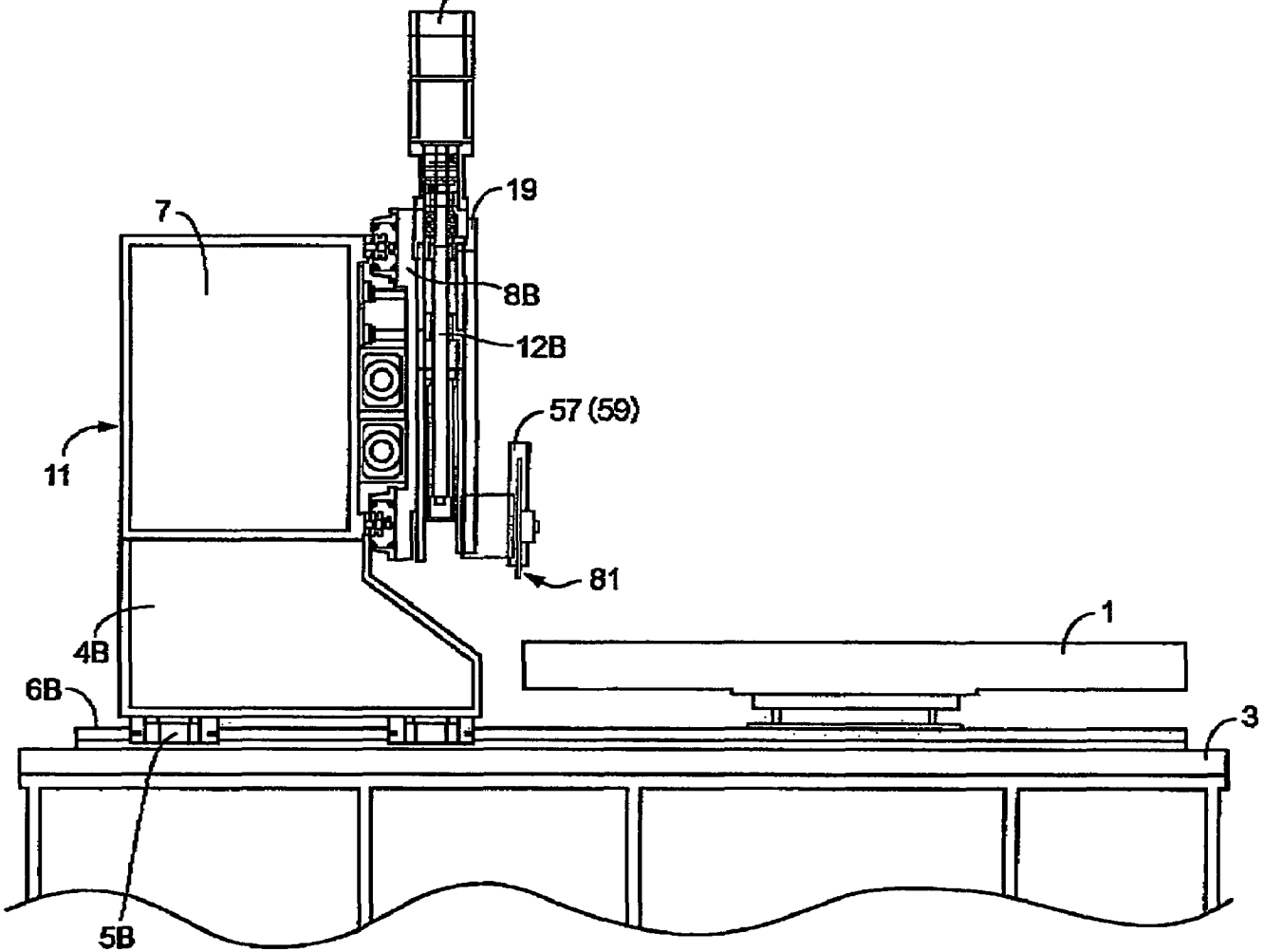
FIG. 10 is a fragmentally side elevational view of the grooving machine of FIG. 1A, which shows one operating state of the grooving machine in which a milling tool is attached to the tool holder.
Figure 11:
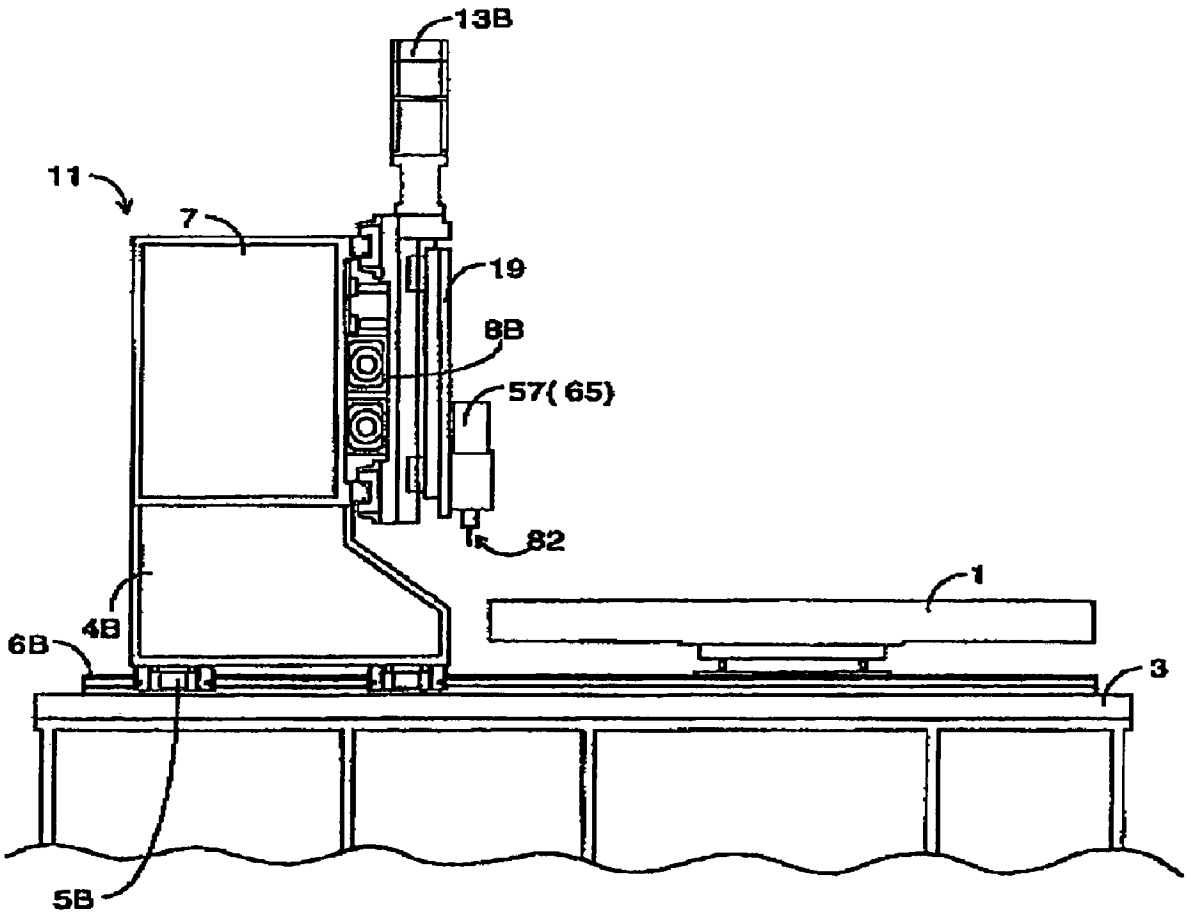
FIG. 11 is a view corresponding to FIG. 10, which shows another operating state of the grooving machine in which a drill tool is attached to the tool holder.
Figure 12:
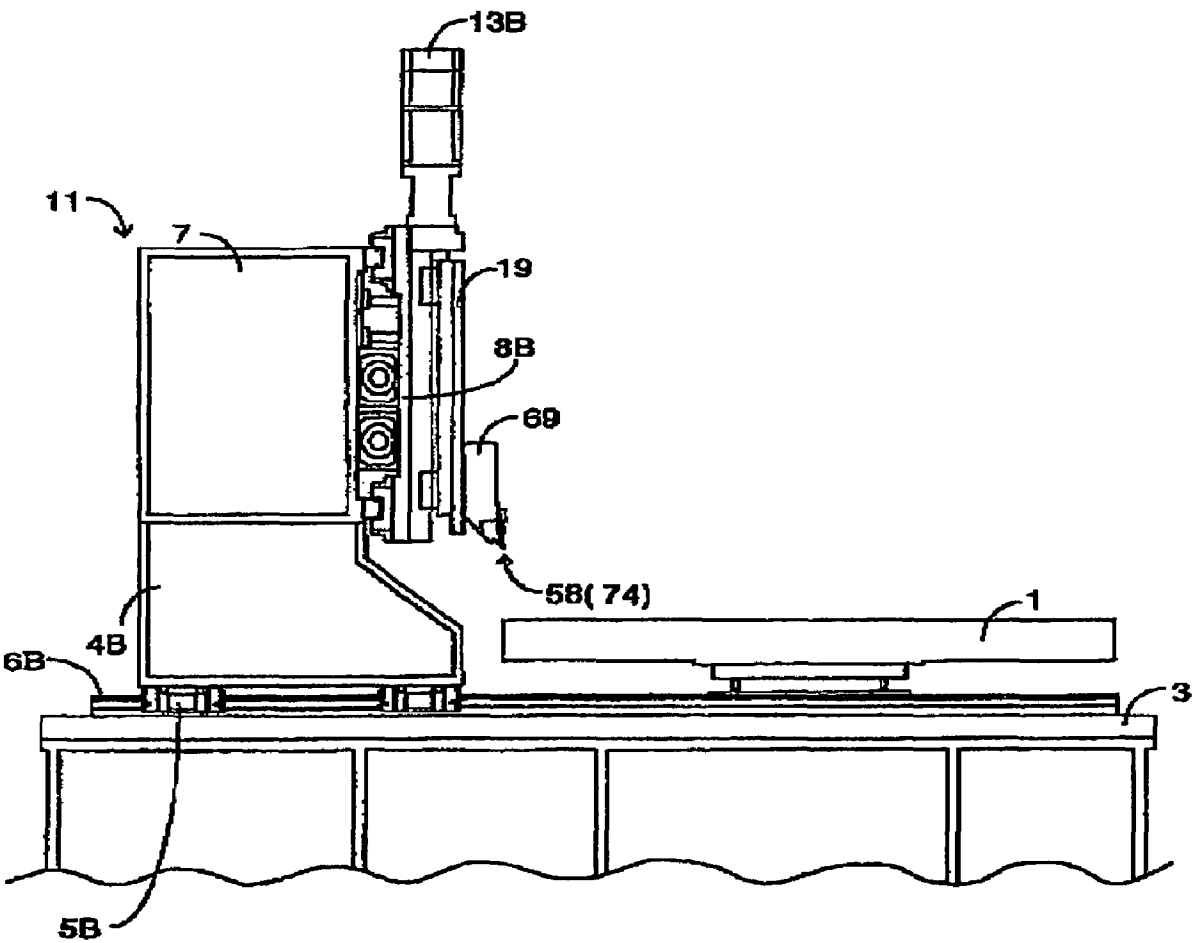
FIG. 12 is a view corresponding to FIG. 10, which shows yet another operating state of the grooving machine in which a fixed tool is attached to the tool holder.

FIG. 6A shows the tool rests 18, 19 mounted on the saddles 8A, 8B on the front side of the cross rail 7. FIGS. 9A, 9B show a front elevational view and a side elevational view of tool-rest support mechanism in which the tool rest 19 are indicated by a two-dot chain line. Further, FIG. 10 shows one example of the operating state of the tool rest 19 in which a milling cutter unit 59 as a rotative tool 57 is fixed to the tool rest 19. FIG. 11 shows another example of the operating state of the tool rest 19 in which a drill 82 as the rotative tool 57 is fixed to the tool rest 19. FIG. 12 shows yet another example of the operating state of the tool rest 19 in which a single edged tool 58 or a multi-edged tool 74 as a fixed tool 69 is fixed to the tool rest 19. It should be noted that both of the tool rests 18, 19 may be provided with various kinds of rotative tools and fixed tools in a possible variety of combinations. The tool rests 18, 19 may also be provided with the cutting device 77 which will be described later or various kinds of groove cutting tools. For instance, the tool rests 18, 19 may be provided with the rotative tool 57 and the fixed tool 69, respectively. The tool rests 18, 19 may otherwise be provided with different fixed tools, e.g., the single edged tool 58 and the multi edged tool 74, respectively. Alternatively, the tool rests 18, 19 may be provided with different rotative tools 57, namely, the tool rest 18 is provided with one of the milling cutter unit 59 and the drill unit 65, while the tool rest 19 is provided with the other.

As is apparent from FIG. 9A, a pair of third guide rails 52B are disposed on the front surface of the saddle 8B so as to extend in the Z-axis direction, while being parallel to each other. The tool rest 19 (indicated by the two-dot-chain line) is mounted on the third guide rails 52B via the four linear bearings 53B, whereby the tool rest 19 is movable along the third guide rails 52B in the Z-axis direction. A screw shaft 12B is also disposed on the front surface of the saddle 8B so as to extend in the Z-axis direction. A ball nut 55B is threaded engaged with the screw shaft 12B. On the upper end portion of the saddle 8B, there is disposed a motor 13B for driving the screw shaft 12B. The operation of the motor 13B is suitably controlled so as to regulate a feed per revolution (i.e., an amount of depth of cut) of a tool fixed to the tool rest 19. A pair of balancers 56B are also disposed on the upper end portion of the saddle 8B. The presence of the balancers 56B ensures a stable weight balance of the tool rest 19 in the Z-axis direction, thus ensuring smooth displacement of the tool rest 19 and accurate positioning control of the tool rest 19. As is understood from the foregoing description, the circular platen 1, the gate-shaped column 11, the saddles 8A, 8B and the tool rests 18, 19 are driven and positioned by suitably controlled operation of the motor 21 for the C-axis control, the motor 40 for the X-axis control, the motors 47, 48 for the Y1-axis and Y2-axis control, and the motor 13A, 13B for the Z1-axis and Z1-axis control, in the present embodiment. These drive motors 21, 40, 47, 48, 13A, 13B may be servomotors of a pneumatic type, a hydraulic type, an electromagnetic type or other possible types.

In the present embodiment, the gate-shaped column 11 is guided to move in the X-axis direction by the first guide rails 5A, 5B, and the saddles 8A, 8B are guided to move in the Y-axis direction by the second guide rails 9A, 9B, while the tool rests 18, 19 are guided to move in the z-axial direction by the third guide rails 52A, 52B, as described above. Therefore, the cutting edges of the tools fixed to the tool rests 18, 19 can be accurately positioned in the above-indicated X, Y and Z-axis directions by utilizing a numerical control device (hereinafter referred to as "NC" device) 102. Namely, the NC device controls the operations of the drive motors 21, 40, 47, 48, 13A, 13B so that the positions of the gate-shaped column 11, the saddles 8A, 8B and the tool rests 18, 19 are accurately controlled. Further, the milling cutter unit 59 and the drill unit 65 are selectively detachably fixed to the tool rest 19. FIG. 10 shows one operation state of the grooving machine 10 in which the rotative tool 57 consisting of the milling cutter unit 59 having a milling cutter 81 (see FIG. 25) is fixed to the tool rest 19. FIG. 11 shows another operation state of the grooving machine 10 in which drill unit 65 having a drill 82 (see FIG. 26) is fixed to the tool rest 19.

There will be described a manner of operation of the grooving machine of the present invention when the grooving machine is operated under control of the NC device 102 for producing the polishing pad multiplicity of straight grooves arranged in the grid pattern, by way of example. First, the milling cutter units 59 are fixed to the tool rest 18 (19). Subsequently, the motor 21 is operated under control of the NC device 102 for detecting the current angular position of the circular platen 1 and then fixing the circular platen 1 in a predetermined angular position. The motor 40 is also operated under control of the NC device 102 for driving the gate-shaped column 11 to a desired position in the X-axial direction, while the motor 47, 48 are operated under control of the NC device 102 for driving the saddles 8A, 8B in the Y-axial direction, while the motors 13A, 13B are operated under control of the NC device 102 for driving the tool rests 18, 19 to a desired position in the Z-axial direction. Thus, the milling cutting unit 59 is accurately positioned on a desired portion of the foamed urethane pad, which portion is to be processed. With the milling groove cutting unit 59 being positioned as described above, the grooving process is performed according to a suitable processing program stored in a storage device of the NC device 102. Namely, a desired amount of depth of cut of the milling cutter 81 in the Z-axial direction are provided by the operation of the motor 13A, 13B under control of the NC device 102, while a desired amount of displacement of feed per revolution of the saddles 8A, 8B in the Y-axial direction are provided by the operation of the motors 47, 48 under control of the NC device 102.

On the other hand, in the case where the grooving machine is operated under control of the NC device 102 for forming a through hole through the foamed urethane pad 15, the drill unit 65 are fixed to the tool rest 18 (19). Like the above case where the grooving machine is operate to cut the grid-patterned grooves into the surface of the foamed urethane pad 15, the circular platen 1 is placed in the initial position, while the drill unit 65 is positioned on a portion of the urethane pad 15 which portion is to be processed. According to a predetermined processing program stored in the storage device of the NC device 102, the amount of depth of cut of the drill unit 65 in the Z-axial direction is produced by the operation of the motors 13A, 13B under control of the NC device 102. The rotation speed of the rotative tool 57 is suitably regulated by controlling the speed of the motor by the NC device 102.

When the grooving machine is operated under control of the NC device 102 for producing a polishing pad having a multiplicity of generally concentric annular grooves, the fixed tool 69 comprises a selective one of the single edged tool 58 and the multi-edged tool 74 is fixed to the tool rest 18 or 19 (e.g., the tool rest 19 as shown in FIG. 12). In this respect, any one of the single edged tool 58 and the multi edged tool 74 may be selected in the light of processing condition, a required cost of manufacture, or the like. The NC device 102 controls displacements of the gate-shaped column 11 in the X-axis direction, the saddle 8B in the Y-axis direction, and the tool rest 19 in the Z-axis direction, so as to place the fixed tool 69 in its initial position. Subsequently, the circular platen 1 is rotated about the C-axis under control of the NC device according to the predetermined control program. The fixing tool 69 is displaced in the Z-axis direction by a predetermined feed per revolution. In order to process all grooves at a generally constant process speed, the rotating speed of the circular platen 1 is changed depending upon the position of the fixing tool 69 in the Y-axis direction.

While one of the tool rest 19 has been described in detail in the aforementioned description, it should be appreciated that the other tool rest 18 is substantially similar in construction to the tool rest 19. Thus, the same reference numerals as used with respect to elements of the tool rest 19 will be used to identify the elements which are the same as or similar to those in the tool rest 18, and no redundant description of elements will be provided, for the sake of simplification of the description. The grooving machine constructed according to the present embodiment, permits that the rotative tool 57 (e.g., milling cutter 81 or drill 82) is fixed to one of the tool rests 18, 19 and the fixed tool 69 (e.g., the single edged tool 58 and the multi-edged tool 74) is fixed to the other one of the tool rests 18, 19. Preferably, these tool units or other various kinds of tool units are easily detachably fixed to the tool rests 18, 19, thus facilitating interchange of the tools. This makes it possible to select and use a suitable tool depending upon a kind of material of the foamed urethane pad 15, and condition of the cutting, thus assuring a further improved dimensional or shape accuracy of the formed grooves. It should be understood that the motors 21, 40, 47, 48, 13A, 13B may be constituted by linear motors rather than the illustrated servomotors, for ensuring an high accuracy of positioning and an improved speed of response of the circular platen 1, the gate-shaped column 11, the saddles 8A, 8B, the tool rests 18, 19 which are moved by these motors in the X, Y1, Y2, Z1, Z2 axes.

(e) Numerical Control Device to Control Motor and Control Axis

Numerical control device 102 is adapted to control operation of the motors 13A, 13B, 21, 40, 47, 48, so that the circular platen 1, the gate-shaped column 11, the saddle 8A, 8B, the tool rests 18, 19 are accurately and smoothly positioned in the C, X, Y and X axes, respectively. The numerical control device 102 permits to control the motors 13A, 13B to regulate the feed per revolution of the tool rests 18, 19 at minute units. The numerical control device 102 enables an automatic synchronizing control operation of the plurality of motors, according to a suitable control program that is stored in its storage device in advance. In this storage device of the NC device 102, a plurality of grooving patterns to be reproduced on the surface of the foamed urethane pad 15 are stored in advance. A suitable grooving pattern is selected from the stored grooving patterns, then the operations of the processing program for the selected grooving patterns with respect to the respective control axes C, X, Y, Z are prepared. According to this predetermined processing program, the grooving machine of this embodiment is automatically operated so as to reproduce the selected grooving pattern on the surface of the polishing pat.

Figure 13:
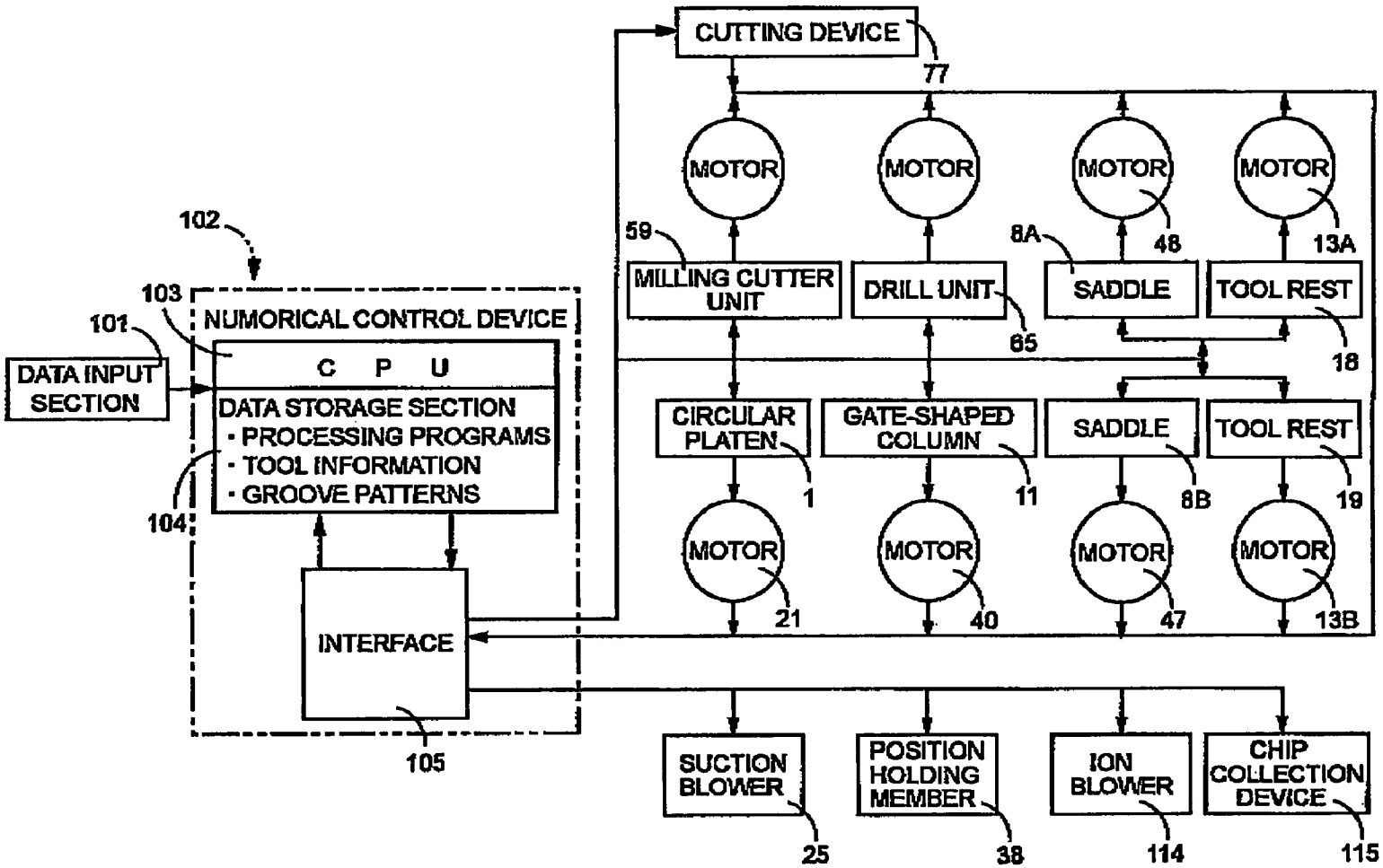
FIG. 13 is a block diagram schematically illustrating an essential structure of a numerical control device employed for controlling operation of the grooving machine of FIG. 1A.

Referring next to FIG. 13, there is shown a block diagram schematically showing a control system of the NC device 102 adapted to control operation of the grooving machine. Described in detail, the NC device 102 includes data input section 101, a central processing unit (CUP) 103, a data storage section 104 and an I/O interface. Upon starting the grooving process under control of the NC device 102, a tool command representing a kind of required tool, and dimensional information of the required tool is applied to the numerical control device 102 through the data input section 101. The required tool is suitably determined depending upon a desired groove pattern, e.g., a grid pattern or a generally concentric annular groove pattern. This tool command is stored in the data storage section 104 via the CPU 103. Once an operation command is applied from the input section 101, the CPU 103 controls operation of the respective motors 13A, 13B, 21, 40, 47, 48, and the cutting device 77 according to a suitable processing program with reference to data stored in the storage section 104, so that the operations of the circular platen 1, the gate-shaped column 11, the saddles 8A, 8B, the tool rests 18, 19 and the milling cutter unit 59, the drill unit 65 are accurately controlled. Each motor is equipped with an encoder. An amount of rotation of the motor detected by the encoder is applied to the NC device so that the NC device controls the operation of the grooving machine in a feedback control fashion. The CPU 103 also controls operation of the suction blower 25, the position holding member 38 of the circular platen 1, the ion blower 114, and a chip collection device 115.

It should be appreciated that the operation of the grooving machine may be controllable by utilizing a sequential control device 110, instead of the NC device 102 as described above. The use of the sequential control device 110 instead of the numerical control device 102 enables to simplify the entire control system and reduce the cost of the device, although accuracy of control in positioning, feeding, and cutting are somewhat limited in comparison with that in the numerical control device 102. Therefore, one of the numerical control device 102 and the sequential control device 110 may be optionally selected depending upon the use or processability of the foamed urethane pad 15.

Figure 14:
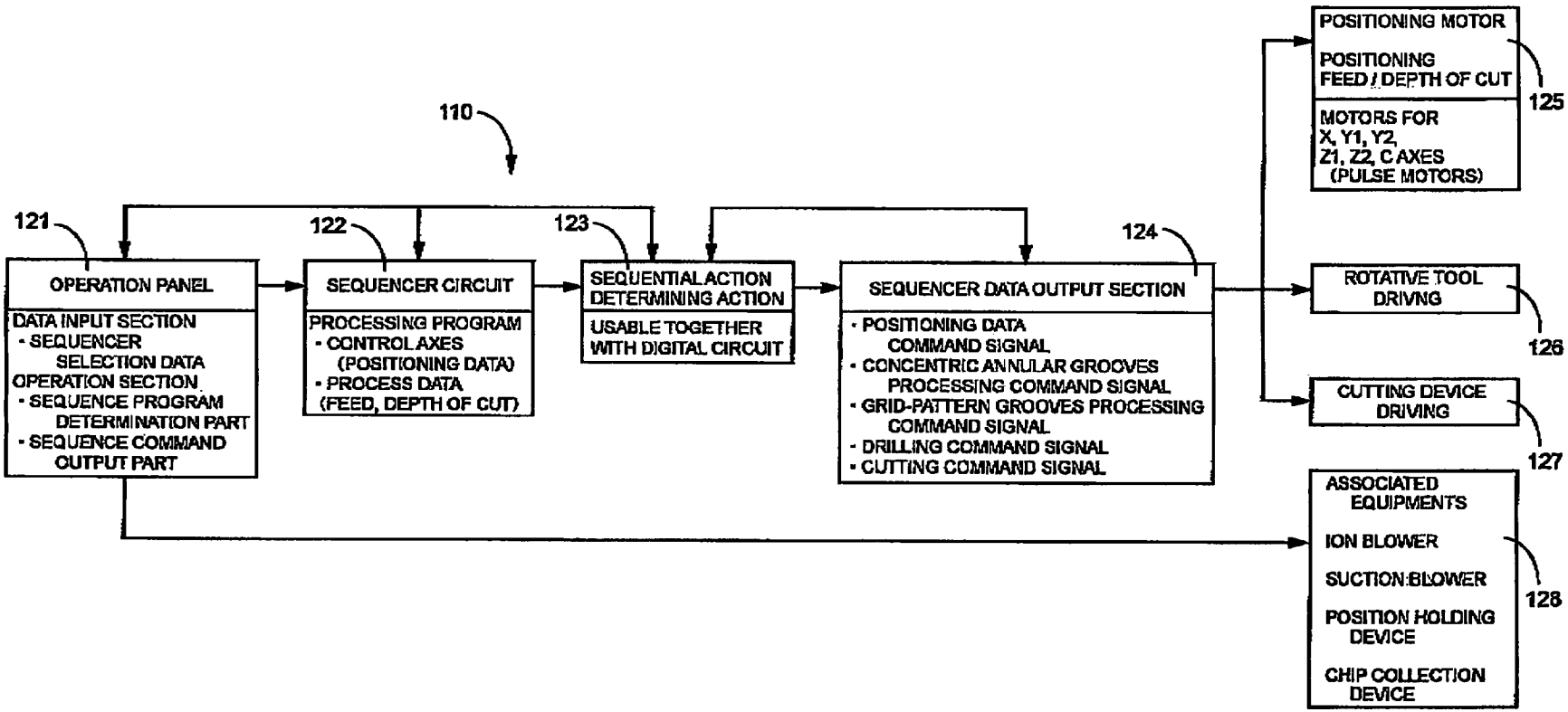
FIG. 14 is a block diagram schematically illustrating an essential structure of a sequence control device employed for controlling operation of the grooving machine of FIG. 1A.

Referring next to FIG. 14, there is shown a block diagram schematically showing a sequential control system of the sequential control device 110 adapted to control operation of the grooving machine. Described in detail, the sequencer device 110 includes an operation panel 121, a sequencer circuit section 122, a sequential action determining section 123, and a sequencer data output section 124. Upon starting the grooving process of the grooving machine under control of the sequencer device 110, various kinds of data including positional data of the control axes and process data with respect to feed per revolution, an amount of depth of cut, or the like, and a suitable sequential control program representing a predetermined sequence of processing steps, are applied to the sequencer circuit 122 via the operation panel 121. The sequencer circuit 122 outputs the data received from the operation panel 121 to the sequential action determining section 123 that comprises a sequencer unit and relay circuits. The sequential action determining section 123 outputs action data to the sequencer data output section 124. The sequencer data output section outputs an action command signal based on the action data to a positioning drive motor 125 operable for controlling positions feed rates, and or depths of cuts of the components arranged in the X, Y1, Y2, Z1, Z2 C axes, a drive motor 126 adapted to drive the rotative tool 69, and a drive motor 127 adapted to drive the cutting device 77, so that these drive motors 125, 126, 127 are operated according to the received action command signals. The sequencer data output section 124 is operable to generate next action command signals to the drive motors 125, 126, 127 each time the operations of these motors 125, 126, 127 according to the current command signals are terminated. That is, the sequencer device 110 controls the operation of these drive motors 125 126, 127 in an open-loop control fashion. In the present embodiment, the positioning motors 125, the drive motors 126, 127 may be constituted by utilizing pulse motors. Meanwhile, the grooving machine is provided with various kinds of associated equipments 128 including the ion blowing device 114, the suction blower 25, the position holding device 38, the chip collection device 115. The operation of the associated equipments 128 can be controlled directly through the operation panel 121.

(f) Ion Blowing Device

Figure 15A:
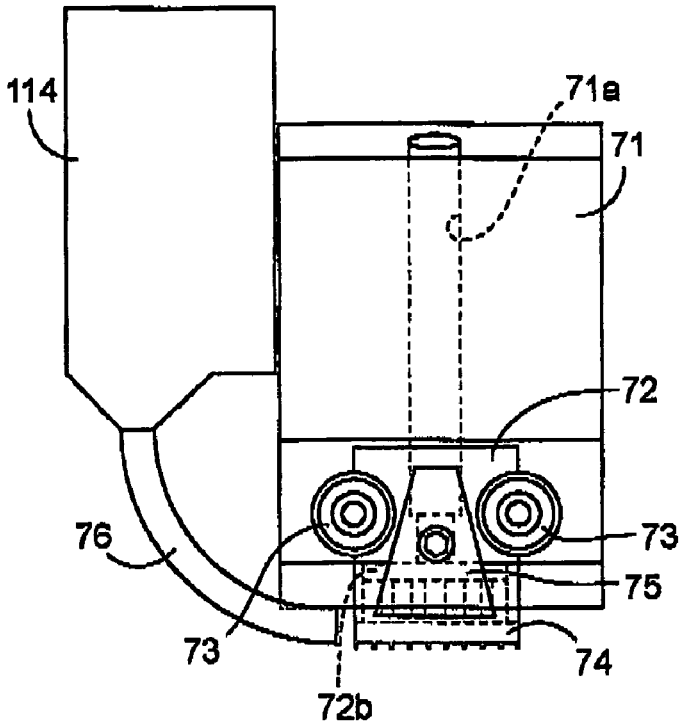
FIG. 15A is a front elevational view of an ion blowing device used in the grooving machine of FIG. 1 for neutralizing charged components of the grooving machine.
Figure 15B:
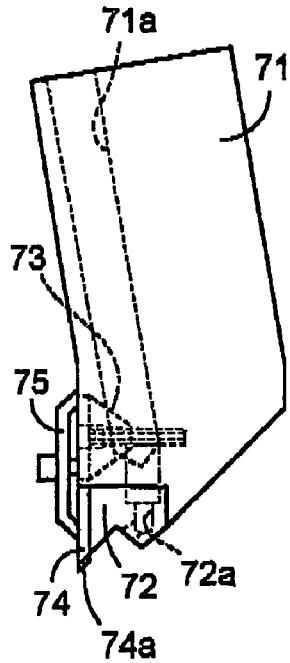
FIGS. 15B and 15C are a side and a bottom elevational view of the ion blowing device, respectively.

Referring next to FIGS. 15A, 15B, there is shown the ion-blowing device 114 adapted to generate and blow positive ions formed by corona discharge. The ion-blowing device 114 includes a compressed air generator (not shown) and a blower nozzle 76, so that the generated positive ions are discharged through the blower nozzle 76 together with the compressed air. Alternatively, the positive ions are discharged through holes 71(*a*), 72(*a*) which will be described later. This ion-blowing device 114 is disposed in a portion of the grooving machine such that a protruded open-end portion of the blower nozzle 76 is located in the vicinity of the attached cutting tool, e.g., the fixed tool 69 or the rotative tool 57 (the multi-edged tool 74 is attached in FIGS. 15A-15C by way of example). When the foamed urethane pad 15 is subjected to the grooving process, cut fragments or chips of the foamed urethane pad 15 are likely to be electrically charged due to friction between the cutting tools and the urethane pad 15, and stick to the surface of the urethane pad 15 and the cutting tools, resulting in difficulty in removing the charged chips from the surfaces of the cutting tool and the urethane pad. To cope with this problem, the ion blowing device 114 is operated to blow the positive ions on the chips stuck to the cutting tool and the foamed urethane pad 15, while the grooving process is executed for the foamed urethane pad 15, whereby the chips are effectively neutralized and removed from the cutting tool and the urethane pad 15. When the multi-edged tool 74 of the fixed tool is used for forming simultaneously a plurality of grooves on the foamed urethane pad 15, in which a plurality of cutting edges are juxtaposed to each other, it is required to evenly blow the positive ions on the respective cutting edges so that the positive ions forcedly come into collision with the charged chips. To meet this requirement, the protruded open-end portion of the nozzle 76 may be suitably arranged.

Figure 15C:
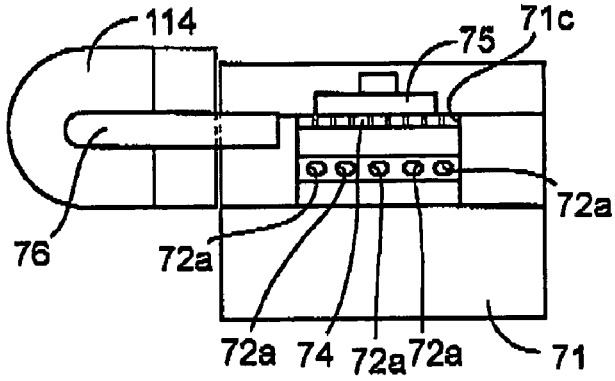

FIGS. 15A-15C show a front, a side and a bottom elevational view of the ion-blowing device 114 that is fixed to a tool holder 71. The tool holder 71 has a rectangular block shape and detachably fixed to the side face of the tool rest 18 (19) by means of suitable fastening means such as a bolt. The tool holder 71 has the above mentioned through hole 71*a* formed therethrough in the vertical direction as seen in FIG. 15A through which positive ions are discharged. To the bottom face of the tool holder 71, a rectangular block shaped tool cartridge is fixed such that the tool cartridge 72 is supported by tapered bush 73 so as to be positioned in the vertical direction as seen in FIG. 15A. The tool cartridge 72 has the above-indicated plurality of straight holes 72*a* extending therethrough in the vertical direction as seen in FIG. 15A. These straight holes 72*a* are held in communication with the through hole 71*a* of the tool holder 71, so that the lower end of the through holes 71*a* is exposed to the atmosphere through the straight holes 72*a*.

As shown in FIG. 15A, the multi edged tool 74 is fixed to the tool holder 71 by way of example. The multi edged tool 74 may be a tool detachably installable on the tool holder 71 with high accuracy. For instance, the multi-edged tool 74 is fixed to the tool cartridge 72. The cartridge 72 is positioned relative to the tool holder 71 by means of tapered bushes 73, 73. The cartridge 72 is guided by the side walls of the tool holder 71, and is firmly fitted to the tool holder 71 by means of a pressing plate 75 that is bolted to the tool holder 71. The positive ions can be discharged from the side of the attached tool through the nozzle 76. In the case where the multi edged tool 74 is attached to the tool holder 71 as described above with the compressed air, the ion blowing device 114 may be arranged to blow the positive ion through the through hole 71*a* formed through the tool holder 71 and the straight holes 72*a* formed through the cartridge 72 instead of or in addition to the nozzle 76. In the ion-blowing device 114, the compressed air generator may be disposed within the nozzle 76, or the straight holes 72*a*, for example. Alternatively, the compressed air generator may be constituted by utilizing an external compressed air source that is held in fluid communication with the nozzle 76 or the like via an air conduit. It should be appreciated that the compressed air generator is interpreted to mean the overall structure thereof including the air conduit connecting between the external compressed air source and the nozzle 76 or the like.

Instead of the multi-edged tool 74, the single edged tool 58, and the rotative tool such as the milling cutter unit 59 and the drill unit 65 may be mounted on the tool holder 71, likewise. In this case, the blowout of the ion may be possibly executed through the nozzle 76. It should be understood that the construction of the blower passage of the ion blow device 114 is not limited to the above, but may otherwise be modified, as needed.

(g) Fixed Tool (Turning Tool/Cutting Tool)

(1) Turning Tool (Single Edged Tool and Multi Edged Tool)

Figure 16A:
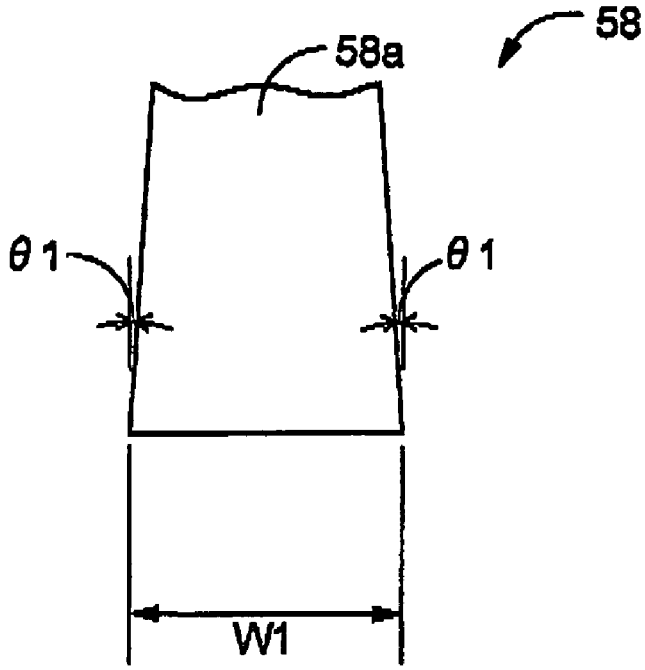
FIGS. 16A and 16B are a front and a side views of a turning tool having a single cutting part, which is usable in the grooving machine of FIG. 1.
Figure 16B:
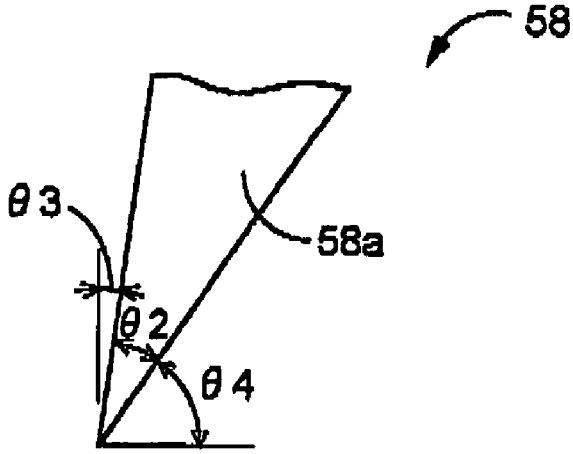
Figure 17A:
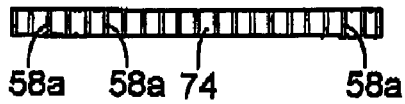
FIGS. 17A, 17B, and 17C are bottom, side and front views of a turning tool having a plurality of cutting parts, which is usable in the grooving machine of FIG. 1.
Figure 17B:
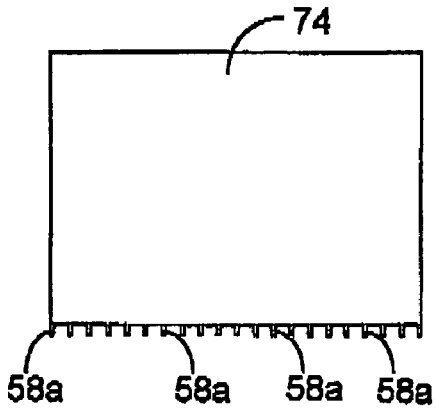
Figure 17C:
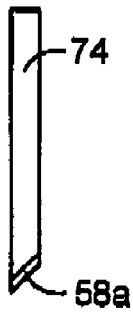

FIGS. 16A and 16B show a front and a side elevational view of the single edged tool 58 as one example of the fixed tool 69. FIGS. 17A-17C shows a bottom, a front and a side elevational view of the multi edged tool 74 as another example of the fixed turning tool 69. The single edge tool 58 and the multi edged tool 74 are suitably used for the grooving process in which the plurality of generally concentric annular grooves are formed on the surface of the foamed urethane pad 15.

The single edged tool 58 has a cutting part 58*a* that is arranged as follows so that the single edged tool 58 is suitable for cutting a working piece made of a resin material, e.g., a foamed urethane pad. Namely, the cutting part 58*a* of the single edged tool 58 has a tooth width: W1 within a range of 0.005-11.0 mm, a side clearance angle: θ1 within a range of 0-3 degrees, as shown in FIG. 16A. Further, the cutting tooth of the single edged tool 58 has a wedge angle: θ2 within a range of 15-35 degrees, a rake angle: θ3 within a range of 10-20, and a front clearance angle θ4 within a range of 45-65 degrees, as shown in FIG. 16B. These angles of respective parts of the cutting part 58*a* of the single edged part 58*a* are determined taking into account a problem of interface between the cutting part 58*a* and walls of the foamed grooves and a required strength of the cutting part 58*a*. Preferably, the single edged part 58*a* is made of a rigid material, such as hard metal, high speed steel, carbon steel, ceramics, cermet, and diamonds.

As shown in FIGS. 17A-17C, the multi-edged tool 74 has a thin rectangular plate-like shape and includes a plurality of cutting parts 58*a* integrally formed on and protruding from its bottom end as seen in FIG. 17A, such that the plurality of cutting parts 58*a* are arranged in a longitudinal direction of the multi-edged tool 74 at regular intervals within a range of 0.2-2.0 mm, over a substantially entire area of the bottom end of the multi-edged tool 74. It is noted that each of the plurality of cutting parts 58*a* of the multi-edged tool 74 is dimensioned identically with the cutting part 58*a* of the single edged tool 58. That is, the multi-edged tool 74 serves as a tool tip having a plurality of cutting parts 58*a* integrally formed in the end portion thereof.

Figure 18A:
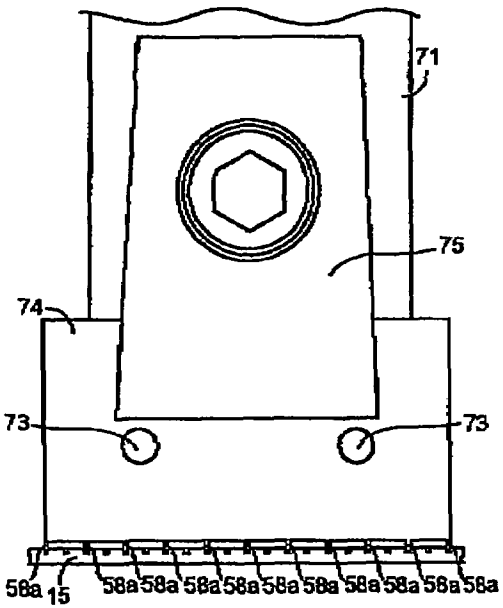
FIGS. 18A, 18B and 18C show enlarged front elevational view of one example of a tool tip.
Figure 18B:
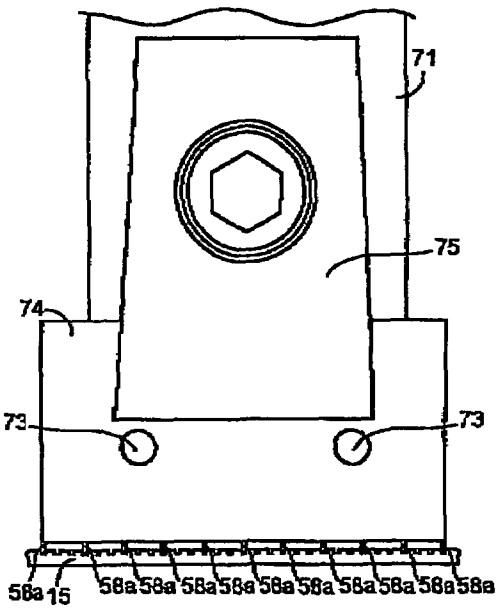
Figure 18C:
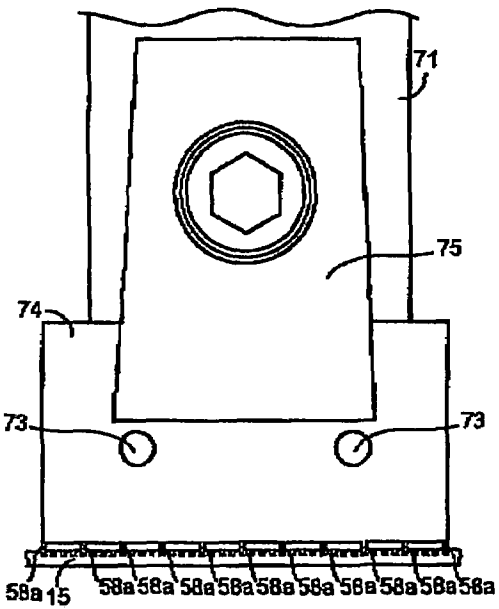
Figure 19A:
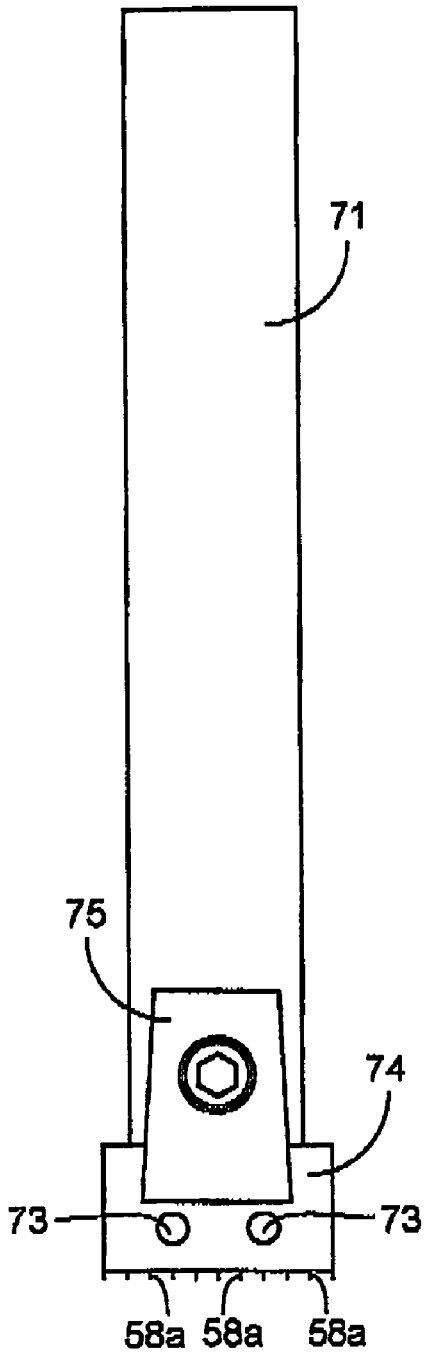
FIGS. 19A and 19B are a front and a side view of a tool holder to which the tool chip of FIG. 18 is attached.
Figure 19B:
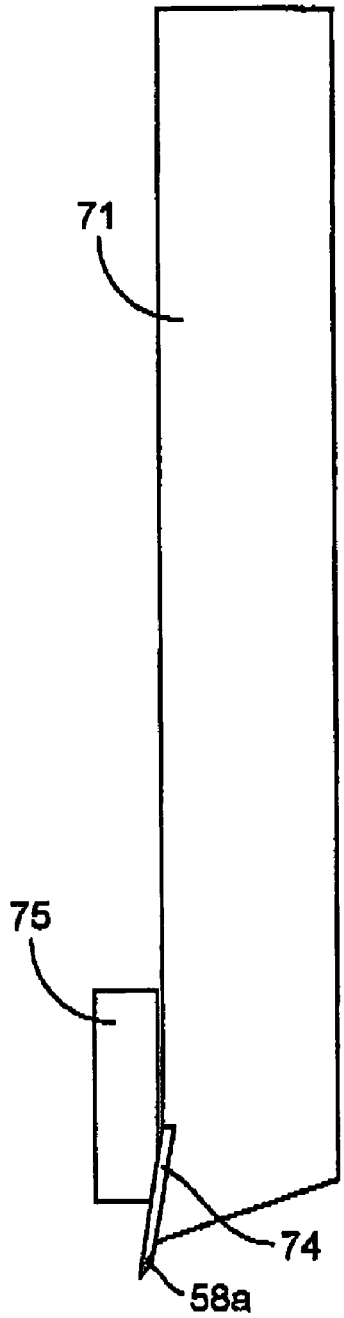
Figure 20:
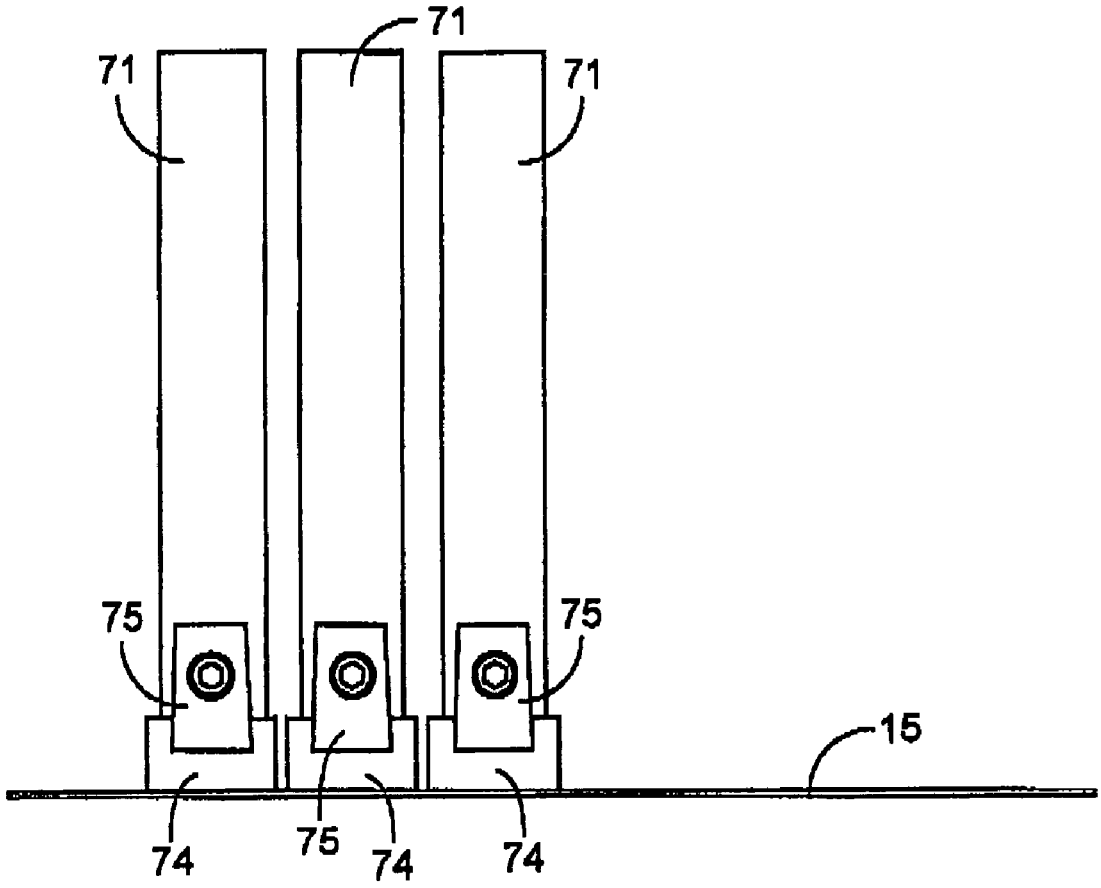
FIG. 20 is an explanatory view showing one example of operation state of the grooving machine of FIG. 1, in which a plurality of tool chips attached to the tool holder are arranged in one direction.
Figure 21:
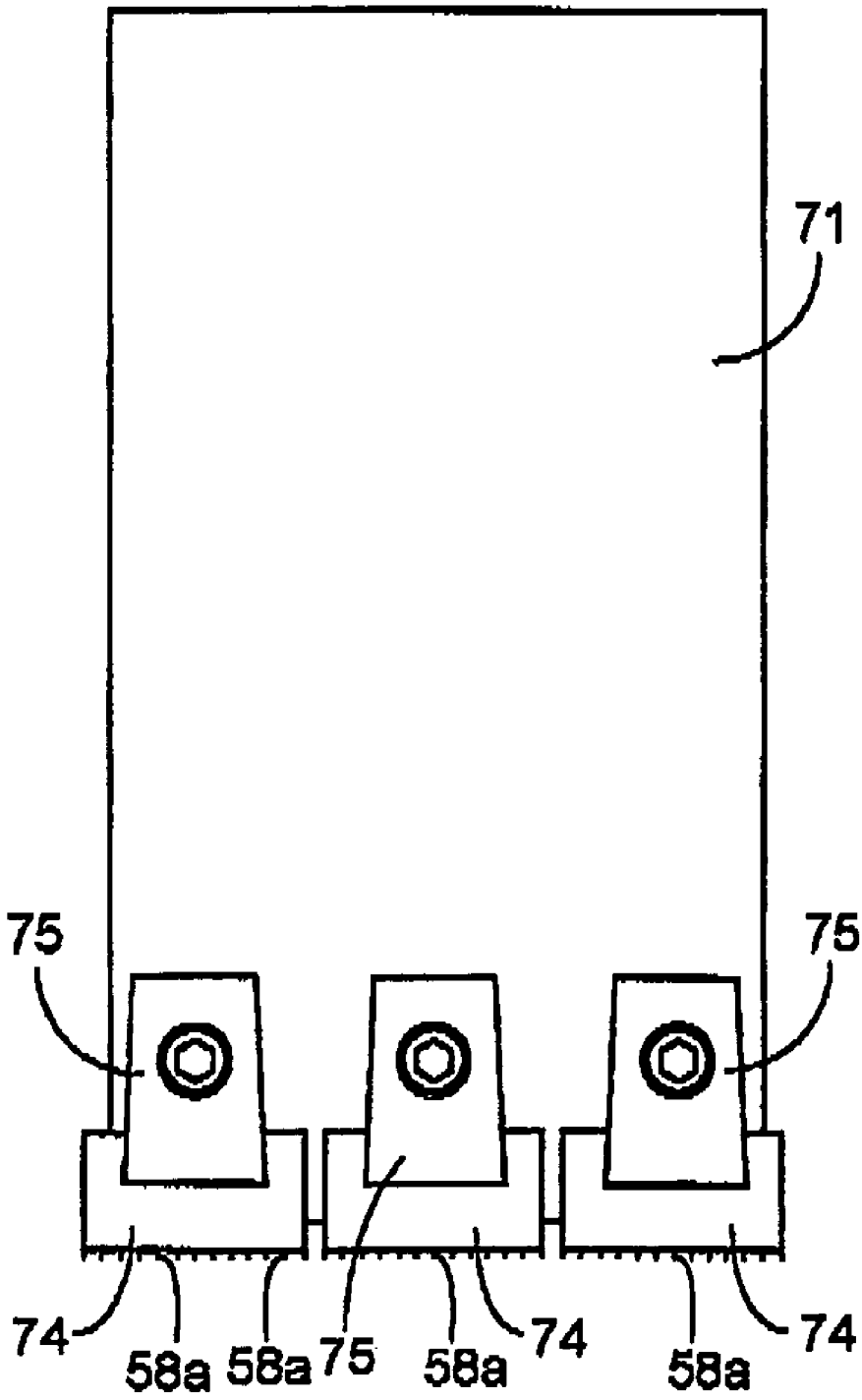
FIG. 21 is an explanatory view showing one example of operation state of the grooving machine of FIG. 1, in which a plurality of tool chips of FIG. 18 are fixed to the tool holder.

Referring next to FIGS. 18 and 19, there is shown by way of example the multi-edged tool 74 in the form of the tool tip, which is fixed to the bottom end portion of the tool holder 71, such that the multi-edged tool 74 is gripped by and between the tool holder 71 and the pressing plate 75. Positioning pins 73 fitted to the multi-edged tool 74 is used for positioning the multi-edged tool 74 relative to the tool holder 71. The tool holder 71 equipped with the multi-edged tool 74 as shown in FIG. 19, may be solely fixed to the tool holder 18 (19). Alternatively, a plurality of tool holders 71 each equipped with the multi-edged tool 74 may be fixed to the tool holder 18 (19), as shown FIG. 20. In this case, the cutting parts 58*a* of the plurality of multi-edged tools 74 may be arranged at regular intervals, thus permitting high efficiency in cutting a plurality of grooves on the foamed urethane pad 15. As is apparent from FIG. 21, it may be possible to fixed a plurality of multi-edged tools 74 to the tool holder 71 such that the cutting parts 58*a* are arranged at regular intervals. This arrangement facilitates the formation of the plurality of grooves on the foamed urethane pad 15, likewise.

Figure 22A:
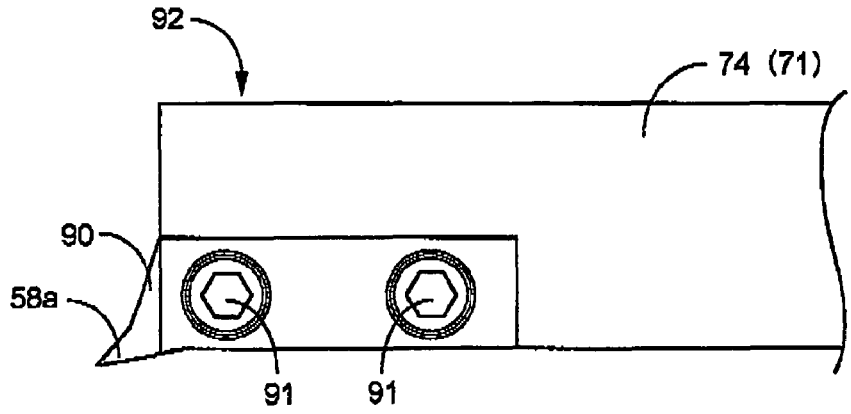
FIG. 22A is an enlarged side view of one example of a multi-edged tool tip in which a plurality of cutting parts are laminated one another.
Figure 22B:
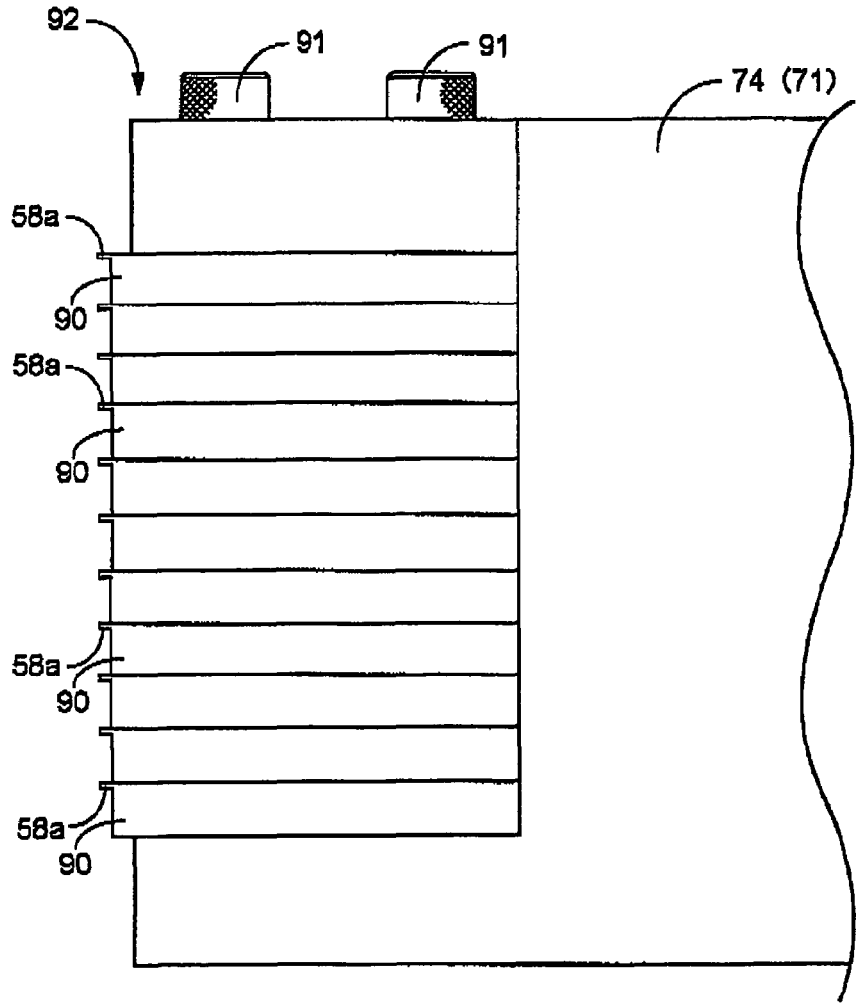
FIG. 22B is an enlarged front elevational view of the multi-edged tool of FIG. 22A.
Figure 23A:
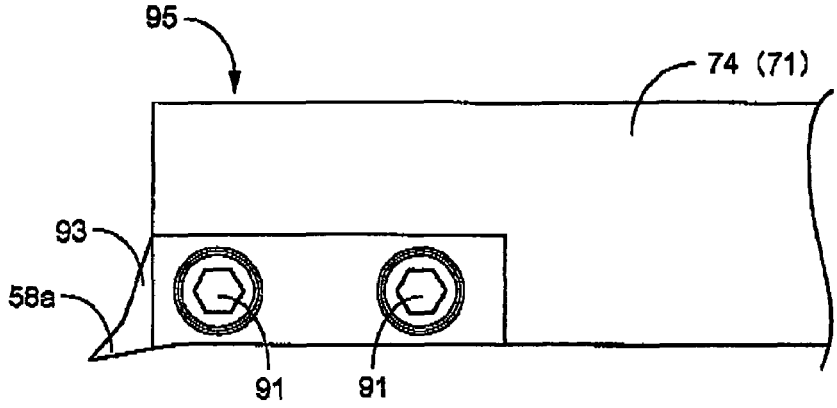
FIG. 23A is an enlarged side view of another example of a multi-edged tool tip in which a plurality of cutting edges are laminated one another.
Figure 23B:
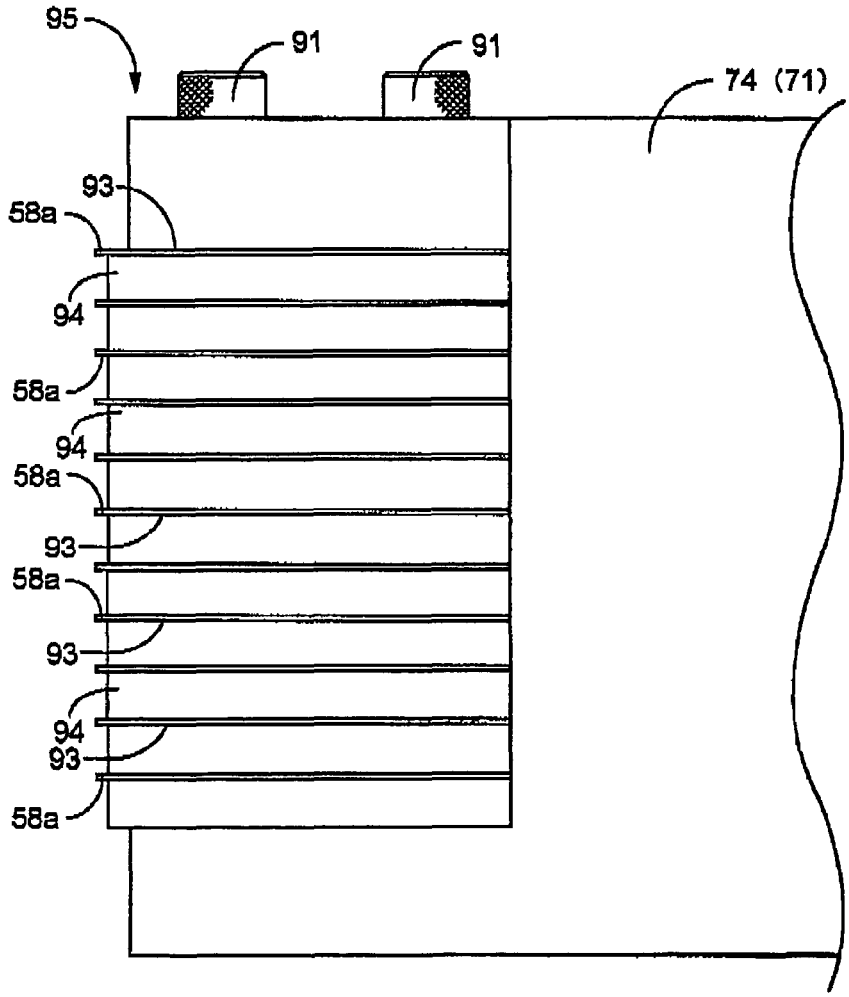
FIG. 23B is an enlarged front elevational view of the tool tip of FIG. 23A.

Referring next to FIGS. 22, 23, there are schematically shown another type of multi-edged tools 92, 95 according to the present invention by way of example. As is apparent from FIG. 22, the multi-edged tool 92 includes a plurality of cutting tips 90 each having a single cutting part 58*a*. The plurality of cutting tips 90 are superposed on each other and are detachably fixed together and fixed to the lower end portion of the tool holder 71 by means of bolts 91 such that the cutting tips 90 are spaced apart from each other with regular intervals in the width direction of the tool holder 71. As is apparent from FIG. 23, the multi-edged tool 95 includes a plurality of cutting tips 93 each having a single cutting part 58*a*. Unlike the multi-edged tool 92, the cutting tooth tips 93 are superposed on each other with spacers 94 interposed between adjacent ones of the cutting tooth tips 93. The presence of the spacers 94 makes it easy to keep the spacing between adjacent ones of the cutting tooth chips 93 constant. The lamination consists of the plurality of cutting tooth tips 93 and the spacers 94 interposed between adjacent ones of the cutting tips 93 are detachably fixed together and fixed to the lower end portion of the tool holder 71 by means of bolts 91. The thus constructed multi-edged tools 92, 95 permit an effective muss-production of the tools, an improved flexibility for a change of the pitch and an ease replacement of the cutting parts 58.

(2) Cutting Tool

Figure 24C:
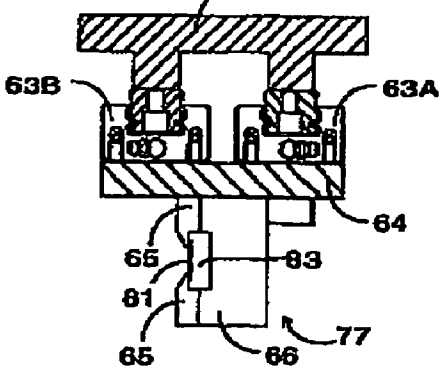
FIG. 24C is a cross sectional view of the cutting device, taken along line C-C of FIG. 24B.
Figure 24A:
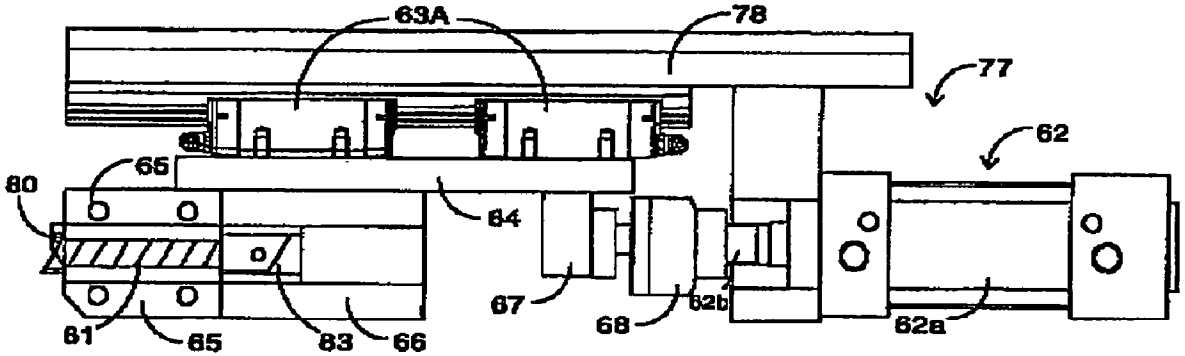
FIG. 24A is a side view of one example of a cutting device usable in the grooving machine of FIG. 1.
Figure 24B:
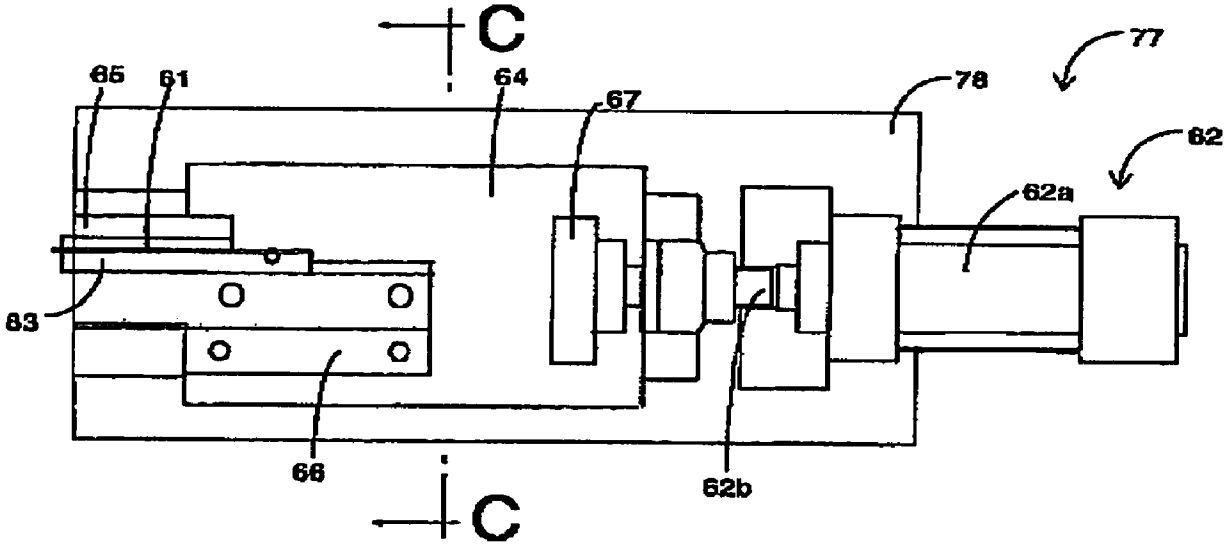
FIG. 24B is a front elevational view of the cutting device.

Referring next to FIGS. 24A-24C, there are respectively shown a side elevational view, a front elevational view and a cross sectional view taken along line C-C of FIG. 24B of the cutting device 77 which is adapted to be mounted on the tool rest 18 (19) disposed on the saddle 8A (8B) of the cutting machine constructed according to the present embodiment.

The cutting device 77 is operable to cut primary peripheral portion of the foamed urethane pad 15 to shape the external form of the foamed urethane pad 15 desirably. More specifically described, the cutting device 77 includes: a base 78; a fourth guide rails 63A, 63B disposed on the base 78 so as to extend parallel to each other in the Z-axis direction; a tool rest 64 disposed on the base 78 via the pair of fourth guide rails 63A. 63B so as to be movable in the Z-axis direction; a cutting tool holder 66 mounted on the tool rest 64; and a power source 62 disposed on the base 78 so as to generate a drive power by which the tool rest 64 is moved in the Z-axis direction. A cutting tool 61 is fixed to the cutting tool holder 66 such that a base portion of the cutting tool 61 is fitted into a cutting tool base 83 formed in the cutting tool holder 66, while being supported by the a pair of tool supports 65 with its protruding end portion supported by a stopper pin 80. An output member of the power source 62 is connected to a support member 67 disposed on the tool rest 64 via a connecting metal member 68, thus transmitting output power of the power source 62 to the tool rest 64. Thus, the cutting tool 61 is driven in the Z-axis direction. It should be understood that the power source 62 may comprises a piston-cylinder mechanism of pneumatics type or hydraulic type, or a solenoid-type actuator. It should be further understood that the cutting tool 61 may otherwise be constituted by a suitable turning tool for assuring further improved cutting ability of the cutting device 77.

(h) Rotative Tool (Milling Cutter and Drill)

(1) Milling Cutter

Figure 25A:
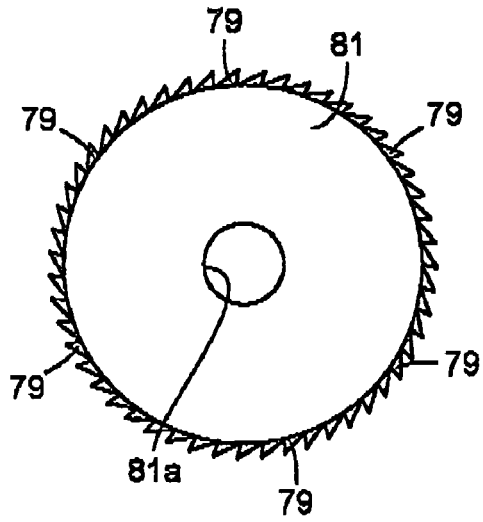
FIG. 25A is a plane view of one example of a milling cutter attachable to the milling tool of FIG. 10.
Figure 25B:
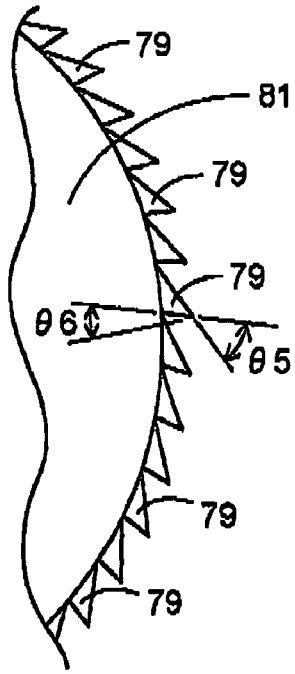
FIG. 25B is a fragmentally enlarged view of the milling cutter of FIG. 25A.

FIG. 25A shows a front view of one example of a milling cutter 81 for forming a fine groove, which is fixed to the grooving milling cutter unit 59. FIG. 25B shows an enlarged view of cutting parts 79 of the milling cutter 81 of FIG. 25A. The milling cutter 81 is a thin circular disk member, which has a center hole 81*a* formed therethrough and a plurality of cutting part 79 integrally formed in its outer peripheral portion such that the plurality of cutting part 79 are arranged in a circumferential direction of the grooving milling cutter 81 with a uniform pitch. Each of the cutting parts 79 is dimensioned to have a wedge angle: θ5 within a range of 20-45 degrees, since the wedge angle: θ5 smaller than 20 degrees may cause undesirable shortening of the life of the grooving milling cutter 81, while the wedge angle: θ5 larger than 45 degrees may cause deterioration of cutting capability of the cutting tooth 79. Further, the each cutting parts 79 is dimensioned to have a rake angle: θ6 within a range of 30-40 degrees, more preferably at around 30 degrees, since the rake angle: θ6 smaller than 30 degrees may cause deteriorated stability of the milling cutter 81, while the rake angle: θ6 larger than 40 degrees may cause deterioration of cutting capability of the cutting tooth 79. Yet further, the each cutting tooth 79 is dimensioned to have a side cutting edge angle within a range of 0-2 degrees and a tooth width within a range of 0.3 mm-2.0 mm. The thus formed milling cutter 81 is disposed radially outwardly on a tool shaft formed on the lower portion of the grooving milling cutter unit 59 and rotated in a predetermined circumferential direction by the drive motor 126. The number of the milling cutter 81 fixed to the tool shaft is not particularly limited. For instance, a plurality of grooving milling cutters 81 may be fixed to the tool shaft with constant intervals within a range of 0.1 mm or more, so that a plurality of grooves arranged in a grid pattern are formed on the foamed urethane pad 15 with improved efficiency.

(2) Drill

Figure 26A:
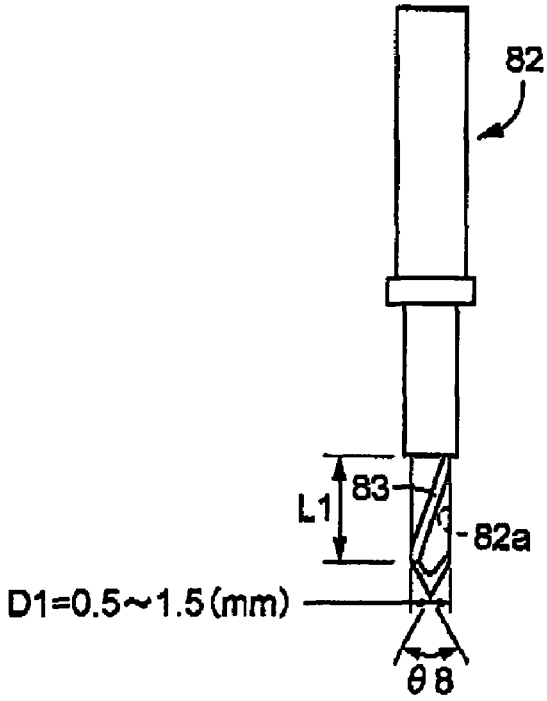
FIG. 26A is a plane view of one example of a drill attached to a drill unit of FIG. 11.
Figure 26B:
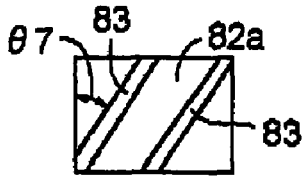
FIG. 26B is an exploded view of a major cutting part of the drill of FIG. 26A.

FIG. 26A shows a front elevational view of one example of a drill 82 to be fixed to the drill unit 65, and FIG. 26B shows an exploded view of a cutting part 82*a* of the drill 82. As shown in FIG. 26A, the drill 82 has a diameter: D1 within a range of 0.5 mm-1.5 mm and a length: L1 within a range of 20-30 mm. As shown in FIG. 26B, the cutting part 82*a* of the drill 81 includes two cutting edges 83, 83. The end edge portion of the drill 82 has a cone angle θ8 within a range of 55-65 degrees, more preferably at around 60 degrees, thus assuring a smooth inserting of the drill 81 into the work piece. A helix angle: θ7 of the two cutting edges 83, 83 is arranged to be held within a range of 1-10 degrees, preferably at about 5 degrees. This arrangement makes it possible to gradually cut a part of the foamed urethane pad 15 located around the edge of the drill 82, thereby forming a desired hole having a predetermined diameter. The number of the drill 82 fixed to the drill unit 65 is not particularly limited. For instance, a plurality of drill 82 may be fixed to the drill unit 65 to form a multi-shaft type drill unit, so that a plurality of holes are formed into the foamed urethane pad 15 with improved efficiency.

There will be described a method of producing a multiplicity of grooves on the surface of the foamed urethane pad 15 by using the grooving machine constructed according to the present invention by way of example.

(i) Concentric Fine Grooves

Figure 27B:
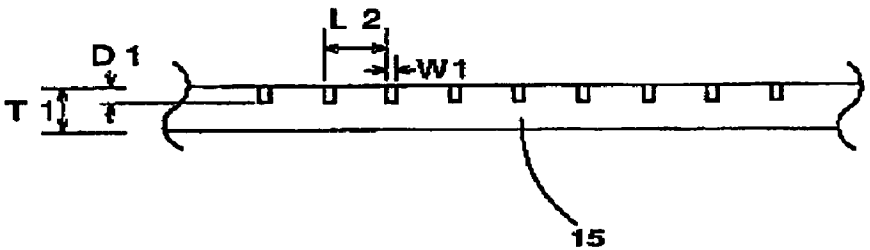
Figure 27A:
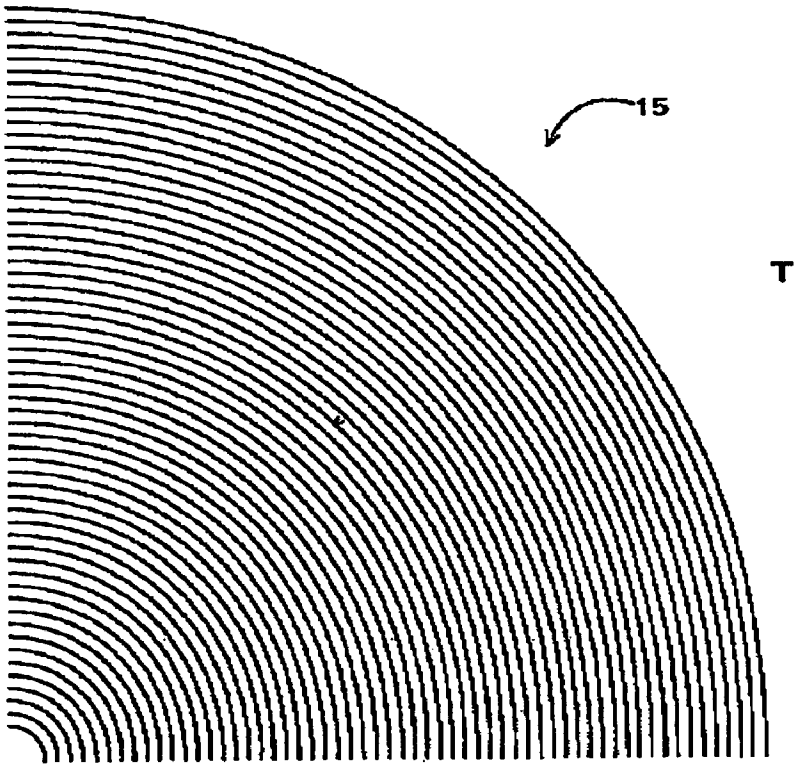

Referring next to FIGS. 27A, 27B, there is shown a polishing pad fabricated according to one preferred embodiment of the invention by way of example. The polishing pad is formed by cutting a multiplicity of generally concentric grooves into the surface of the foamed urethane pad 15 having a thickness: T1 within a range of 1.0 mm-2.0 mm. The generally concentric grooves have a width: W1 within a range of 0.005-11.0 mm, a depth: D1 within a range of 0.2-2.0 mm, and a pitch: L2 within a range of 0.2-2.0 mm. For producing the polishing pad of the present invention, initially, the single-edged cutting tool 58 or the multi-edged cutting tool 74 is fixed to the tool rest 18 (19), while a base for desired polishing pad, e.g., the foamed urethane pad 15 is placed on the suction plate 16 of the circular platen 1. Preferably, the foamed urethane pad 15 is shaped to have a circular-disk shape identical in size with the circular platen 1 in advance, by cutting. The cutting of the foamed urethane pad 15 may be executed by means of cutting device 77 fixed to the tool rest 18 (19). In the case where the foamed urethane pad 15 has a diameter smaller than the suction plate 16, an annular covering member may be placed on the outer peripheral portion of the suction plate 16 located radially outward of the foamed urethane pad 16, so that the air holes 16*a* open in the outer peripheral portion of the suction plate 16 is effectively closed by the annular covering member. The suction plate-16 may be modified so that only a portion of the suction plate 16 serving for suctioning the urethane pad 15 is provided with the air holes 16*a*. Alternatively, the communication grooves 16*b* formed in the suction plate 16 may be partially closed so that distribution of the suction force on the suction plate 16 is divided into local sections.

With the base for the foamed urethane pad 15 placed on the circular platen 1 as described above, the suction blower 25 is operated, whereby the base for the foamed urethane pad 15 is firmly fixed on the circular platen 1 by the suction force applied on the rear surface thereof. A predetermined revolution speed of the circular platen 1 about the C-axis during the grooving operation is set in advance to a suitable control device such as the NC device 102 and the sequential control device 110 so that every groove is cut at the same turning speed. The gate-shaped column 11, the saddle 8A (8B) and the tool rest 18 (19) are moved to be placed in their initial positions in the X-axis, Y-axis and Z-axis directions, respectively, under control of the suitable control device. In addition, radial positions of the respective generally concentric annular grooves are determined in the Y-axis direction depending upon the number of grooves cut into the surface of the foamed urethane pad 15 according to control program of the control device. A predetermined amount of displacement of the tool rest 18 in the Z-axis direction is set to the control device in advance so as to control an amount of depth of cut of the single edged tool 58. Thus, the cutting device is on standby. Upon starting cutting, the rotation of the circular plate 1 about the C-axis is started at the predetermined revolution speed. The cutting by tool 58 is started at the predetermined amount of depth of cut. Namely, the tool 58 executes a predetermined number of cuttings by the slight amount of depth of the cut, thereby cutting one fine annular groove into the surface of the base for the foamed urethane pad 15.

The tool rest 18 and the saddle 8A is subsequently displaced in the Y-axis direction so as to subsequently form the multiplicity of grooves. When the formed urethane pad has a relatively large area and a great number of grooves are required to be formed, the multi-edged tool 74 is preferably employed. The multi-edged tool 74 may consist of 10-30 single-edged tools juxtaposed to each other, for example. The use of the multi-edged tool 74 makes it possible to form a great number of grooves with high efficiency.

Meanwhile, the cutting of the grooves into the formed urethane pad 15 causes a problem of chips. Namely, the kind or shape of the cutting chip may vary depending upon materials of the base of the polishing pad pieces. For instance, the chips may be a powder form or a ribbon form. In particular, the cutting chip is likely to be electrically charged, and accordingly to be adhered to the urethane pad 15, the cutting tool, e.g., the single edged tool 58 or the like. This makes it difficult to assure a complete removal of the cutting chip by only executing air blowing. To cope with this problem, the grooving machine of the present embodiment is equipped with the ion blower. The ion blower is operated to discharge positive ions, which are charged enough to neutralize the chips, through the nozzle open in the vicinity of the cutting part of the tool 58, thus neutralizing the electrically charged chips by the positive ions, resulting in an desired removal of the cutting chips from the urethane pad 15 and the single-edged tool 58. Preferably, a nozzle of a suitable vacuum system is disposed in the vicinity of a cutting portion of the urethane pad so as to vacuum the cutting chips from the cutting portion, to thereby prevent undesirable disperse of the cutting chips. This arrangement is effective to execute the grooving process with high accuracy. The synchronization of the motions of the single cutting tool 58 in the Z-axis direction, the saddle 8A (8B) in the Y1 (Y2)-axis direction and the circular platen 1 about the C-axis enables to form a swirl groove on the foamed urethane pad 15. After the grooving process is terminated, the cutting device 71 may be usable to cut the circular urethane pad 15.

(j) Grid Patterned Fine Grooves

Figures 28A, 28B:
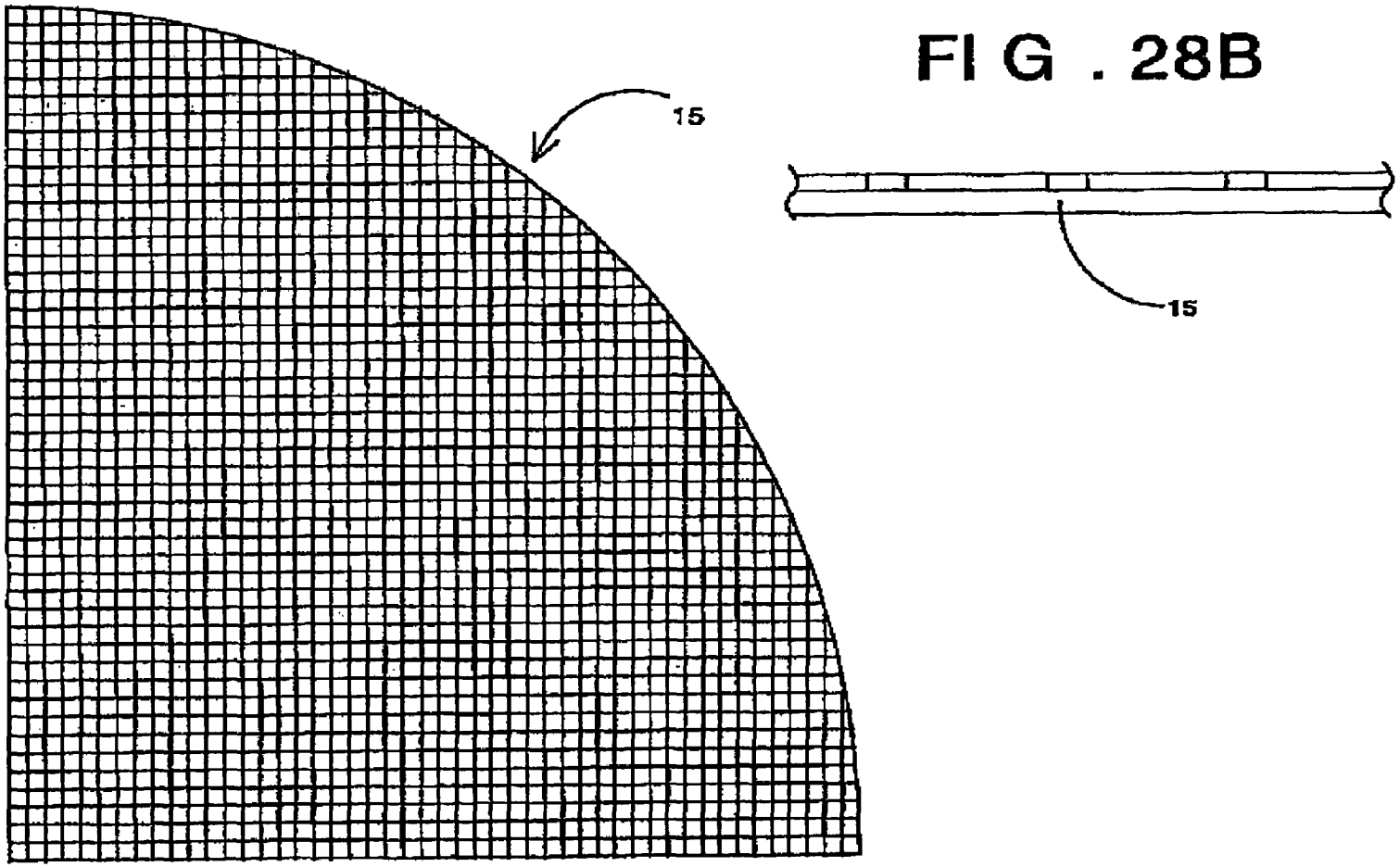

Referring next to FIG. 28, there is shown one example of a polishing pad having a plurality of grooves arranged in the grid pattern. This polishing pad is formed by cutting a multiplicity of straight grooves arranged in the grid pattern into the base for the polishing pad, e.g., the foamed urethane pad 15 having a thickness of 1.4 mm. Each of the straight grooves has a width of 0.8 mm, a depth of 0.5 mm and a pitch of 6.35 mm. For producing this grid grooved polishing pad, initially, the rotative tool unit 57 equipped with the milling cutter 81 is fixed to the tool rest 19 disposed on the saddle 8B, while the urethane pad 15 as a working piece is placed on the circular platen 1. Subsequently, the angular position of the circular platen 1 about the C-axis is detected, and then the circular platen 1 is held in its initial angular position, under control of suitable control device, e.g., the NC device 102 or the sequencer 110. For forming the grooves in the grid pattern, the circular platen 1 placed in its initial angular position is then rotated about the X-axis by 90 degrees to be held in its first processing angular position. The gate-shaped column 11, the saddle 8B and the tool rest 19 are moved to be placed in their initial positions in the X-axis, Y-axis and Z-axis directions, respectively, under control of the control device. A predetermined pitch of displacement of the gate-shaped column in the X-axis in the grid pattern is set in advance, thus eliminating a need for a surplus displacement of the tool rest 19 in the Y-axis direction.

With the circular platen 1 being held in its first processing angular position, and with the tool rest 19 held in its initial position, the process for cutting the grid-patterned grooves is initiated. The gate-shaped column 11 is subsequently moved in the X-axis direction by the predetermined pitch of displacement corresponding to the pitch of the grid-patterned grooves, each time one straight groove is formed, whereby a multiplicity of straight grooves extending parallel to each other are formed on the urethane pad 15. After a desired number of straight grooves is formed on the surface of the foamed urethane pad 15 positioned in the first processing angular position of the circular platen 1, the circular platen 1 is then rotated about the C-axis by 90 degrees so as to be placed and held in its second processing angular position. Then, a predetermined number of grooves are formed on the surface of the urethane pad 15 so as to extend parallel to each other and cross the previously formed grooves at right angles. Thus, the desired grid grooves polishing pad is obtained. Upon cutting the grooves on the foamed urethane pad 15 by using the milling cutter 81, the chips in the form of powder are produced and dispersed around the cutting part of the urethane pad 15 and are likely to be adhere to the urethane pad 15 and the milling cutter 81. Therefore, the above-described ion-blowing device 114 should be employed.

(k) Radial Grooves

The grooving machine constructed according to the present invention may form radially arranged grooves on the base for the polishing pad, e.g., the foamed urethane pad 15. Described more specifically, the circular platen 1 on which the foamed urethane pad 15 as the work piece is fixedly placed, is held in a processing angular position, and then the milling cutter 81 fixed to the tool rest 19 is moved by a predetermined amount in the Y-axis direction so as to form a single straight groove extending in a radial direction of the urethane pad 15. After the single radial groove is formed, the circular platen 1 is rotated by a predetermined angle so as to be held in a next processing angular position thereof. The grooving milling cutter 81 is moved again by the predetermined amount in the Y-axis direction so as to form another single straight grooves extending in a radial direction of the urethane pad 15. The above described reciprocating motion of the grooving milling cutter 81 in the Y-axis direction and the rotation of the circular platen 1 about the C-axis are repeated until a desired number of grooves are formed on the urethane pad 15. Thus, the polishing pad having the radial grooves is obtained. In this case, the use of the ion blower is preferable.

Figure 29:
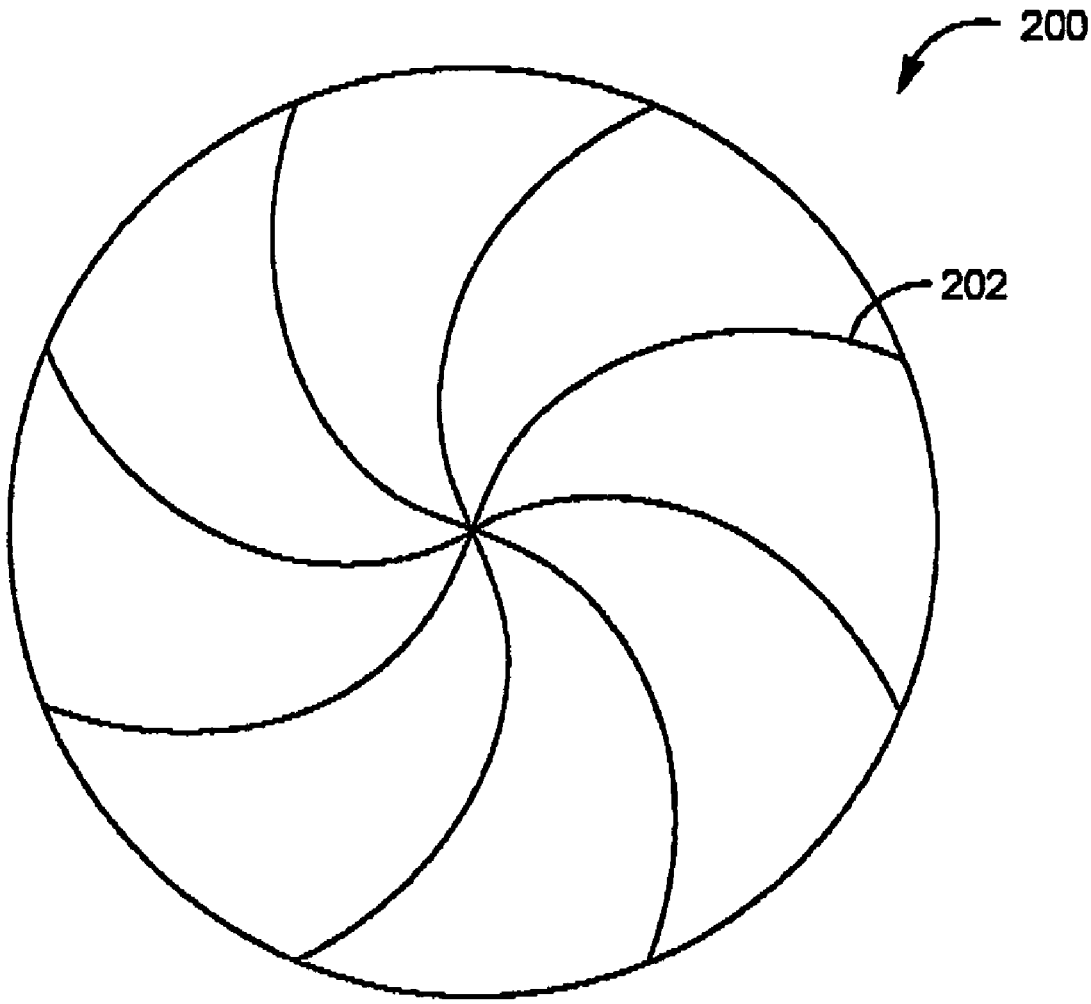
FIG. 29 is yet another example of polishing pad of foamed urethane having a plurality of grooves arranged in a radial pattern formed by milling process executed by the grooving machine of FIG. 1.

The above described radial grooves may be formed on the foamed urethane pad 15 which has a multiplicity of generally concentric annular grooves. Further the above-described radial grooves may be modified so as to form a polishing pad 200 constructed according to another embodiment of the invention, as shown in FIG. 29. The polishing pad 200 has curved radial grooves 202. To form this polishing pad, an known endmill (not shown) is fixed to the drill unit 65. The circular platen 1 is controlled to be rotated about the C-axis at a predetermined revolution speed and by a predetermined amount of angle, while being synchronized with the feed of the tool rest 19 in the Y-axis direction. Thus, the desired polishing pad 200 having curved radial grooves 202 is obtained.

(m) Drilling

The obtained polishing pads as described above, may be subjected to a drilling process as needed. The drilling process makes it possible to form a plurality of fine holes through the polishing pads. The drilling process may be performed on a working piece that is not subjected to any grooving process. In order to perform the drilling process, a special drill 82 is fixed to the drill unit 65 mounted on the tool rest 19, initially, Subsequently, the circular platen 1 is positioned about the C-axis, and the gate-shaped column 11, the saddle 8B and the tool rest 19 are respectively positioned in the X-axis, Y-axis and Z-axis directions. Then, the tool rest 19 is moved downwardly in the Z-axis direction by a predetermined amount of feed, assuring a predetermined amount of depth of cut of the drill 82. Thus, a desired hole is formed through the grooved urethane pad or the work piece.

The grooving machine may be operated under control of the suitable control device to form automatically the plurality of holes on the base for the polishing pad on the basis of coordinate values in the X, Y, and Z axes each representing a portion of the hole to be formed on the surface of the base for the polishing pad, which are stored in the memory of the control device in advance. Since the end of the drill 82 has a conical shape and has no cutting edge, the drill 81 is initially compresses the base for the polishing pad by the conical shaped edge, and then gradually cut the compressed part of the polishing pad by the cutting edge 58*a* formed in a body portion of the drill 81, whereby the drill 81 is able to be smoothly inserted into the inside of the base for the polishing pad. Thus, the drill 82 is able to form a desired hole even when the base for the polishing pad is made of a soft material, such as a foamed urethane. In the light of the fact that the working piece for forming the polishing pad has a relatively small thickness, the suction plate 16 may be formed with recesses at portions corresponding to the portions of the base for the polishing pad in which the holes is formed by drilling. The diameter of the recess is made larger than the diameter of the drill 81. This arrangement makes it possible to effectively guide the conical shaped edge of the drill 81, and to facilitate forming the through holes by drilling on the base for the polishing pad such as the foamed urethane pad. In the drilling process, the use of the ion blower is preferable for facilitating removal of the chips.

While the presently preferred embodiments of this invention has been described above by reference to the accompanying drawings, for illustrative purpose only, it is to be understood that the present invention is not limited to the details of the illustrated embodiments, but may be otherwise embodied.

For instance, single edged tool may be arrange to have a cutting part which is curved arcuately in its width direction. The opposite end portions of the curved cutting part may be protrude outward of an intermediate portions interposed between the opposite end portions in the width direction. The single edged tool may be otherwise arranged to have a tip portion being serrated, namely to have a saw-toothed cutting part. The side surfaces of the cutting part may be serrated, as needed.

While the grid patterned grooves are formed on the surface of the base for the polishing pad by using a milling cutter 81 in the grooving machine of the illustrated embodiment, the grid patterned grooves may be formed more efficiently by utilizing a single edged tool or a multi edged tool that is fixed to the tool rest 18 (19) that is reciprocally movable in the Y-axis direction at a relatively high speed, e.g., 50-180 m per minute. More specifically described, the grooving machine is modified such that the saddles 8A, 8B are reciprocally moved in the Y-axis direction by means of linear motors disposed so as to extend along the guide rails 9A, 9B, in stead of the ball-screw shafts 10, 14. The use of the linear motors enables the above-indicated high-speed reciprocal motion of the saddles 8A, 8B and the_tool rest 18, 19 in the Y-axis direction, in comparison with the ball-screw shafts 10, 14 which permits the reciprocal movement of the saddles 8A, 8B at 10 m per minute at most. Thus, the modified grooving machine, which has the linear motors as a drive power source of the saddles 8A, 8B in the Y-axis direction, is capable of cutting the grid patterned grooves into the base for the polishing pad with significantly improved efficiency. In addition, the modified grooving machine utilizes the single or multi edged tool rather than the milling cutter 81. This arrangement is effective to prevent undesirable melt of the base of the polishing pad due to heat caused by frictional contact of the milling cutter 81 with the base for the polishing pad, depending upon kinds of materials of the base for the polishing pad.

It is also to be understood that the present invention may be embodied with various other changes, modification and improvements, which may occur to those skilled in the art, without departing from the spirit and scope of the invention defined in the following claims.

EXAMPLES

To further illustrate the present invention, there will be described some examples of the invention. It is to be understood that the invention is not limited to the details of these examples, but may be embodied with various changes, modifications and improvements, which may occur to those skilled in the art, without departing from the spirit and scope of the invention defined in the appended claims.

Figure 30:
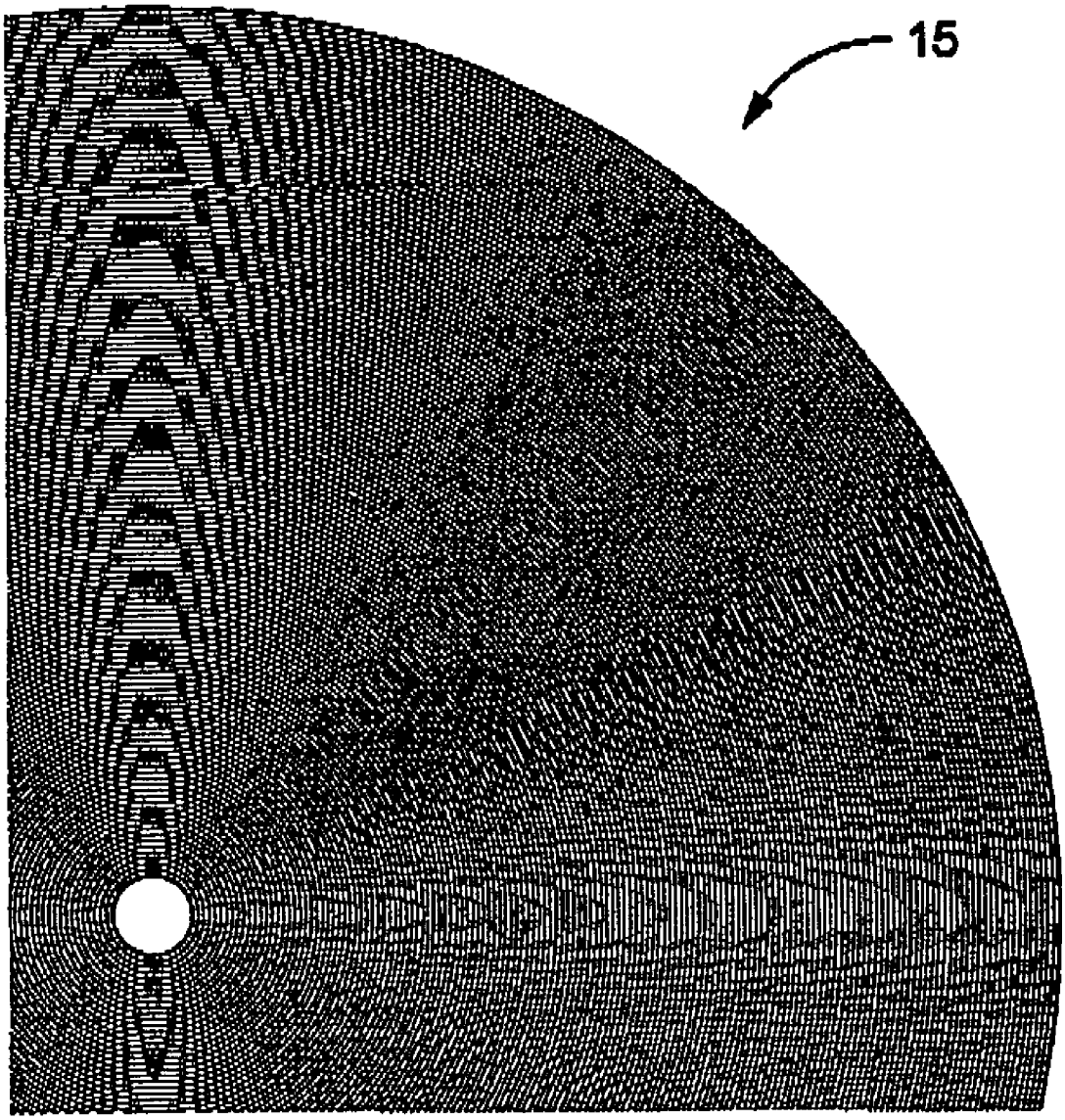
FIG. 30 is still another example of polishing pad of foamed urethane according to examples 1 and 2 by using the grooving machine of FIG. 1 equipped with the turning tool of FIG. 17.
Figure 31:
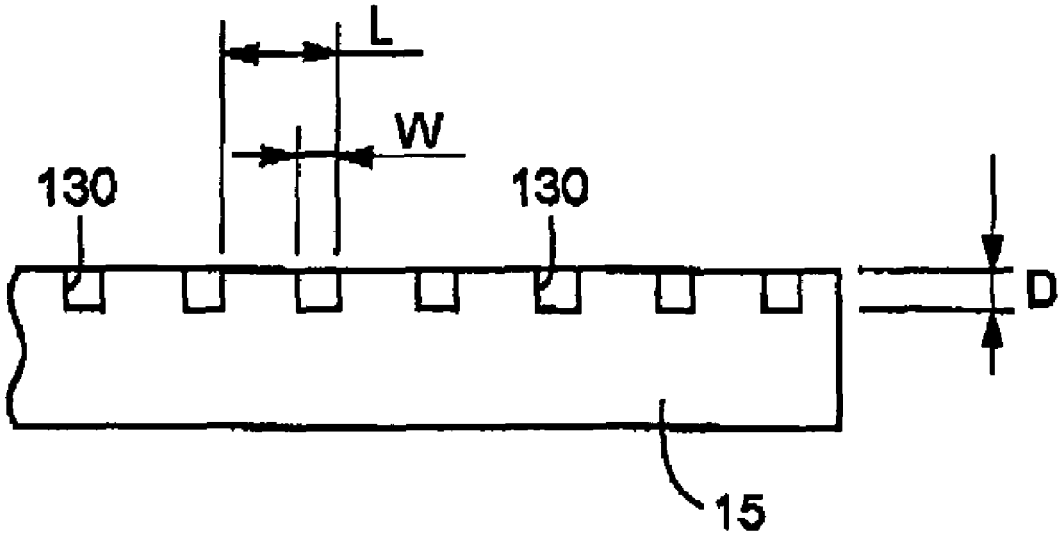
FIG. 31 is a fragmentally enlarged view in axial cross section of the polishing pad of FIG. 30.

There were prepared two specimens of the polishing pad according to Examples 1 and 2 of the present invention as shown in FIGS. 30, 31 by cutting multiplicity of generally concentric annular grooves 130 into surfaces of respective foamed urethane pads 15 by using respective multi-edged tools 74 each constructed according to the present invention as indicated in the following Table 1. Described in detail, each of the specimens of Examples 1 and 2 is formed by using the grooving machine of the present invention. The foamed urethane pad 15 attracted on the suction plate 16 of the circular platen 1 is rotated about the C-axis at a speed of 150 revolutions per minute, and the multi-edged tool 74 fixed to the tool rest 18 is cut into the foamed urethane pad 15 at a feed per revolution of 0.01 mm/rev. The prepared specimens of the polishing pad of the Examples 1 and 2 had grooves 130 whose dimension were held within a range of the invention, as indicated in Table 1.

On the other hand, specimens of the polishing pads constructed according to comparative examples 1 and 2 were prepared by using an optional multi-edged tool having a plurality of cutting parts whose shape does not meet the requirements of the present invention as indicated in Table 1. Each specimens of the polishing pad of the comparative examples 1 and 2 were formed in the same processing condition as described above with respect to the specimens of the Examples 1 and 2. Dimensions of the grooves 130 of the obtained specimens of the comparative examples 1 and 2 were also indicated in Table 1.

Figure 32A:
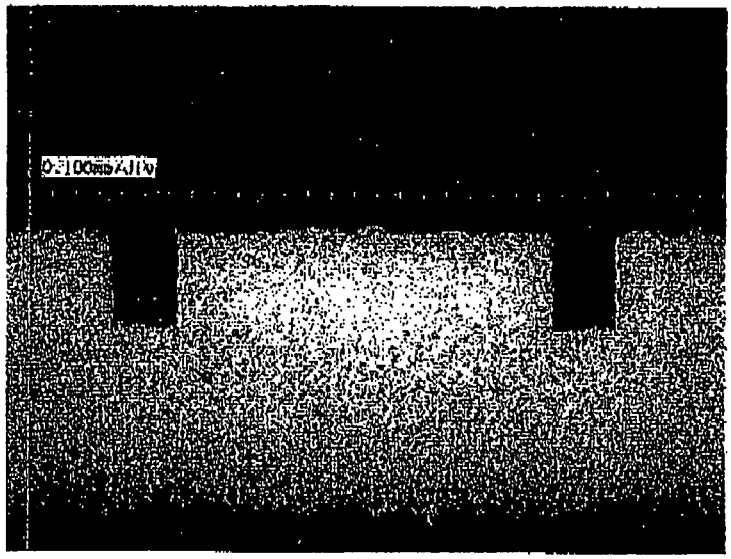
FIG. 32A is a microscopic photographic view of 30 times magnification and FIG. 32B is a microscopic photographic view of 100 times magnification, which shows a cross sectional shape of grooves of one example of a polishing pad of the present invention, which grooves are formed by using the turning tool of the present invention.
Figure 32B:
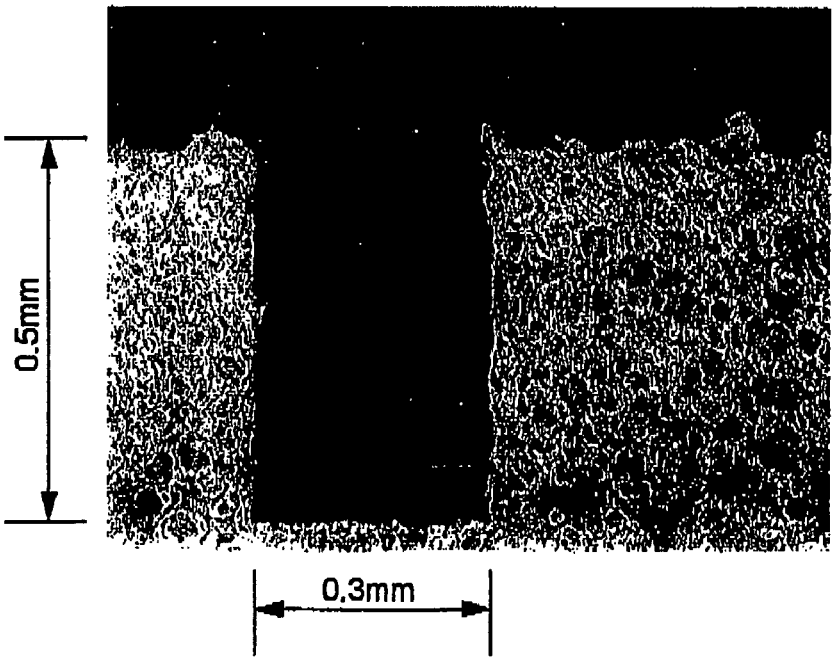
Figure 33A:
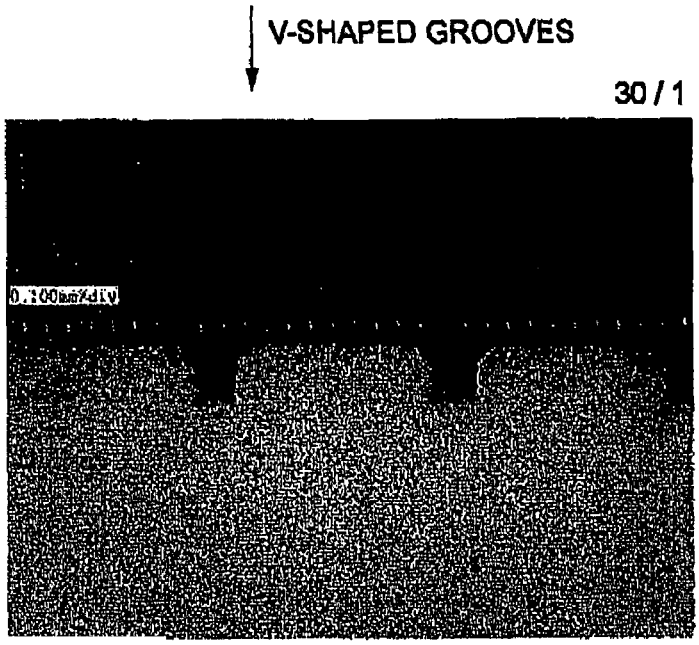
FIG. 33A is a microscopic photographic view of 30 times magnification and FIG. 33B is a microscopic photographic view of 100 times magnification, which shows a cross sectional shape of grooves of a comparative example of a polishing pad.
Figure 33B:
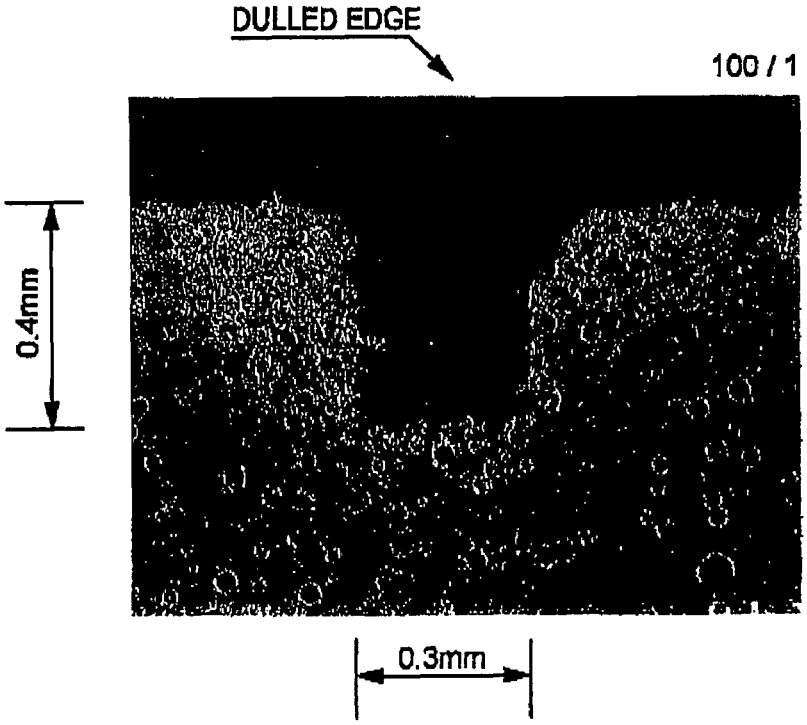
Figure 34:
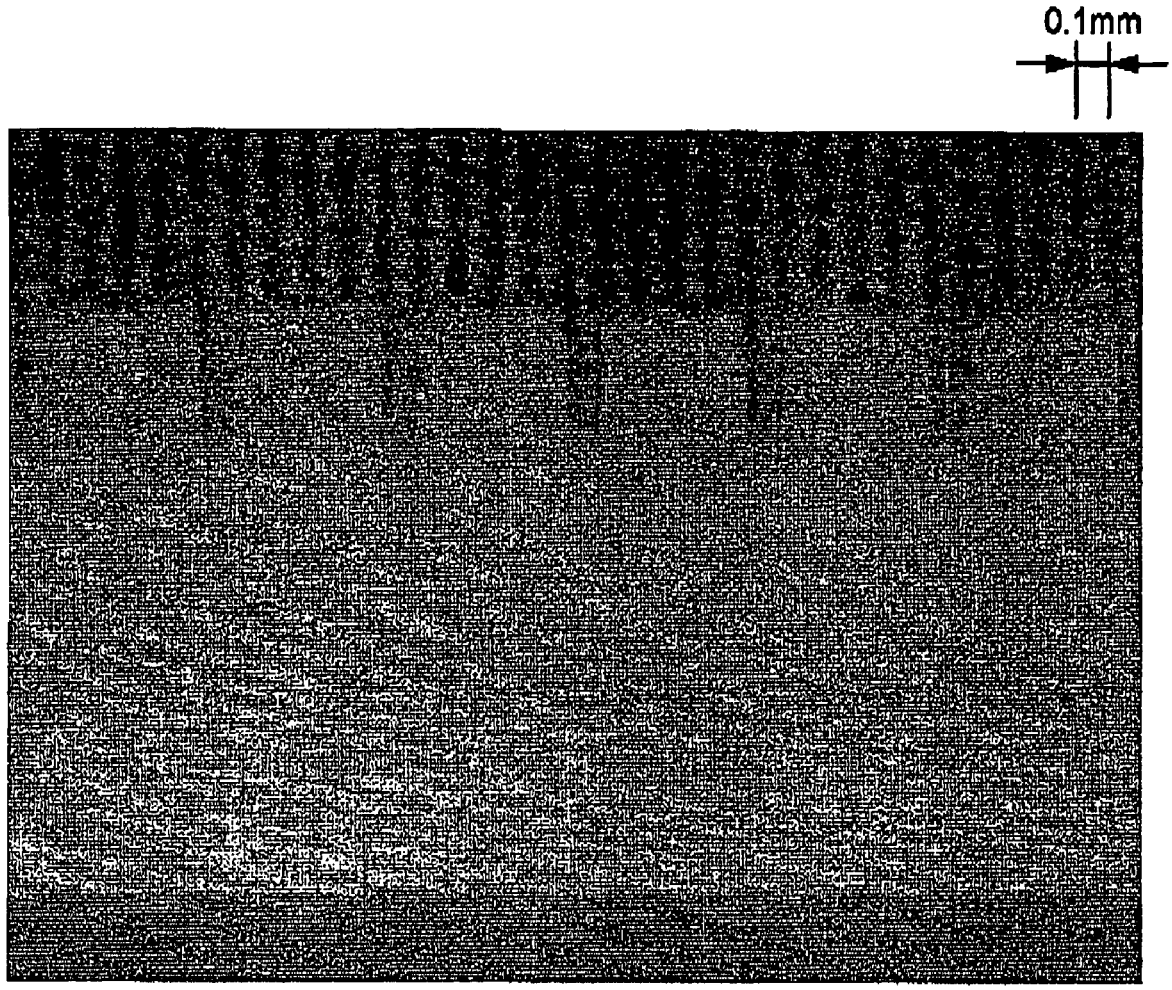
FIG. 34 is a microscopic photographic view of 120 times magnification showing a cross sectional shape of grooves of another example of a polishing pad of the invention.
Figure 35:
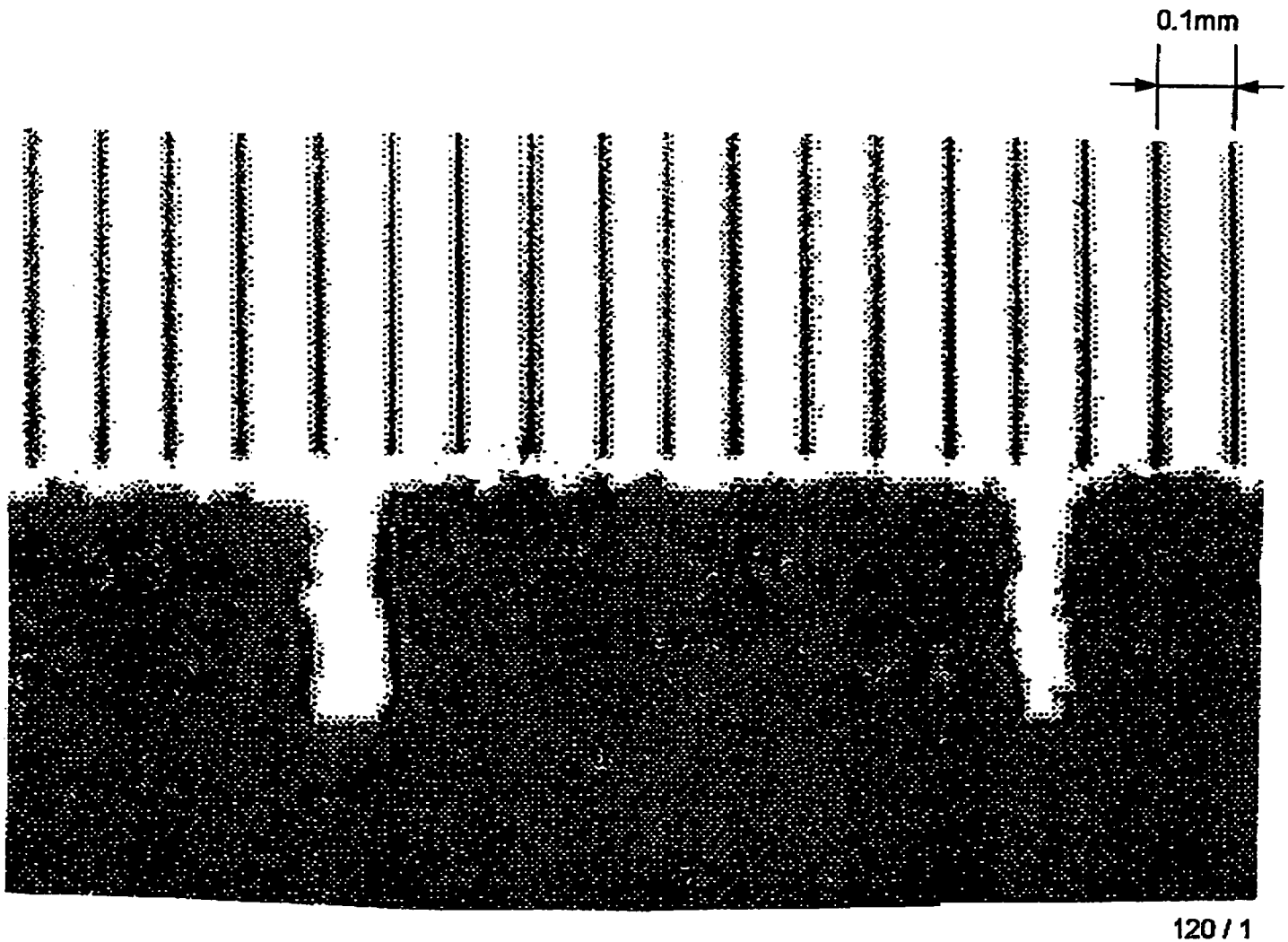
FIG. 35 is a microscopic photographic view of 120 times magnification showing a cross sectional shape of grooves of another comparative example of a polishing pad.

Microscopic photographic view of cross sections of the obtained specimens were obtained and evaluate qualities of the grooves 130 of the obtained specimens in terms of occurrence of burrs, occurrence of dulled edge of the grooves, and occurrence of raised portions on the surface of the pad. The results were also indicated in Table 1. It is noted that the evaluated grooves have radius of curvatures at around 50 mm. In this respect, FIG. 32A shows a microscopic photographic view of 30 times magnification and FIG. 32B is a microscopic photographic view of 100 times magnification in axial cross section of the groove formed on the polishing pad of the Example 1. On the other hand, FIGS. 33A, 33B correspond to the FIGS. 32A, 32B, in which the groove formed on the polishing pad of the comparative example 1 is shown in its axial cross section. FIG. 34 is a microscopic photographic view of 60 times magnification showing a cross sectional shape of a groove of the Example 2 of a polishing pad of the invention; and FIG. 35 is a microscopic photographic view of 120 times magnification showing a cross sectional shape of a groove of the comparative example 2 of a polishing pad.

TABLE 1

| | | Example 1 | Example 2 | Comparative Example 1 | Comparative Example 2 |
|---|---|---|---|---|---|
| Tool Shape | Tooth Width | 0.35 | 0.15 | 0.35 | 0.15 |
| | Wedge angle | 350 | 350 | 600 | 600 |
| | Front Clearance Angle | 45° | 45° | 20° | 20° |
| Groove Shape | Groove Width (mm) | 0.3 | 0.1 | 0.3 | 0.1 |
| | Groove Depth (mm) | 0.5 | 0.3 | 0.4 | 0.4 |
| | Groove Pitch (mm) | 2.0 | 0.5 | 1.1 | 1.0 |
| Groove Condition | Burrs | None | Almost none | Occurred | Occurred |
| | Dulled Edges | None | None | — | — |
| | Raised Portions | None | Almost none | Occurred | Occurred |
| Quality | Good/Bad | Good | Good | Bad | Bad |

Figure 36:
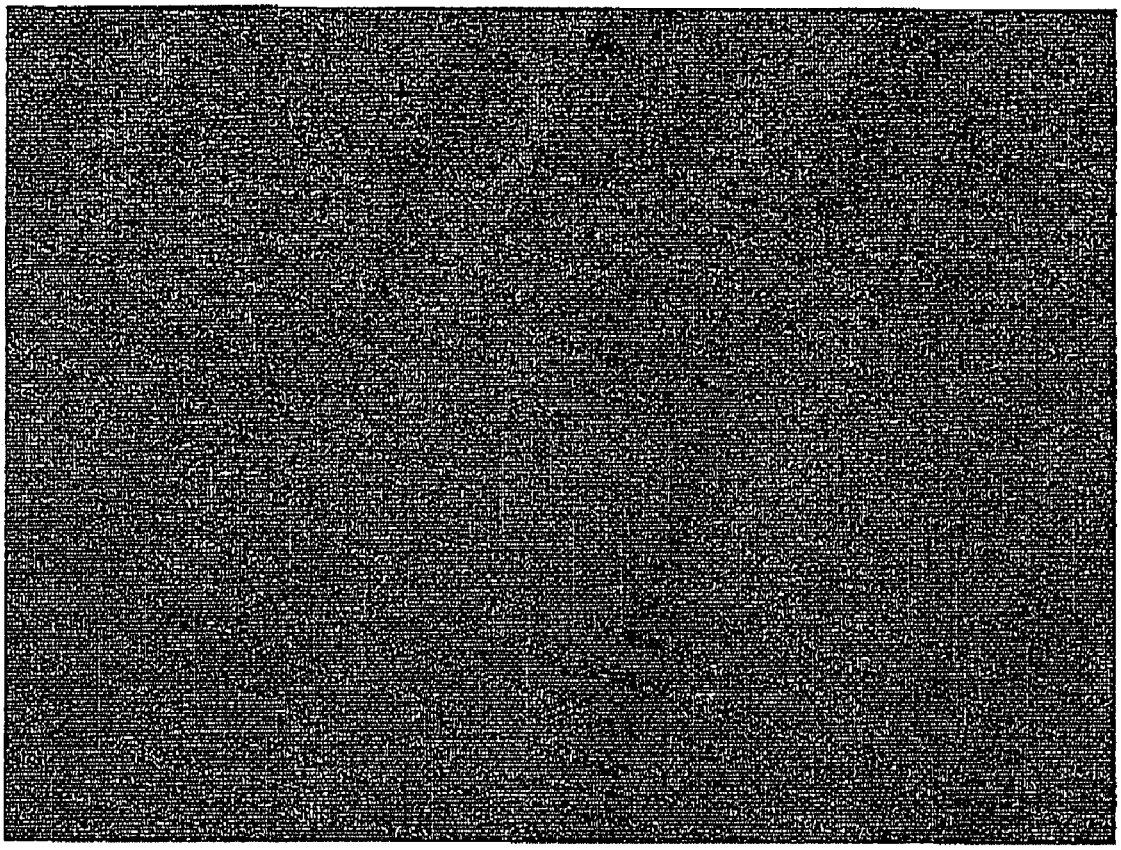
FIG. 36 is a microscopic photographic view showing grooves formed in a radially inner portion of a polishing pad of the present invention.

As is understood from Table 1, the polishing pads of the Examples 1 and 2 which were formed by using the multi edged tool 47 having cutting parts whose dimensions are held within a range of the invention, have a desired shape and never suffer from the problem of occurrence of burrs, dulled edges and raised portions. Therefore, the specimens of the polishing pads according to Examples 1 and 2 are capable of establishing a desired distribution of a slurry, and exhibiting a desired polishing effect. Further, the grooves 130 of the specimens of the polishing pads of Examples 1 and 2 were formed with high dimensional accuracy, thus eliminating or minimizing the conventionally experienced problem of variation in width of the grooves 130 after execution of the dressing process of the polishing pad. Further, the specimens of the polishing pads of Examples 1 and 2, have accurately dimensioned grooves at radially inner portions thereof as shown in FIG. 36. In FIG. 36, the grooves have radius of curvatures within at around 10 mm. Therefore, the specimens of the polishing pads of Examples 1 and 2 is able to minimize radially inner useless areas thereof.

On the other hand, the polishing pads of the comparative examples 1 and 2, which were formed by using the multi-edged tool having the cutting parts whose dimensions were not held within the range of the invention, suffer from occurrence of burrs and dulled edges. Therefore, the specimen of the polishing pad of the comparative examples 1 and 2 are incapable of exhibiting a desired polishing effect with stability, and are likely to suffer from variation in the width of the grooves after execution of the dressing process of the polishing pad.

Figure 37:
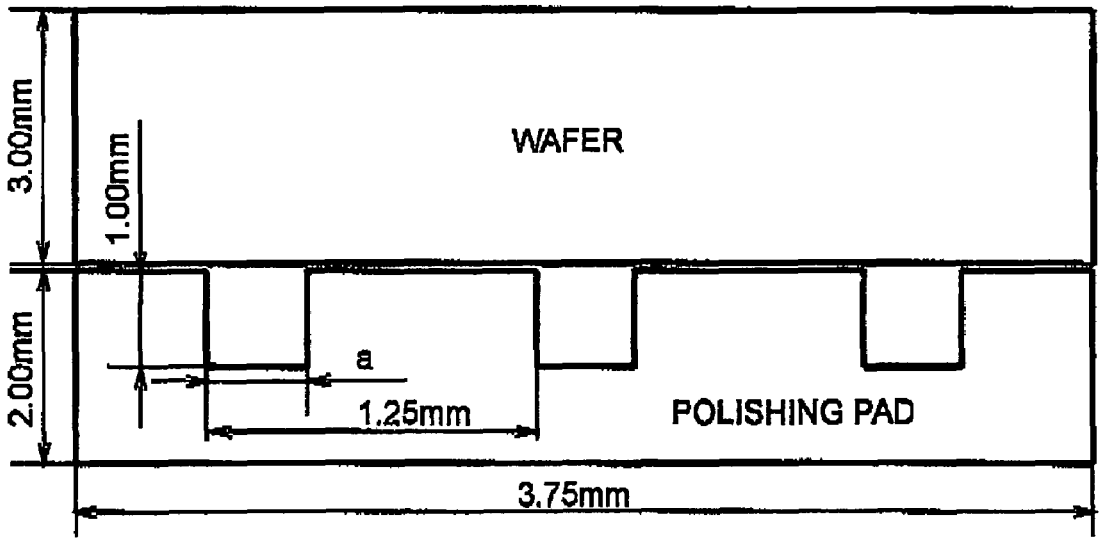
FIG. 37 is a view schematically showing a static model used in a simulation of relationship between a groove width variation and an abutting pressure variation of a polishing pad of the invention with respect to a wafer.

To further clarify technical advantages of the present invention, a relationship between variation in a groove width and a variation of an abutting pressure of a polishing pad with respect to a work, i.e., a wafer, were obtained by conducting a simulation using a static model as shown in FIG. 37. Where a groove width: "a" varies among four values: 0.2 mm, 0.2375 mm, 0.2625 mm and 0.3 mm while a groove pitch is made constant, a variation of the abutting pressure of the polishing pad applied on a surface of the wafer were calculated according to the finite element method. The obtained result as shown in graphs of FIGS. 38 and 39.

Figure 38:
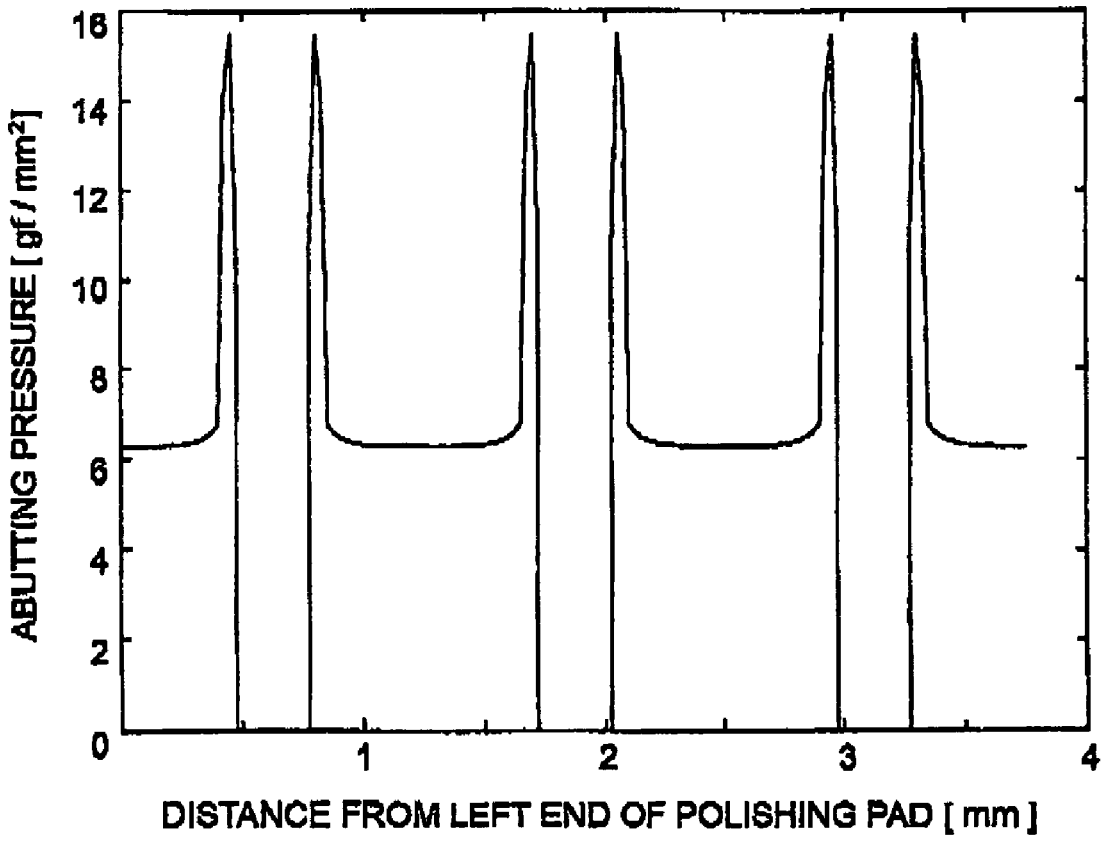
FIG. 38 is a graph showing a distribution of an abutting pressure of the polishing pad on a surface of the wafer of the static model of FIG. 37.
Figure 39:
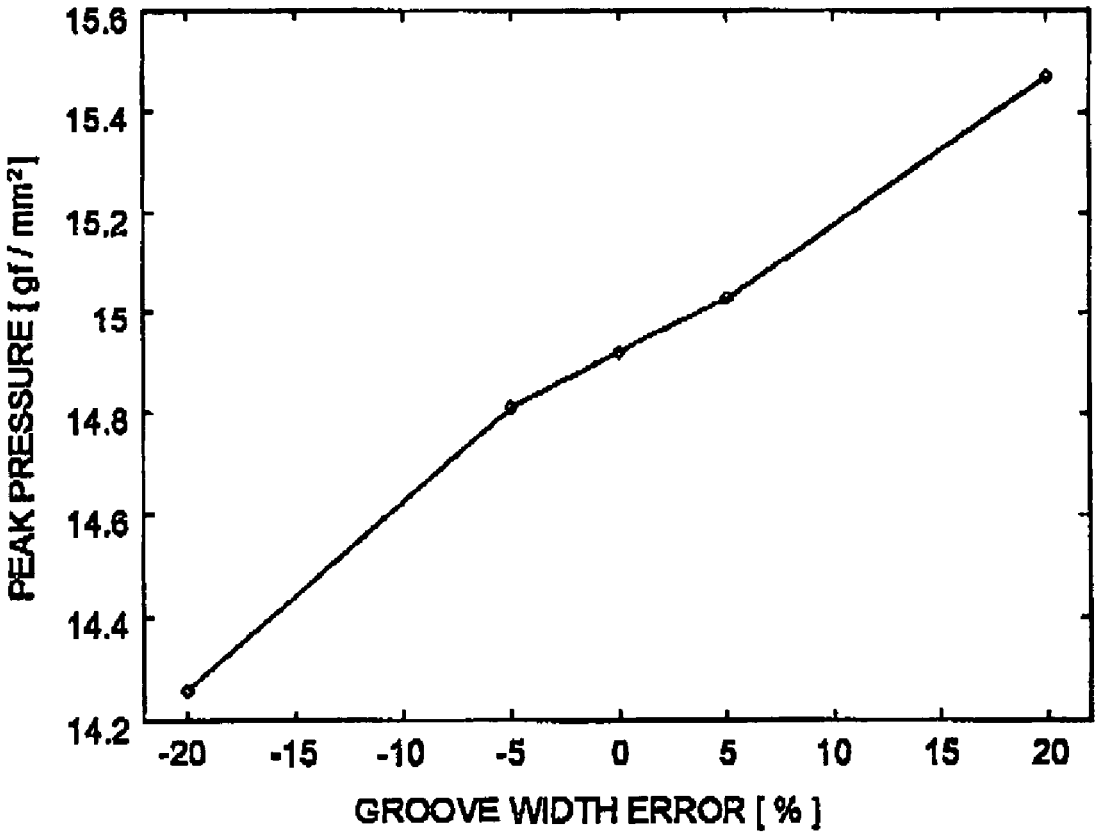
FIG. 39 is a graph showing a relationship between a peak pressure applied on the surface of the wafer and a rate of variation or error of a groove width.

As is understood from the graph of FIG. 38, the abutting pressure of the polishing pad applied on the surface of the wafer is significantly increased at open-end edge portions of each groove. Namely, a significantly high peak pressure is generated at the open-end edge portions of the each groove. As is also understood from the graph of FIG. 39, the peak pressure varies over 1.0 gf/mm$^2$ or more under the condition of a groove width variation or error of ±20%. In the case where the each groove has a relatively small width selected from a predetermined groove width range of 0.005-1.0 mm of the present invention, the groove width error of ±20% means a dimensional difference within a range of 0.002-0.40 mm. This clearly shows that a high dimensional accuracy of the grooves is significantly important to assure a desired polishing ability of the polishing pad with high stability. It should be appreciated that conventional technique for grooving the polishing pad is absolutely insufficient to form such a fine multiplicity of circumferential grooves on the base for the polishing pad with high dimensional accuracy. The aforementioned high dimensional accuracy of the grooving technique of the present invention should be appreciated as a prominence effect of the present invention, which is distinguishable from the conventional grooving techniques.

It should be appreciated that as shown in FIG. 18A, the pad groove machining cutting parts 58*a* in the present form of embodiment are arrayed linearly with a blade spacing that is twice the spacing of the grooves to be formed in the polishing pad 15. Here a polishing pad 15 wherein grooves have been fabricated at the desired spacing in the polishing pad 15 can be provided through repetitively performing cutting fabrication of grooves while moving the multi-edged tool 74 in the direction of the array of the plurality of blade edge parts 58*a*.

Figure 40A:
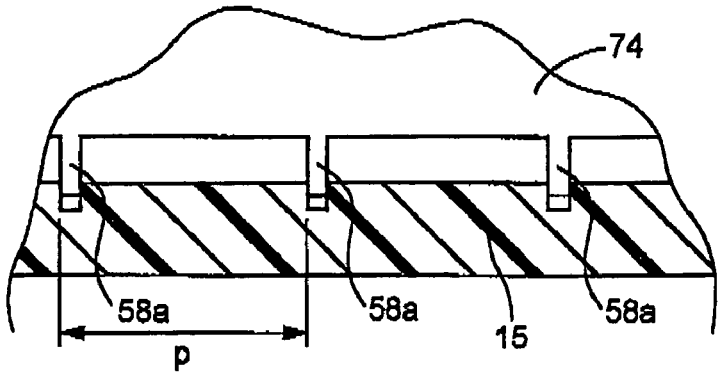
FIGS. 40A, 40B and 40C show respective steps of a method of producing the polishing pad according to the present invention.
Figure 40B:
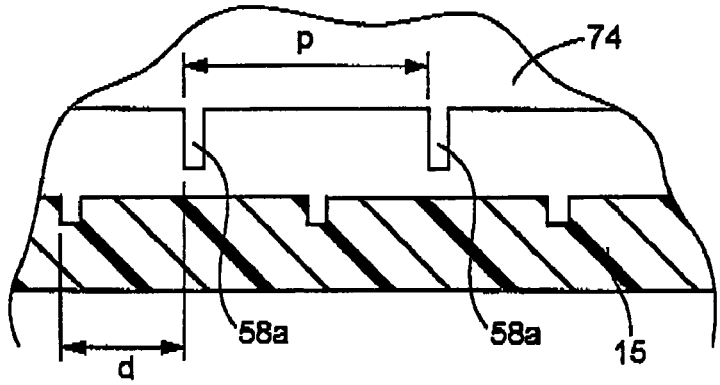
Figure 40C:
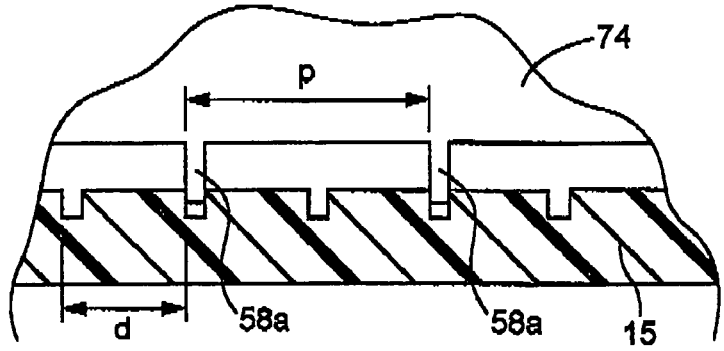

More specifically, in the multi-edged tool 74, as shown in FIG. 18A, a plurality of cutting parts 58*a* are arrayed linearly with essentially equal spacing. The spacing p in this plurality of cutting parts 58*a* is twice the desired groove spacing d of the grooves to be formed in the polishing pad 15. Furthermore, as shown in FIG. 40A, after grooves have been fabricated with the spacing p using the multi-edged tool 74 in a first process, then, as shown in FIG. 40B, the multi-edged tool 74 is moved by an amount equal to the desired groove spacing d in the direction of the array of the cutting parts 58*a* (in one direction or the other along the radial direction of the polishing pad 15) as a second process, following which, as a third process, grooves are again formed with a spacing of p as shown in FIG. 40C. At this point, the spacing p of the cutting parts 58*a* is twice the groove spacing d desired for the grooves, and thus the grooves formed in the third process with the spacing p will be positioned essentially centered between the grooves formed with the spacing of p in the first process. This causes grooves to be formed with the spacing d, which is ½ of the spacing p of the cutting parts 58*a*, enabling the fabrication of grooves with a specific groove spacing d on the front surface and/or back surface of the polishing pad 15. Note that in the present form of embodiment the desired grooves are formed on the front surface and/or the back surface of the polishing pad 15 through moving the multi-edged tool 74 towards the outer radial direction from the inner position in the radial direction of the polishing pad 15.

In the method for manufacturing described above, the use of a multi-edged tool that has a blade edge spacing p that is an integer multiple of the groove spacing d enables the fabrication of grooves with the specific groove spacing d. Consequently, when fabricating, in a polishing pad 15, grooves that have a small groove spacing d in order to achieve a required high precision polishing, it is possible to provide a large blade edge spacing in the multi-edged tool 74, making it possible to manufacture the cutting parts 58*a* of the multi-edged tool 74, which has tended to be difficult because of the spacing p being narrow, with relative ease and with high precision. Moreover, providing a relatively large spacing p for the cutting parts 58*a* of the multi-edged tool 74 enables the positions between adjacent cutting parts 58*a* in the multi-edged tool 74 to be wide, enabling the heat due to friction between the cutting parts 58*a* and the polishing pad 15 to be dispersed in this wide area, thereby making it possible to reduce or eliminate effectively the pad deformation and reduction in polishing performance caused by the effects of concentrated frictional heating. Furthermore, because the spacing p of the cutting parts 58*a* of the multi-edged tool 74 can be made relatively large, the amount of airflow between the cutting parts 58*a* can be increased, which can produce beneficial cooling of the cutting parts 58*a* through the flow of air, making it possible to effectively reduce or avoid reductions in polishing precision due to the generation of heat in the polishing pad 15. In particular, in the present form of embodiment, an "ion blow" is performed wherein air that includes negative ions (in the present embodiment the air is ionized to include positive ions and negative ions) is blown onto the cutting parts 58*a* to not only achieve more effective cooling of the cutting parts 58*a*, but to also make it possible to control the occurrence of static electricity at the cutting location, enabling the effective prevention of reductions in cutting precision due to, for example, the adherence of shavings within the grooves.

Figure 41A:
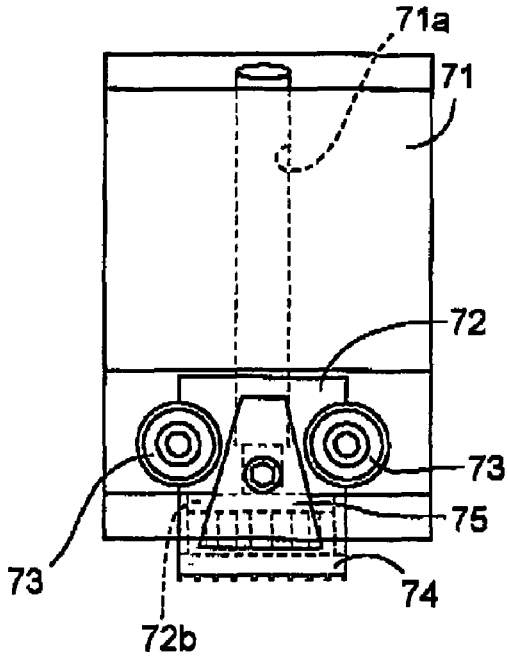
FIG. 41A, is a front elevational view of an ion blowing device used in the grooving machine of FIG. 1 for neutralizing charged components of the grooving machine.
Figure 41B:
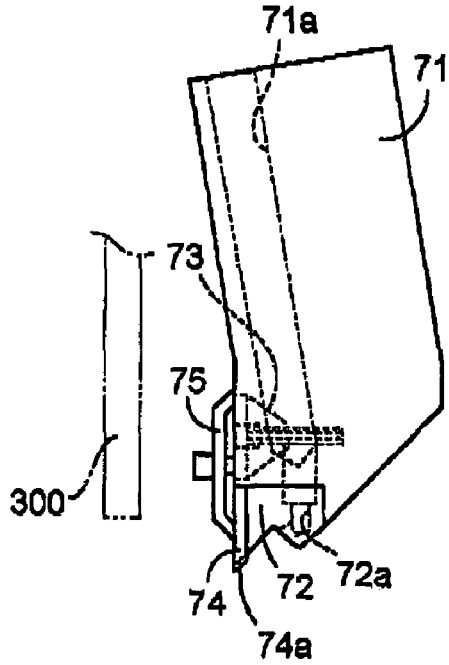
FIGS. 41B and 41C are a side and a bottom elevational view of the ion blowing device, respectively.
Figure 41C:
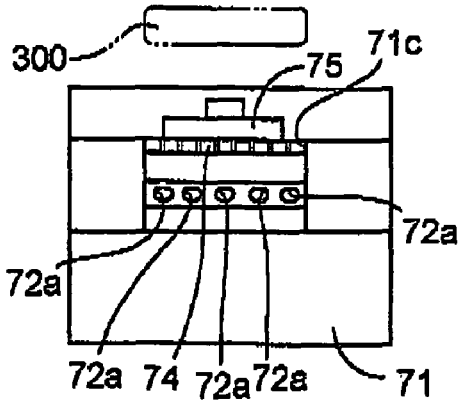

Note that this type of "ion blow," as shown in FIG. 15, may be performed by blowing from the side of the multi-edged tool 74. However, preferably the ionic air should be blown from behind the blade edges of the multi-edged tool 74, in the direction of cutting, as shown, for example, in FIGS. 41A, B, and C. That is, blowing the air stream from behind can prevent shavings from getting between the cutting parts 58*a* and melting and adhering due to frictional heating. In particular, as is shown by the double dotted lines in FIGS. 41B and C, it is preferable to position the opening of a vacuum tube negative pressure suction opening 300 in front of the blade edges of the multi-edged tool, in the direction of cutting, so that the shavings will be vacuumed away and removed from the cutting work area as quickly as possible by this negative pressure suction aperture 300.

Furthermore, it is not absolutely necessary that the fluid used for cooling the cutting parts 58*a* and the polishing pad 15 be an ionic air, but rather the fluid may be normal air that is blown by, for example, a blower. It is also not imperative to have, for example, a device that blows the cooling fluid, but rather the cutting parts 58*a* and the position of cutting in the polishing pad 15 may be cooled through the air flow that occurs naturally due to the turning.

It should be appreciated that while in the present form of embodiment the use of a multi-edged tool 74 having a spacing p for the cutting parts 58*a* that is twice the groove spacing d of the grooves was shown as an example, as shown in FIG. 18A, any spacing of the cutting parts 58*a* is acceptable insofar as it is an integer multiple of the groove spacing d, and, as shown in FIG. 18B, the spacing p of the cutting parts 58*a* may be three times the groove spacing d of the grooves, or, as shown in 18C, the spacing of the cutting parts 58*a* may be four times the groove spacing d of the grooves. Of course, the spacing p of the cutting parts 58*a* may be an integer multiple of five times or more the groove spacing d.

More specifically, the plurality of grooves may be formed more effectively in accordance with the following machining processes.

Figure 42:
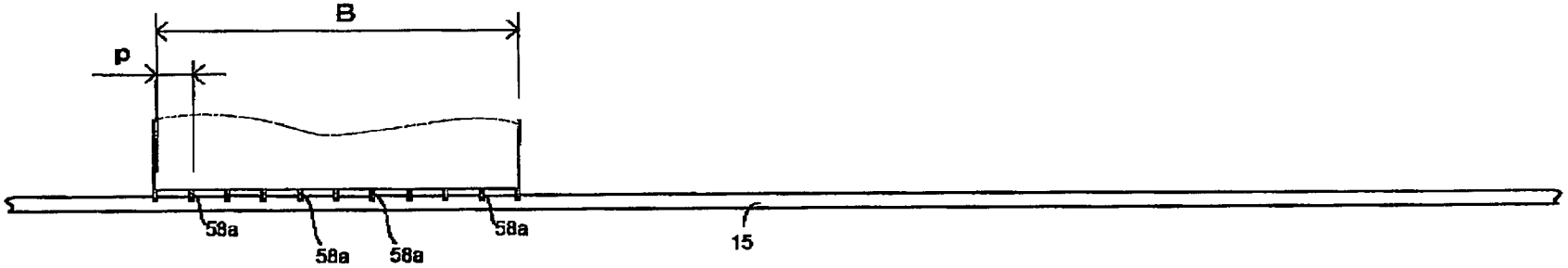
FIG. 42 shows one step of the method of producing the polishing pad according to the present invention.

Referring first to FIG. 42, the grooves are formed onto the surface of the polishing pad substrate 15, by means of the plurality of cutting parts 58*a* of the multi-edged tool 74, with the spacing p corresponding to the spacing p of the cutting parts 58*a*, by the number corresponding to that of the cutting parts 58*a* of the multi-edged tool 74.

Figure 43:
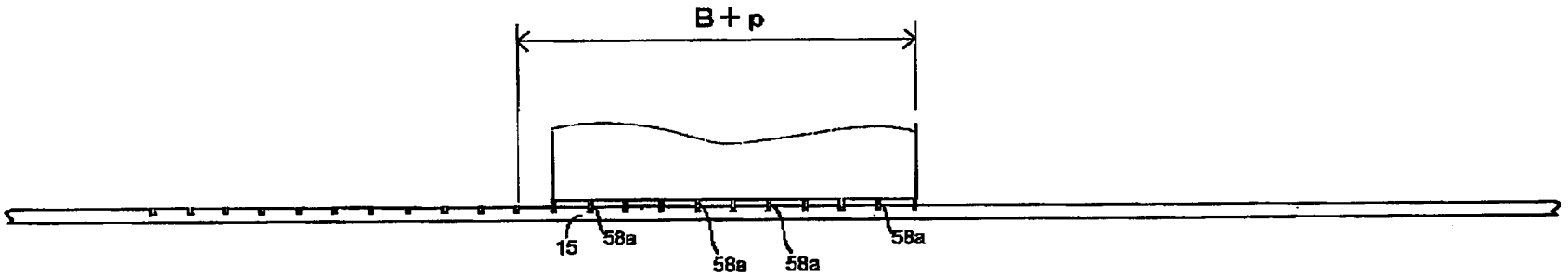
FIG. 43 shows another step of the method of producing the polishing pad according to the present invention.

Subsequently, as shown in FIG. 43, the multi-edged tool 74 is relocated with respect to the polishing pad substrate 15 in the widthwise direction thereof (i.e., in a direction along which the plurality of cutting parts 58*a* are arranged), by a distance corresponding to a sum (B+p) of a distance B between the outermost end cutting parts 58*a* of the multi-edged tool 74 and a spacing p between the adjacent cutting parts 58*a*. At this location, the groove forming process previously executed is repeated, thereby forming the plurality of grooves onto the substrate by the same number and with the same pitch.

Figure 44:
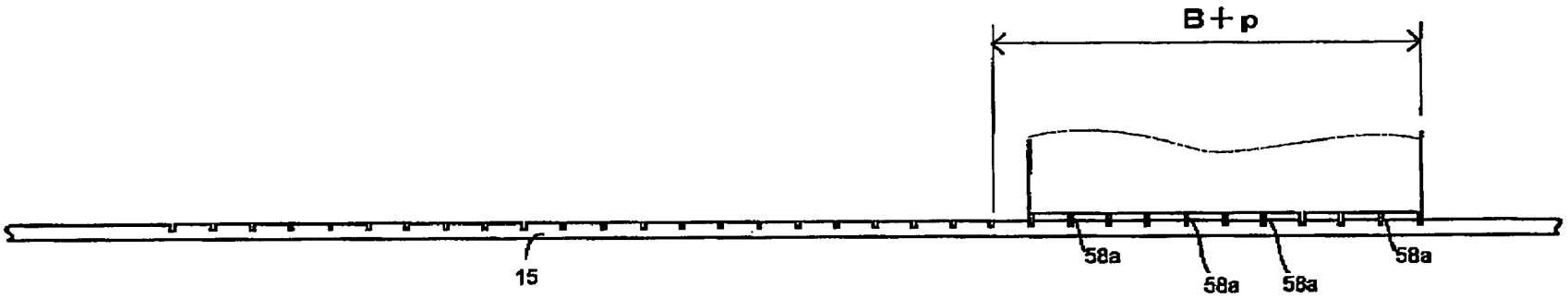
FIG. 44 shows yet another step of the method of producing the polishing pad according to the present invention.

Referring next to FIG. 44, these subsequent processes of grooving and dislocation are repeated by the suitable number of times, until a desired area of the surface of the polishing pad substrate is formed with the plurality of grooves.

Figure 45:
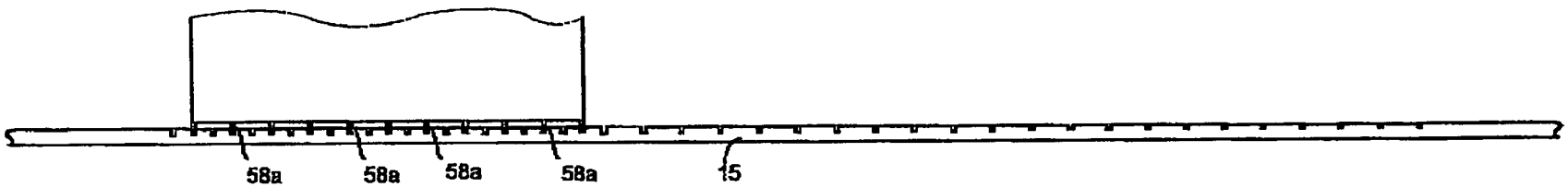
FIG. 45 shows still another step of the method of producing the polishing pad according to the present invention.

Then, as shown in FIG. 45, the multi-edged tool 74 is moved back to the initial position as shown in FIG. 42. Subsequently, the multi-edged tool 74 is shifted outward in the widthwise direction by a desired pitch of the grooves formed onto the polishing pad substrate 15 (e.g., an interval between adjacent grooves) At this location, the groove forming process previously executed is repeated, thereby forming the plurality of grooves onto the substrate by the number of cutting parts 58*a* and with the spacing p corresponding to the spacing p of the cutting parts 58*a*.

Figure 46:
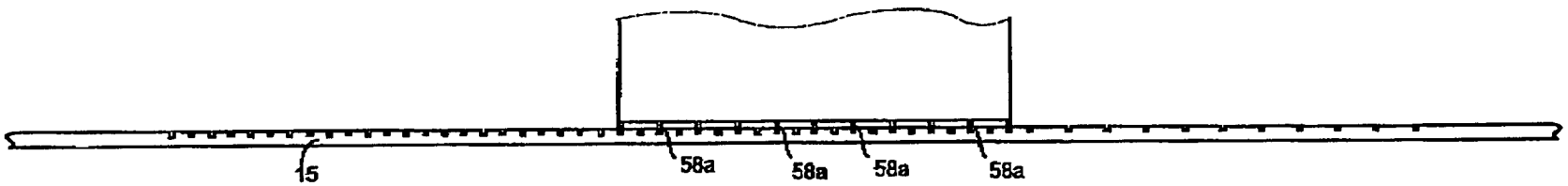
FIG. 46 shows the further step of the method of producing the polishing pad according to the present invention.

Subsequently, as shown in FIG. 46, the multi-edged tool 74 is relocated with respect to the polishing pad substrate 15 in the widthwise direction thereof (i.e., in a direction along which the plurality of cutting parts 58*a* are arranged), by the distance corresponding to the aforementioned sum (B+p), and at this location, the groove forming process previously executed is repeated, thereby forming the plurality of grooves onto the substrate by the same number and with the same pitch. These subsequent processes of grooving and dislocation are repeated by the suitable number of times, until a desired area of the surface of the polishing pad substrate is formed with the plurality of grooves.

As needed, a series of the processes discussed above is repeated until a multiplicity of grooves are formed at a desired pitch, thereby completing the processes of machining the desired multiplicity of grooves onto the polishing pad substrate 15.

The aforementioned groove forming method is able to avoid machining grooves onto the area adjacent to the grooves just formed in the last machining process. Accordingly, if the area where the grooves have just been formed undergoes experiences a temperature increase, the next grooving process to the same area can be performed after the area undergoes cooling for a given period of time, while assuring that the groove machining process can be continued with no break. This results in an improved process efficiency overall, while avoiding heating of the polishing pad substrate itself.

As disclosed in FIGS. 42-46, the desired grooves can be produced by shifting the multi-edged tool 74 by the distance corresponding to the sum of B+p, while repeating the groove machining, and then going back to the initial point, as described above. Alternatively, for example, the processes shown in FIGS. 42 and 43 are performed, and then the process shown in FIG. 45 are performed by positioning the multi-edged tool 74 at the illustrated position, before executing the process shown in FIG. 44. The specific sequence of the location of the multi-edged tool 74 can be suitably desired without limited to those in the illustrated embodiment.

For adopting the aforementioned groove processing method, a radius dimension of an area where the grooves to be formed should be twice or more the distance B between the most end cutting parts 58*a* of the multi-edged tool 74, more preferably, an integer multiple of the distance B.

Figure 47:
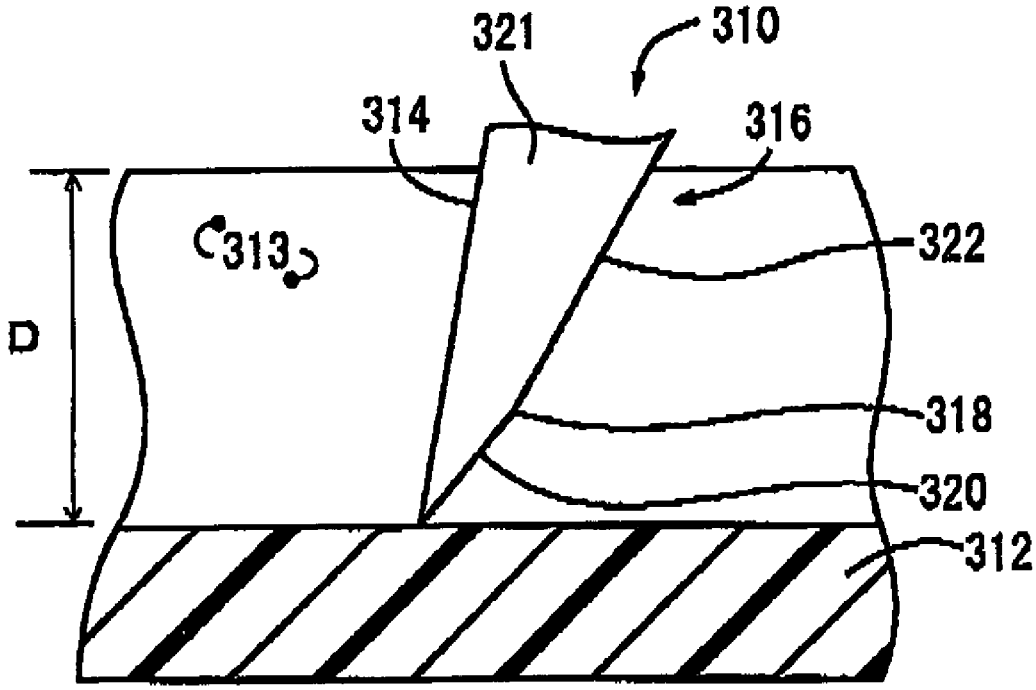
FIG. 47 is an enlarged fragmentary view showing a pad groove machining cutting tool of construction according to the invention and a polishing pad substrate.

There will be described another embodiment of the present invention. First, FIG. 47 shows the leading edge part in a cutting tool 310, as a cutting tool for machining a pad groove, and a pad substrate 310, as a pad substrate for polishing, in another embodiment according to the present invention. The cutting tool 310 forms grooves 313 by cutting the pad substrate 312 through advancing from the right side towards the left side in FIG. 47. Note that in the explanation below the forward and backwards directions for the cutting direction are, as a rule, referring to the left and right directions in FIG. 47, where in FIG. 47 the left side is the forward direction. Furthermore, in each the various appended drawings, the shapes and dimensions are exaggerated to facilitate understanding of the shapes of the cutting tool 310 and the pad substrate 312, which will be explained below.

The pad substrate 312 has a thin disk shape that has a uniform thickness dimension overall, and may be formed from an appropriate material of any of a variety of types, such as a hard foam, a solid synthetic resin, or a hard rubber material.

Figure 48A:
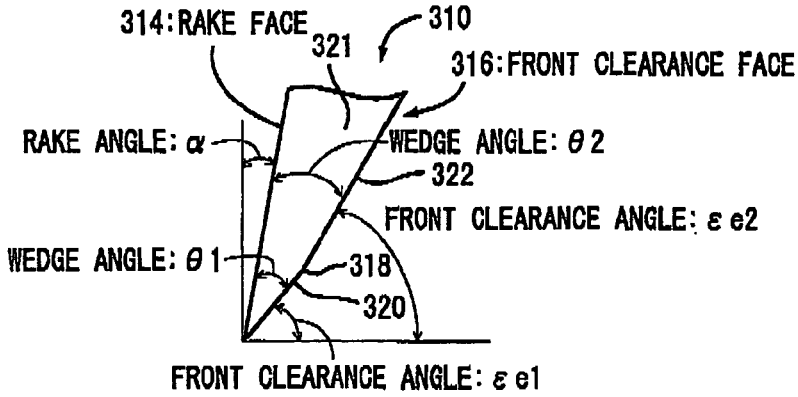
FIG. 48A is a side elevational view of the cutting tool shown in FIG. 47.
Figure 48B:
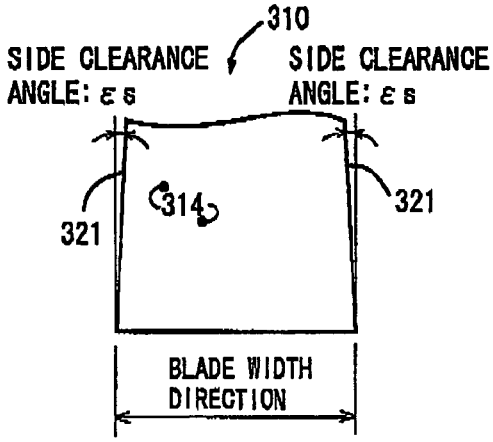
FIG. 48B is a front elevational view thereof.
Figure 48C:
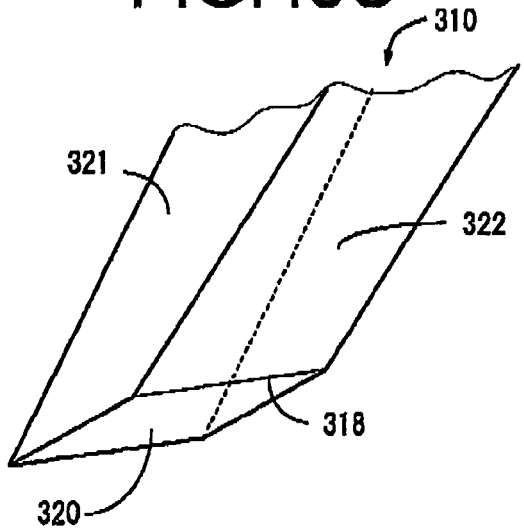
FIG. 48C is a perspective view in a diagonally backward direction.

On the other hand, in the cutting tool 310, as can be seen in FIG. 48 as well, a rake face 314, which is a front face, forms a specific cutting angle of $\alpha$ towards the back from the perpendicular direction relative to the pad substrate 312. Conversely, a curve 318 that extends facing in direction of the width of the blade of the cutting tool 310 is formed on the front clearance face 316, which is the back surface, where the region on the blade edge side of the curve 318 on the front clearance face 316 is defined as the blade edge-side front clearance face 320, and the region on the base-side of the curve 318 is defined as the base-side front clearance face 322.

Moreover, the wedge angle $\theta$1 at the blade edge-side front clearance face 320 is different from the wedge angle $\theta$2 at the base-side front clearance face 322, where the wedge angle $\theta$2 at the base-side front clearance face 322 is smaller than the wedge angle $\theta$1 at the blade edge-side front clearance face 320. The result is that the front clearance angle $\epsilon$e2 at the base-side front clearance face 322 will be larger than the front clearance angle $\epsilon$e1 at the blade edge-side front clearance face 320, so that the base-side front clearance face 322 will be the one that will have the larger rise relative to the pad substrate 312.

Here the wedge angle $\theta$1 at the blade edge-side front clearance face 320 is preferably set in a range of $25° \leqq \theta 1 \leqq 87°$, preferably $25° \leqq \theta 1 \leqq 70°$, more preferably, $30° \leqq \theta 1 \leqq 70°$. In the present form of embodiment is set to 30°. In accordance therewith, the wedge angle $\theta$2 of the base-side front clearance face 322 uses a value that is smaller than that of $\theta$1, and in the present form of embodiment, is set to 20°.

The front clearance angle $\epsilon$e1 at the blade edge-side front clearance face 320 is preferably set in a range of $3° \leqq \epsilon e1 \leqq 60°$, preferably $10° \leqq \epsilon e1 \leqq 60°$, more preferably $20° \leqq \epsilon e1 \leqq 50°$. These front clearance angles $\epsilon$e1 and $\epsilon$e2 are set by the cutting angle $\alpha$ and the wedge angle $\theta$1 and $\theta$2, and in the present form of embodiment the cutting angle $\alpha$ is set to 10°, so the clearance angle $\epsilon$e1 at the blade edge-side front clearance face 320 is set to 50°, and the front clearance angle $\epsilon$e2 at the base-side front clearance face 322 is set to 60°.

Note that the curve 318 is preferably formed at a position with a height between 0.05 mm and 1.0 mm from the blade edge of the cutting tool 310 in the direction of depth of the groove 313 in the pad substrate 312, and, more preferably, is set to be smaller than the dimension of the depth of the groove 313 that is formed in the pad substrate 312. Were the position of the curve 318 set to a position that is higher than the groove 313, the small blade edge-side front clearance face 320 of the front clearance angle would have an interference with the edge of the groove 313, which would tend to cause tooling interferences. In the present form of embodiment, in particular, the curve 318 is formed at a position with a height of 0.3 mm from the blade edge of the cutting tool 310, in consideration of the depth dimension of the groove 313, formed in the pad substrate 312, being set to 1.0 mm.

In order to reduce the tooling interferences, preferably the distance of separation, in the direction of the cutting, from the blade edge part in the front clearance face 316, or in other words, the front-back width of the cutting tool 310 in the direction of cutting, is small, and, specifically, preferably the position at a height of 2.0 mm from the blade edge in the front clearance face 316, in the direction of the depth of the groove 313, has a distance of separation of no more than 2.5 mm from the blade edge in the cutting direction, and, more preferably, this distance of separation is no more than 2.0 mm, and, even more preferably, this distance of separation is no more than 1.5 mm. In the present form of embodiment, given the cutting angle and the wedge angle as described above, the position at a height of 2.0 mm from the blade edge in the front clearance face 316 has a distance of separation of 1.23 mm from the blade edge (in the horizontal direction), and at a height of 1.0 mm, has a distance of separation of 0.66 mm from the blade edge.

Furthermore, a surface treatment is performed on the blade edge-side front clearance face 320, where the surface roughness thereof is less than that of the base-side front clearance face 322. In particular, in the present form of embodiment, a surface treatment is performed through lapping using a diamond abrasive grain with a size of no more than 10 μm so that the surface roughness will have an Ry value of no more than 3 μm, and preferably $Ry \leqq 1$ μm. Note that a variety of treatment methods can be used for the surface treatment, where, for example, polishing, buff finishing, ultrasonic treatments, etc., can be used instead of lapping, or plating can be performed on the blade edge-side front clearance face 320 to reduce the surface roughness, etc.

There will be the respective side clearance angles $\epsilon$s on both edges 321 and 321 in the direction of the width of the blade in the blade edge part of the cutting tool 310. These side clearance angles $\epsilon$s preferably are set to between 0° and 5°, more preferably 0° and 3°, and more preferably 0.1° and 1°, and in the present form of embodiment, $\epsilon s$ is set to approximately 2°.

Moreover, the blade width of the cutting tool 310 is set according to the groove width dimension to be formed in order to produce the desired polishing performance in the polishing pad, where typically, for a polishing pad for CMP (chemical mechanical polishing), this dimension should be set to between 0.1 mm and 1.0 mm, and in the present form of embodiment is set to about 0.5 mm.

Figure 49:
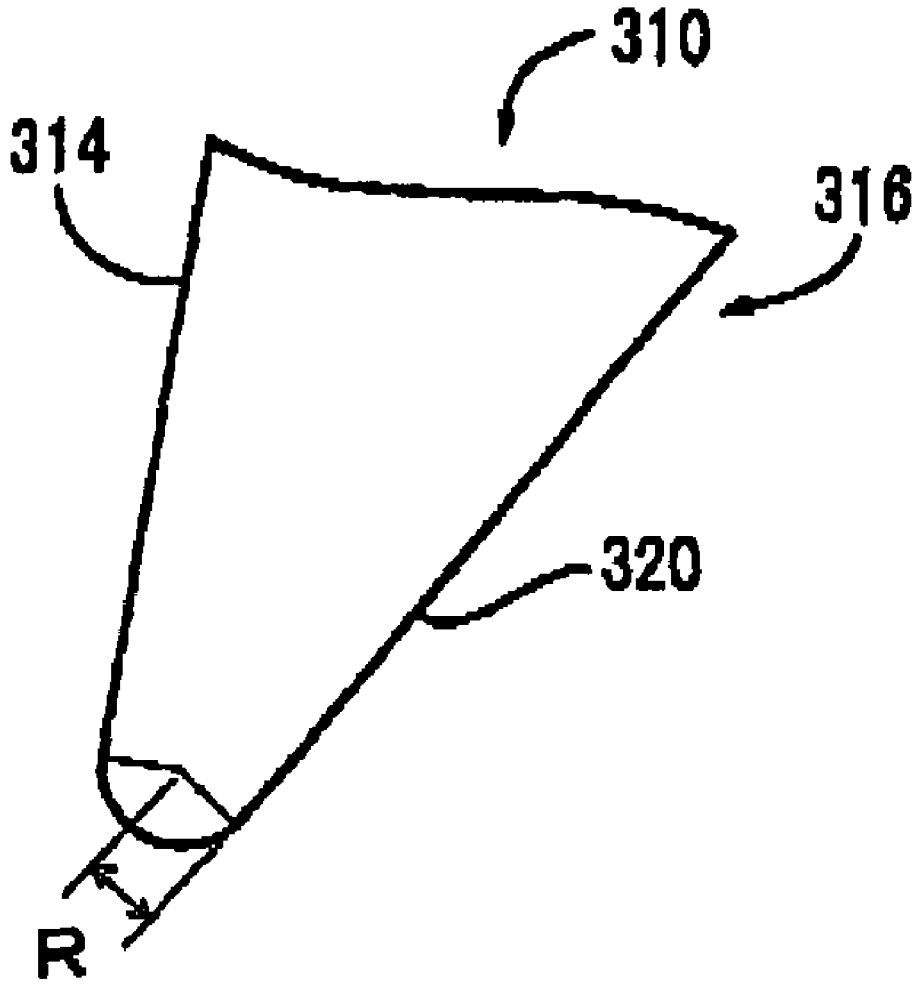
FIG. 49 is an enlarged cross sectional view of a blade edge portion of the cutting tool of FIG. 47.

As is shown in FIG. 49, the blade edge strength is increased through the formation of a curve that has a specific nose radius R at the blade edge part of the cutting tool 310. Note that, from the perspective of machining precision, it is desirable to form a sharp shape for the blade edge part of the cutting tool 310 that will cut the pad substrate 312, which is typically formed from a synthetic resin material. In consideration of both the durability and the machining precision in the cutting tool 310, it is desirable for this nose radius R to be as small as possible. Consequently, it is desirable for this nose radius R to be, specifically, no more that 0.05 mm, and, actually, the nose radius R may be 0, with the edge part of the cutting tool 310 forming a sharp angle. In particular, in the present form of embodiment, the nose radius R of the edge part of the cutting tool 310 is set to 0.01 mm. That is, in accordance with the present invention, it is possible to provide a cutting tool that has a blade edge that has this type of small R or that forms a sharp angle.

It should be appreciated that the cutting tool 310 can be made from a variety of different materials, for example, diamond, sintered diamond, sintered cBN, ceramic, ceramic metal, an ultrahard alloy, high-speed steel, or the like. In particular, the use of an ultra hard alloy or high speed-steel is preferred. In the present form of embodiment, the cutting tool 310 is made from an ultra hard alloy.

The cutting tool 310 with this type of structure can be used in a cutting device such as, for example, is explained below, to fabricate, with superior machining precision and machining efficiency, multiple parallel grooves in a pad substrate for polishing.

Figure 50:
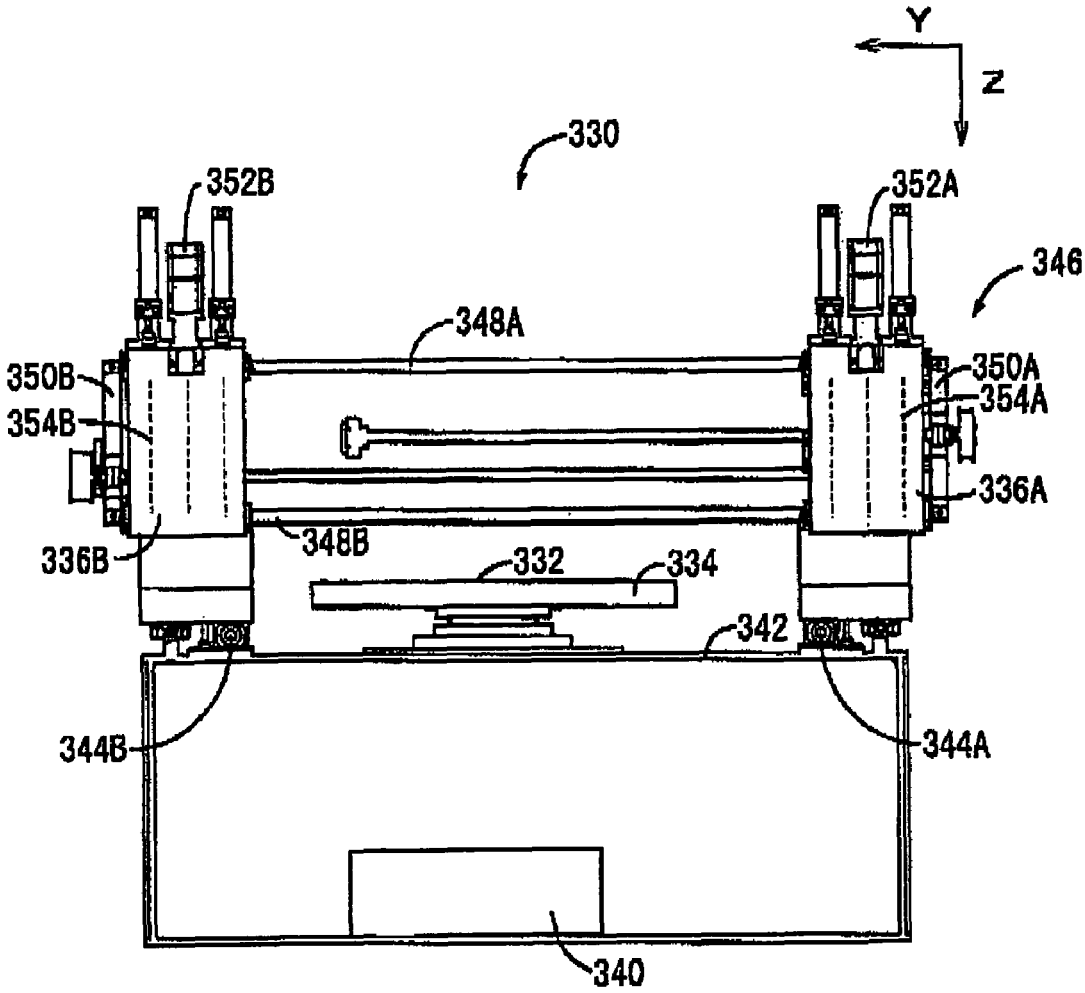
FIG. 50 is a front elevational view of a grooving machine by which executed the method of producing the polishing pad of the invention.
Figure 51:
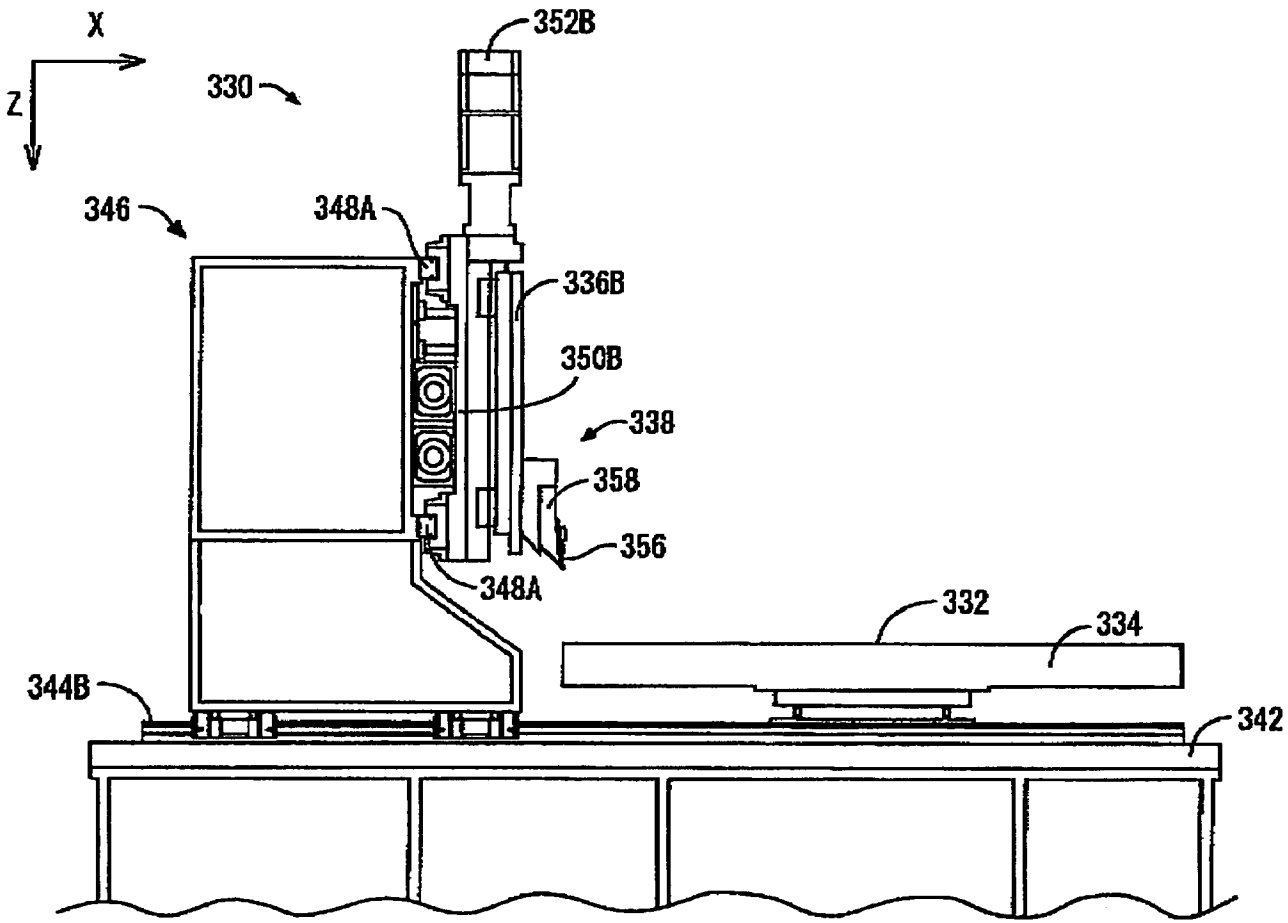
FIG. 51 is a side elevational view of the grooving machine of FIG. 50.

Specifically, the machining device 330, as shown in FIG. 50 and FIG. 51, is well suited for use. Note that the machining device 330 that is described below is described in JP-A-2002-11630, and so only a summary description will be provided herein.

The machining device 330 comprises a circular table 334 equipped with a flat support surface 332 for fixedly supporting a pad substrate 312; a pair of blade holders 336A and 336B that can move relative to the circular table 334 in the three orthogonal directions of the X axis, the Y axis, and the Z axis; cutting units 338 equipped in these blade holders 336A and 336B; driving means for driving the blade holders 336A and 336B and the circular table 334; and a control device 340 as control means for controlling the operations thereof. Note that the direction of the X axis is the left-right direction shown in FIG. 51, the direction of the Y axis is the left-right direction shown in FIG. 50, and the direction of the Z axis is the up-down direction shown in FIG. 50. Moreover, the blade holders 336A and 336B in FIG. 50 are shown in a state wherein the cutting units 338 have been removed.

The circular table 334 is not only rotationally driven around a central axis that extends in the vertical direction (the direction of the Z axis) by C axis control, but is also equipped with holding means, such as an electromagnetic break, not shown, that holds the circular table 334 releasably so as to prevent rotation. Moreover, the support surface 332 of the circular table 334 not only is able to hold the pad substrate 312 using a vacuum suction, but is also formed with an indentation, such as a clearance groove or a clearance hole, for when a cutting tool is used, at that location.

Moreover, a pair of first guides 344A and 344B are disposed so as to extend in the X-axial direction, with the circular table 334 interposed there between, on a bed 342 in the machining device 330, and a gantry-shaped column 346, which can move in the X-axial direction, is guided by these first guides 344A and 344B.

Furthermore, the gantry-shaped column 346 is equipped with a pair of saddles 350A and 350B that can be moved in the Y-axial direction by a pair of second guides 348A and 348B, which extend in the Y-axial direction, equipped on the gantry-shaped column 346.

Furthermore, each of these saddles 350A and 350B is equipped with a blade holder 336A and 336B. These blade holders 336A and 336B can be moved in the Z-axial direction by the respective motors 352A and 352B. Moreover, attachment holes 354A and 354B, for equipping tools, are provided as appropriate in the respective blade holders 336A and 336B, enabling the attachment of tools.

As described above, the blade holders 336A and 336B can move in three orthogonal directions relative to the circular table 334 through movement in the X direction due to the first guides 344A and 344B of the gantry-shaped column 346, the second guides 348A and 348B of the saddles 350A and 350B, and free movement in the Z axial direction.

Moreover, the operational control and positional control of the circular table 334 and blade holders 336A and 336B are performed by the control device 340. Note that the operational control of the various members by this control device 340 is performed, for example, through a well-known means such as the back control of a servo motor, or the like, as driving means for driving each of the operating members, using a detector signal from position sensors for detecting the positions of each member.

Moreover, cutting tools and turning tools are attached as appropriate to the blade holders 336A and 336B that are controlled positionally in the three orthogonal directions as described above. Note that while the present form of embodiment shows a form wherein a cutting tool is provided, a bore or a drill may be attached instead.

FIG. 51 shows one form wherein a cutting tool is mounted on the machining device 330. A cutting unit 338, as the cutting tool, is attached to an attachment hole 354B in the blade holder 336B shown in FIG. 51. This cutting unit 338 is equipped with a tool holder 358 to which a tool tip 356 is attached as a multi-edged tool.

Figure 52A:
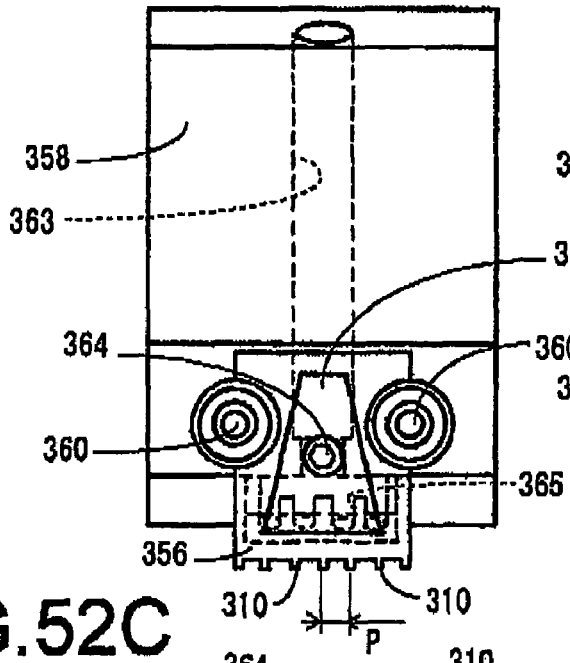
FIG. 52A, is a front elevational view of a tool holder equipped with the cutting tools according to the invention.
Figure 52B:
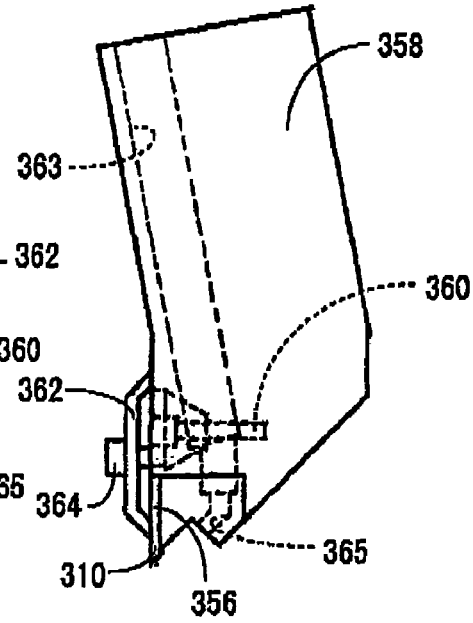
FIGS. 52B and 52C are a side and a bottom elevational view of the tool holder, respectively.
Figure 52C:
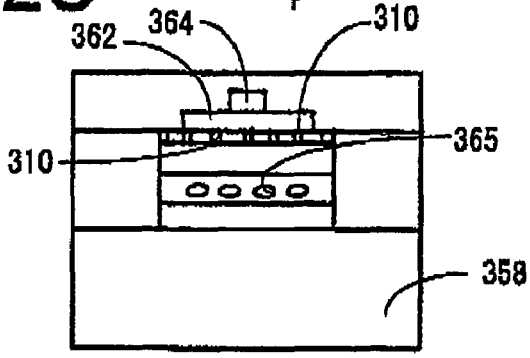

The tool tip 356, as shown in FIG. 52, is used appropriately as a multi-edged tool tip wherein cutting tools 310, structured according to the present invention, are provided, at the area around the tip, with an appropriate pitch P (which is the spacing between adjacent blades in the direction of the blade width, and, in the present form of embodiment, is approximately 3.0 mm). This type of tool tip 356 is positioned with high accuracy through positioning pins 360 and 360, for example, being firmly secured to the tool holder 358, held by a retaining plate 362, and secured to the tool holder 358 by a bolt 364. Note that in the present form of embodiment, the tool tip 356 may be formed with a plurality of blades for a single tool, but it is also possible to form a multi-edged tool in the same manner by securing, through layering in the blade-width direction with spacers interposed therebetween, as appropriate, a plurality of cutting tools, each having a single independent blade. Moreover, in the present form of embodiment, tunnel-shaped holes 363 are formed, extending in the vertical direction, within the tool tip 356, where the bottom edge parts of these holes 363 are split into a plurality of blow openings 365, after which there are openings formed in a plurality of positions behind the tool tip 356. Moreover, ions are blown from the through holes 363 through the blow openings 365 when the tool tip 356 is installed in the tool holder 358. That is, when cutting using the tool tip 356, ions are blown through blowing a stream of ionic air towards the blade edge of the tool tip 356, reducing insofar as is possible, the static electricity that is generated by the lapping. Furthermore, while not shown in the figure, in front of the tool tip 356 there is a suction opening from a vacuum tube, where shavings are vacuumed away through the suction opening, to be eliminated as quickly as possible from the cutting work area.

The use of a cutting unit 338 equipped with a tool holder 358, structured in this way, to perform a machining process by having the cutting tool 310 protrude into the pad substrate 312, which is held in place against the support surface 332 of the circular table 334 by suction, and to perform a turning process by repetitively cutting so as to trace the same cutting positions can effectively cut and form a groove 313 that has the desired shape through the performance of multiple repetitions in a discontinuous form through reciprocating motion, or the like, if the groove is a groove that is linear or that has ends, such as a spiral groove, or in a continuous form if the groove is a closed loop.

In particular, in the present form of embodiment, this type of groove 313 can be formed with improved machining precision and machining efficiency through the use of a cutting tool 310 having a particular structure.

That is, the cutting tool 310 according to the present form of embodiment not only maintains a large front clearance angle $\epsilon e2$ for the base-side front clearance face 322 at the blade part, but also side clearance angles are formed so that, when forming a groove 313 with a small diameter dimension positioned in the center part of a pad substrate 312, tool interference can be avoided effectively, and disruption of the edge shape of the groove 313 can be avoided or reduced.

Moreover, given the present form of embodiment, the wedge angle $\theta 1$ at the blade edge-side front clearance face 320 is greater than the wedge angle $\theta 2$ at the base-side front clearance face 322, so that in the cutting tool 310, the blade edge part can be fabricated with an appropriate thickness. Consequently, the strength of the blade edge part can be increased, enabling an increase in the useful life of the cutting tool 310. Moreover, increasing the strength of the blade edge part makes it possible to form the front edge part of the cutting tool 310 with a sharper shape, making it possible to perform the machining with greater precision.

In addition, in the present form of embodiment the adherence of shavings to the machining surface when performing the cutting process can be reduced through reducing the surface roughness of the blade edge-side front clearance face 320. Doing so reduces the roughness of the machining surface, which is caused by the presence of the shavings, thereby enabling greater machining precision. Furthermore, because the amount of heat that is produced in the blade edge part of the cutting tool 310 that is thought to be caused by frictional heating is suppressed, not only is it possible to increase the speed of machining, but it is also possible to suppress changes in quality due to heating within the groove 313. In addition, suppressing the generation of heat can further improve the useful life of the cutting tool 310. In particular, in investigations by the present inventors, improvements in the machining precision of the bottom parts of grooves were found to be the result of not just reductions in the heating alone. That is, when machining pad substrates made from synthetic resin materials there is a tendency for there to be plastic deformation, where the pad substrate expands in the direction behind the blade when the cutting tool is pressed downwards, which is thought to increase the likelihood of contact with the front clearance face of the blade edge of the cutting tool. Because the size of this contact surface is relatively large when compared to the case when machining metal, there is also the tendency to have the aforementioned problem with generating heat, while, in addition, because the electrical conductivity of the pad substrate is low, there is a tendency for the shavings to be electrostatically charged, and thus a tendency for the effects of the static electricity to cause the shavings to adhere to the inside surfaces of the grooves being machined in the pad substrate. Because the cutting by the cutting tool is performed by repetitively cutting a large number of cycles, with a slight depth each, in order to form a groove of the desired depth, shavings that adhere to the inner walls of the groove get caught between the pad substrate and the cutting tool during the repeated cutting cycles, which is thought to cause roughness in the cut surfaces. In the present form of embodiment, the cutting tool front clearance face has low friction at the blade edge part, which is most likely to come into contact with the polishing pad, and the occurrence of static electricity is suppressed, thereby enabling even greater groove machining precision. Note that in order to prevent more effectively the adhesion of shavings onto the pad substrate due to static electricity, preferably devices should be used such as, for example, blowing ions onto the cutting positions, or vacuuming shavings away from the cutting positions.

Figure 53:
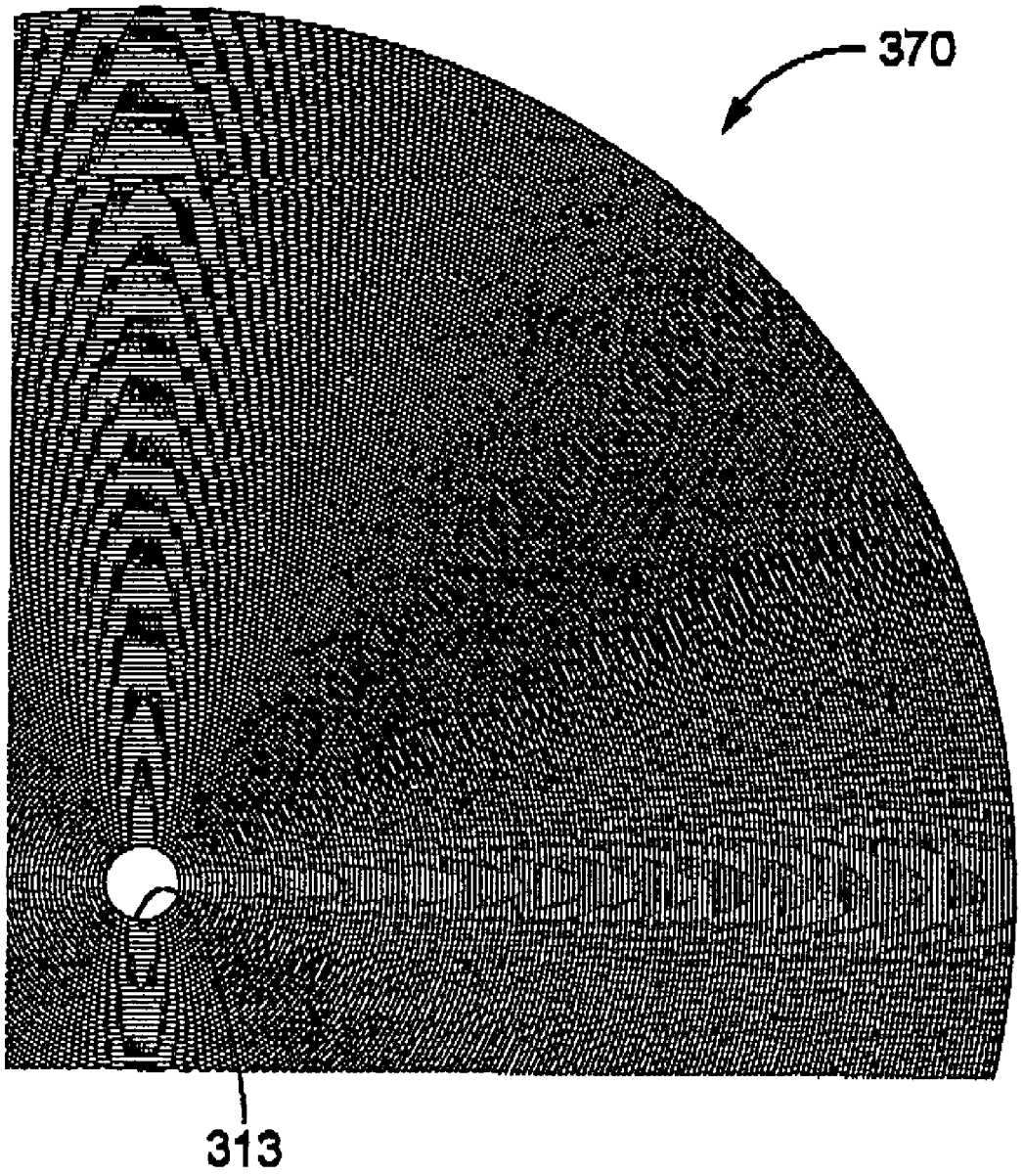
FIG. 53 is a part plane view of a grooved polishing pad formed according to the method of the present invention.
Figure 54:
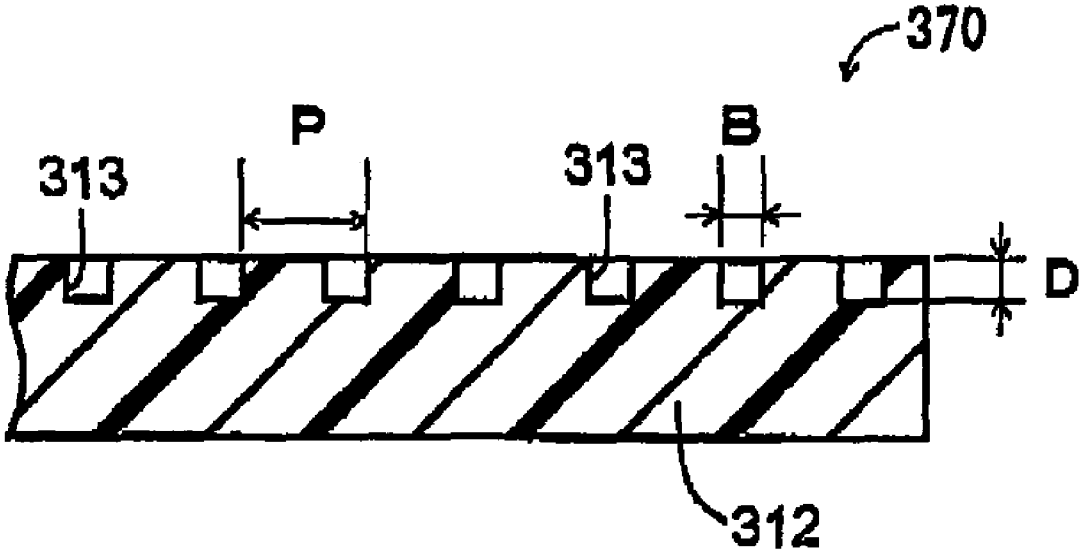
FIG. 54 is a fragmental enlarged cross sectional view of the grooved pad of FIG. 53.

Next FIG. 53 and FIG. 54 show a polishing pad 370 as one example of a polishing pad manufactured according to a manufacturing process as described above. FIG. 53 is a partial plan view of the polishing pad 370, and FIG. 54 is an expanded view of the key part of the polishing pad 370. The grooves 313 in the polishing pad 370 are a large number of ring-shaped grooves that extend in concentric circular shapes around the central axis of the polishing pad 370, formed with, for example, a groove width of B=0.5 mm, a grove depth of D=1.0 mm and a groove pitch of P=1.5 mm. This type of polishing pad 370 is fabricated through mounting a pad substrate 312 onto a circular table 334 of the aforementioned machining device 330, and rotating the circular table 334 and inserting, a plurality of times, the cutting tool 310, manufactured as described above, with continuous tracks. Note that as described above, the tool tip 356 has a gap between cutting tools 310 of P=3.0 mm, and thus when performing a turning process for the grooves 313, the cutting unit 338, or in other words, the tool tip 356 is moved by 1.5 mm each time in the radial direction of the pad substrate 312 to form the ring-shaped grooves with a groove pitch P=1.5 mm.

Given this, the diameter D of the ring-shaped groove 313 at the position that is nearest the center of the polishing pad 370 in the present form of embodiment is 20 mm. Because of this, a wide area of the surface of the polishing pad 370 can be used effectively as the polishing surface. Moreover, because the ring-shaped grooves 313 are provided even in the center part of the pad, where the polishing fluid is less likely to accumulate, these grooves can be anticipated to hold the polishing fluid effectively. Note that, as described above, the use of the cutting tool 310 with a structure according to the present invention reduces interferences with the inner surfaces of the side walls of the ring-shaped grooves 313 by the cutting tool 310 and enables turning fabrication and machining with ease for even ring-shaped grooves with a diameter of less than 60 mm, while appropriately adjusting the front clearance angle and the wedge angle to enable excellent turning fabrication of ring-shaped grooves at D<20 mm and even D≦10 mm.

Furthermore, by using the cutting tool 310, with the particular structure as described above, to fabricate the ring-shaped groove 313 that is located closest to the center, the groove can be fabricated with superior machining precision, even for a ring-shaped groove of such a small radial dimension. This makes it possible to obtain better polishing fluid flow operations for the polishing pad 370.

Note that the structure of the cutting tool 310 in the present form of embodiment is preferred for use as the cutting part 58*a* of the multi-edged tool 74 used in the method for manufacturing a grooved polishing pad shown in the first form of embodiment described above. The use of a cutting tool 310 structured in this way, as the cutting part 58*a* not only has the effect, for example, of enabling high precision fabrication of grooves with the narrow groove spacing shown in the first form of embodiment, but is also able to suppress the production of heat and static electricity due to friction, shown in the second form of embodiment, and able to exhibit the benefit of other effects such as being able to achieve high precision cutting fabrication of grooves.

EXAMPLES

Next, a comparative investigation will be performed regarding the amount of tool interference when fabricating ring-shaped grooves using cutting fabrication for a cutting tool with a conventional structure vs. a cutting tool with the structure according to the present invention. Note that for the sake of brevity, the comparative investigation will focus on the distance of separation from the blade edge part in the direction of cutting at the front clearance face, or in other words, will focus on the front-back width of the cutting tool in the direction of cutting, rather than considering the blade width.

Figure 55A:
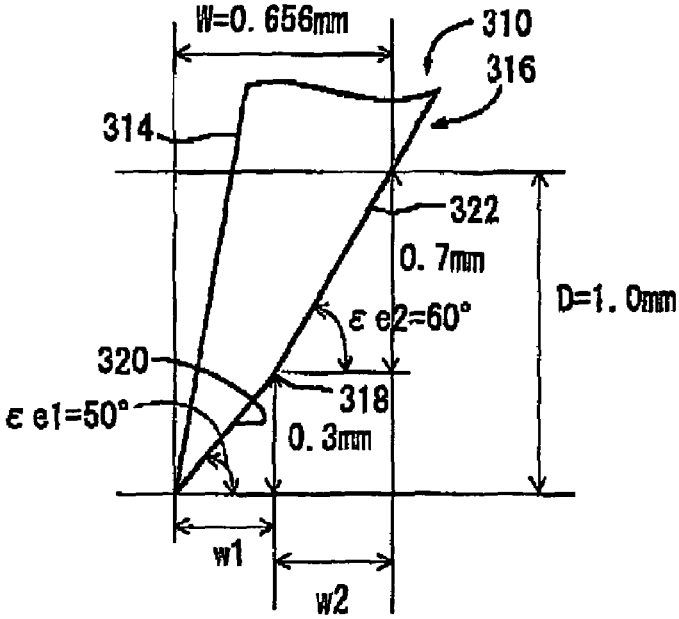
FIGS. 55A and 55B are explanatory views for obtaining an amount of interference of the pad groove machining cutting tool of the invention, where

First, FIG. 55A shows the various set values for the aforementioned front clearance angle, etc., in the cutting tool structured according to the present invention. That which is the subject is the cutting tool 310 in the form as described above, where the blade edge front clearance face 320 has a front clearance angle $\epsilon$e1=50°, and the base-side front clearance face 322 has a front clearance angle of $\epsilon$e2=60°. Note that the height dimension of the curve 318 in the direction of depth is 0.3 mm.

Note that the ring-shaped grooves 313 fabricated through cutting using this cutting tool 310 have a height dimension of D=1.0 mm, and a curvature radius dimension, when the pad substrate is viewed from the top, of r=10 mm.

Here the distance of separation W of the front clearance face 316 (which, in the present form of embodiment, is the base-side front clearance face 322) from the blade edge at the top edge face of the groove 313, or in other words, the front-back width, in the direction of cutting of the cutting tool 310, at the top edge face of the groove 313 is the sum of the front-back width w1 from the blade edge to the curve 318 and the front-back width w2 from the curve 318 to the position on the top edge face of the groove 313 of the base-side front clearance face 322.

[Equation ]

$$w1=0.3/\tan 50°$$

$$w2=(1-0.3)/\tan 60°$$

$$W=w1+w2=0.656 \qquad \text{[Equation 1]}$$

Figure 55B:
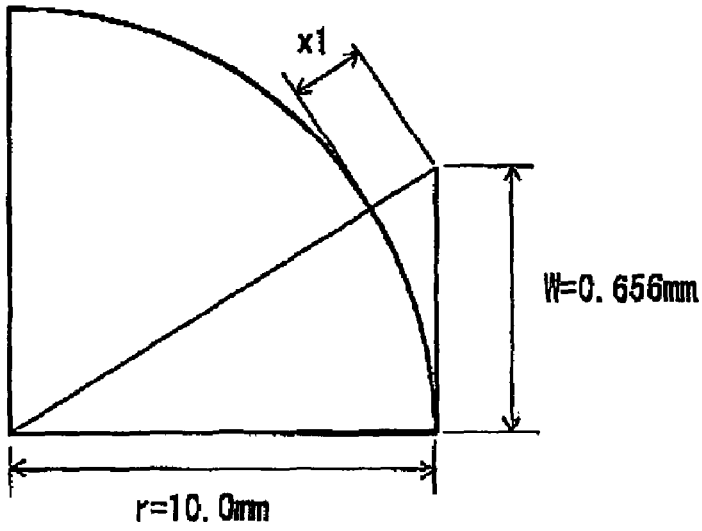

Consequently, the front-back width, at the top edge surface of the groove 313, of the cutting tool 310 is set to W=0.656. Here, as shown in FIG. 55B, the amount of interference x1 with the side wall faces of the groove 313 with the cutting tool 310 when forming a groove 313 with the radius dimension r, as described above, is calculated using the following equation:

$$x1 = \sqrt{w^2 + 10^2} - 10 \qquad \text{[Equation 2]}$$
$$= 0.021$$

Accordingly, using the cutting tool 310 according to the present invention causes the amount of interference x1 with the inner wall surface, when forming the ring-shaped groove 313, as described above, through cutting, to be 0.021 mm. On the other hand, when the same calculation is performed for a cutting tool according to the conventional structure, which is formed with a constant wedge angle of θ=20°, without having the curve 318, the amount of interference x2=0.017. As is clear from these calculations, the structure according to the present invention has many effects, as described above, through maintaining the cutting angle θ1 of the blade edge part even while keeping the effect on the tool interference low.

Next, Table 1 shows the results of comparisons of groove machining precision, durability, etc., after having performed repetitive groove machining on identical synthetic resin chemical mechanical polishing pad substrates for three test samples (all made from the same materials) those comprising a cutting tool of the comparative example that has a blade edge shape according to a conventional structure, formed having a constant wedge angle, without having the curve. A cutting tool of an example A that has a two-stage structure, with the curve, for the front clearance face, according to the present invention where no surface treatment has been performed on the front clearance face on the blade edge side of the curve; and a cutting tool of example B according to the present invention where, on the front clearance face in example A, a surface treatment has been performed on the region from the curve to the blade edge to reduce the surface roughness of this region.

Note that in the tests of the groove machining, a high speed multi-edged tool with a blade pitch of 3.0 mm with 11 blades, as described above, and shown in FIG. 52, was used to form through cutting ring-shaped concentric grooves with a grove width of 0.5 mm, a groove pitch of 1.5 mm, and a groove depth of 1.0 mm, in a foam urethane pad with a diameter of 750 mm, using the machining conditions of a turning pad speed of rotation of between 200 and 400 rpm. Note that in the cutting tool of the comparative example, the wedge angle θ=20°, and in examples A and B, θ1=30° and θ2=20°.

TABLE 1

| Test piece | Shape of Blade Edge | Roughness of side walls and bottom surface of groove | Life expectancy due to wear of blade edge | Blade edge defect rate prior to reaching end of useful life |
|---|---|---|---|---|
| Comparative example | Conventional: Constant wedge angle | Good for only the first several pads processed | Number of pads processed: 40 | 5% |
| Example A | 2-stage wedge angle (no lapping) | Relatively good state observed continuously | Number of pads processed: 80 | 2% |
| Example B | 2-stage wedge angle lapping finish | Extremely good state observed continuously | Number of pads processed: 110 | 0% |

*Notes
The present invention was confirmed to be able to use an ultrahard alloy, which has been difficult to use conventionally.
While the use of an ultrahard alloy slightly increases the defect rate, when compared to the use of high-speed steel in similar experiments, in the structure according to example B it was confirmed that the defect rate, up to the end of the useful life, can be held to 2%.
Incidentally, when an ultrahard alloy is used, the defect rate, up to the end of useful life, was 5% in the structure according to the example A, described above, and manufacturing was extremely difficult using the structure according to the conventional example, described above.

Firstly, when the machining precision of the groove is observed, no major difference can be seen in terms of the machining precision of the side walls of the groove, but when it comes to the machining precision of the bottom surface of the groove, better machining precision could be obtained using the cutting tool structured according to the present invention than in the conventional example. This confirms the ability to increase the machining precision of the groove through the effect of providing a 2-stage cutting angle in the front clearance phase, and, preferably, the effects of providing a surface treatment in the region of the blade edge part.

Moreover, observing the durability of the cutting tool, durability was clearly better for example A than for the comparative example, and better still for the example B. Moreover, when it comes to defects in the blade edge part, in the comparative example not only did the occurrence of defects occur in an early stage, but the quantity of the defects was large, where an improvement was seen in example B, and even in example A the onset of the defects was delayed, and the quantity of defects was low. That is, it was possible to verify the effect of both the fabrication of the large wedge angle in the blade edge part of the cutting tool, and of the performance of the surface treatment on the blade edge side region of the front clearance face as both increasing the durability, and in the cutting tool structured according to the present invention (in particular, in the example B), these two effects appeared synergistically, so as to be able to produce superior durability.

While the present invention has been described in detail in its presently preferred embodiment, for illustrative purpose only, it is to be understood that the invention is by no means limited to the details of the illustrated embodiment, but may be otherwise embodied.

The specific values in, for example, the forms of embodiment described above, such as the values for the wedge angles $\theta 1$ and $\theta 2$ and for the front clearance angles $\epsilon e1$ and $\epsilon e2$, are no more than examples of suitable set values, and, of course, there are no limitations whatsoever to the set values such as described above. Note that when the blade edge part wedge angle $\theta 1$ is made larger, the front-back width in the cutting direction of the cutting tool is increased, and the amount of tool interference is increased, and thus when $\theta 1$ is made larger it is desirable to reduce the height position of the curve accordingly. Specifically, if, for example, $\theta 1 \leqq 60°$, then the height of the curve from the blade edge should be no more than 0.8 mm.

Furthermore, in the method for manufacturing a polishing pad with grooves as described above, a groove machining method was presented as an illustration wherein a single tool tip 56 was used as a multi-edged tool; however, the groove machining may be performed through providing a plurality of these tool tips 56 lined up in parallel. This type of situation enables the groove machining to be performed more efficiently.

Furthermore, in the forms of embodiment described above, an example was given of a method for manufacturing a polishing pad with a plurality of ring-shaped grooves, extending in concentric circular shapes, through the use of a multi-edged tool structured according to the present invention, presented as an example of a manufacturing method for a grooved polishing pad; however, this method for performing machining using a multi-edged tool is not limited in any way. For example, instead of machining grooves through a cutting process or a turning process wherein the polishing pad substrate is rotated, as described above, and the cutting tool is inserted into the surface thereof, the cutting tool structured according to the present invention may instead be applied to groove machining wherein a cutting process is performed through moving the cutting tool linearly or along an appropriate curve on the surface of an abrasive pad substrate while holding the abrasive pad substrate in a stationary position, or to groove machining wherein the cutting effect is produced through moving both the pad substrate and the cutting tool simultaneously. Given these groove machining processes, grooved polishing pads with multiple grid-like grooves can be manufactured with excellent machining precision and machining efficiency.

The application of the grooved polishing pad substrate manufactured according to the method for manufacturing according to the present invention is also not a limitation. For example, although the present invention is applied to polishing of silicon wafers and polishing of semiconductor wafers, and in particular is used in CMP (chemical-mechanical polishing), the present invention may also be applied to resin pads for other types of polishing instead. Furthermore, the groove machining of the polishing pads can be performed on either surface of the pad, the front or the back. Also, the polishing pad to which the present invention is applied is not limited in its material or its application, and, for example, as a polishing pad for CMP, a pad substrate made from a conventionally known synthetic resin material, a pad substrate with a multilayer structure, a pad substrate made from a hardened resin, a pad substrate made from a composite material wherein water-soluble particles are dispersed into a water insoluble matrix of cross-linked polymers, etc., can be used.

It is also to be understood that the present invention may be embodied with various other changes, modifications and improvements, which may occur to those skilled in the art, without departing from the spirit and scope of the invention defined in the following claims.

What is claimed is:

1. A method of manufacturing a grooved polishing pad wherein a number of grooves, extending parallel to each other, are fabricated at specific intervals on at least one of a front surface and a back surface of a polishing pad substrate through a groove cutting process on the polishing pad substrate, which is made from a synthetic resin material, the method comprising the steps of:

cutting, by using a multi-edged tool having a plurality of pad groove machining cutting parts, arrayed at equal spacing p with the spacing p being an integer multiple no less than 2 of a desired spacing d of the grooves, a plurality of the grooves; and repeating the cutting of the plurality of grooves through shifting the multi-edged tool in a direction in which the pad groove machining cutting parts are arrayed, in order to fabricate the number of grooves, extending parallel to each other, with the desired spacing d.

2. A method of manufacturing a grooved polishing pad according to claim 1, wherein the cutting of the plurality of grooves is performed by using the multi-edged tool, and wherein the spacing p of the plurality of cutting pats for fabricating the grooves, which are arrayed in the multi-edged tool, is twice the spacing d of the grooves to be cut into the polishing pad substrate.

3. A method of manufacturing a grooved polishing pad according to claim 1, wherein the plurality of grooves formed on the polishing pad substrate are circumferential grooves extending in a direction of a circumference of the polishing pad substrate.

4. A method of manufacturing a grooved polishing pad according to claim 1, wherein the cutting of the plurality of grooves is performed by using the multi-edged tool, wherein the spacing p for the plurality of pad groove machining cutting parts, which are arrayed in the multi-edged tool, are such that 0.5 mm $\leqq p \leqq 30$ mm, and wherein at least one of the cutting parts is a two-stage cutting part having two wedge angles leading to a cutting edge of the respective cutting part.

5. A method of manufacturing a grooved polishing pad according to claim 1, wherein the plurality of grooves are formed on the polishing pad substrate while blowing a cooling fluid onto the pad groove machining cutting parts.

6. A method of manufacturing a grooved polishing pad according to claim 5, wherein the cooling fluid comprises an ionic air.

7. A method of manufacturing a grooved polishing pad according to claim 1, wherein the cutting of the plurality of grooves is performed by using the multi-edged tool, and wherein each of the pad groove machining cutting parts includes a curve at a position between 0.05 mm and 1.0 mm high from a blade edge on a front clearance face thereof, and has a wedge angle $\theta 1$, on a blade edge side of the curve, in the range of $25° \leqq \theta 1 \leqq 87°$, while has a wedge angle $\theta 2$, on a base part side of the curve, being such that $\theta 2 < \theta 1$.

8. A method of manufacturing a grooved polishing pad according to claim 7, wherein the cutting of the plurality of grooves is performed by using the multi-edged tool, and wherein a surface roughness of a region on the blade edge side of the curve on the front clearance face has an Ry value of no more than 3 μm.

9. A method of manufacturing a grooved polishing pad according to claim 7, wherein the cutting of the plurality of grooves is performed by using the multi-edged tool, and wherein a surface processing is performed on a blade edge side region of the curve on the front clearance face so that the surface roughness of the blade edge side region is less than that of a base part side region, on an other side of the curve.

10. A method of manufacturing a grooved polishing pad according to claim 7, wherein the cutting of the plurality of grooves is performed by using the multi-edged tool, and wherein a front clearance angle $\alpha$of the blade edge side of the curve in each of the pad groove machining cutting parts is in a range of $3° \leqq \alpha \leqq 60°$.

11. A method of manufacturing a grooved polishing pad according to claim 7, wherein the cutting of the plurality of grooves is performed by using the multi-edged tool, and wherein a surface treatment by lapping, using diamond particles of 10 μm or less, is performed on the blade edge side region of the curve on the front clearance face.

12. A method of manufacturing a grooved polishing pad according to claim 7, wherein the cutting of the plurality of grooves is performed by using the multi-edged tool, and wherein at a position on the multi-edged tool where a height is 2.0 mm in a direction of a depth of each groove from a blade edge on the front clearance face, the position is at a distance of separation of no more than 2.5 mm from the blade edge in a direction of cutting.

13. A method of manufacturing a grooved polishing pad according to claim 7, wherein the cutting of the plurality of grooves is performed by using the multi-edged tool, and wherein a nose radius R of the blade edge in each of the pad groove machining cutting parts is such that $R \leqq 0.05$ mm.

14. A method of manufacturing a grooved polishing pad according to claim 7, wherein the cutting of the plurality of grooves is performed by using the multi-edged tool, and wherein side clearance angles are provided on both end faces, in a width direction of the respective cutting part, in the pad groove machining cutting parts.

15. A method of manufacturing a grooved polishing pad according to claim 7, wherein the cutting of the plurality of grooves is performed by using the multi-edged tool, and wherein the cutting of the plurality of grooves is performed by using the multi-edged tool wherein the pad groove machining cutting parts are fabricated from an alloy or a steel.

16. A method of manufacturing a grooved polishing pad according to claim 7, further comprising the step of upon shifting the multi-edged tool in a direction in which the pad groove machining cutting parts are arrayed, shifting the multi-edged tool by a distance more than a distance between outermost end cutting parts of the multi-edged tool with respect to the polishing pad substrate.

* * * * *